US010159361B2

(12) United States Patent
Jolley et al.

(10) Patent No.: US 10,159,361 B2
(45) Date of Patent: Dec. 25, 2018

(54) RETAIL DISPLAY TRAY AND KNOCKDOWN

(71) Applicants: INNOVATIVE PACKAGING DESIGNS L.P., Montgomeryville, PA (US); JVC HENDRICKS BOX CO., INC., Seymour, IN (US)

(72) Inventors: Carl Jeffrey Jolley, Plymouth Meeting, PA (US); Derek Lindsey Charles Jones, Seymour, IN (US)

(73) Assignee: ROYAL BOX GROUP, LLC, Indianapolis, IN (US)

( * ) Notice: Subject to any disclaimer, the term of this patent is extended or adjusted under 35 U.S.C. 154(b) by 0 days.

(21) Appl. No.: 15/097,986

(22) Filed: Apr. 13, 2016

(65) Prior Publication Data

US 2017/0042345 A1 Feb. 16, 2017

Related U.S. Application Data

(60) Provisional application No. 62/204,539, filed on Aug. 13, 2015.

(51) Int. Cl.
*A47F 5/11* (2006.01)

(52) U.S. Cl.
CPC ..... *A47F 5/114* (2013.01)

(58) Field of Classification Search
CPC ..... A47F 5/112; A47F 5/114; B65D 5/0005; B65D 5/2047; B65D 5/2042; B65D 5/22; B65D 5/5206; B65D 5/2038; B65D 5/20; B65D 5/5273
USPC ..... 211/126.16
See application file for complete search history.

(56) References Cited

U.S. PATENT DOCUMENTS 1,448,743 A * 3/1923 Grady ..... B65D 5/5206 206/45.25
2,312,595 A * 3/1943 Smith ..... B65D 5/5206 206/45.25
2,366,602 A * 1/1945 De Haven ..... B65D 5/2047 15/257.06
2,905,371 A * 9/1959 Huff ..... B65D 5/2042 15/257.06
3,033,437 A * 5/1962 Wrage ..... B44D 3/126 15/257.06
3,193,108 A * 7/1965 Johnson ..... A47F 5/0068 206/806
3,338,469 A * 8/1967 Donovan ..... B65D 5/003 221/47
3,858,787 A * 1/1975 Bamburg ..... B65D 5/0035 15/257.06
4,128,167 A * 12/1978 Hogshead, III ..... B65D 5/2047 206/45.29
4,433,778 A * 2/1984 Maio ..... B65D 5/5206 206/45.21
4,512,541 A * 4/1985 Lietzke ..... A47F 5/112 206/45.25

(Continued)

*Primary Examiner* — Patrick D Hawn
(74) *Attorney, Agent, or Firm* — Fox Rothschild LLP

(57) ABSTRACT

A knockdown that can be assembled into a display tray, such as that of a PDQ style tray, having a bottom, front, rear and opposing side panels, and an alignment panel having an alignment portion and a connection portion divided by a fold line. The alignment panel provides for automatic alignment of the rear and side panels from the knockdown form to the display tray form. A display tray is also provided.

37 Claims, 56 Drawing Sheets

(56) References Cited

U.S. PATENT DOCUMENTS

| | | | | |
|---|---|---|---|---|
| 6,227,438 | B1 * | 5/2001 | Hiltke | A47F 3/14 220/8 |
| 6,886,737 | B2 * | 5/2005 | Dye | B65D 5/2047 206/45.21 |
| 6,915,947 | B2 * | 7/2005 | Siurek | A47F 5/112 229/101 |
| 7,784,617 | B2 * | 8/2010 | Urban | B65D 5/2038 206/45.25 |
| 8,360,255 | B2 * | 1/2013 | Chen | A47B 43/02 211/135 |
| D700,070 | S * | 2/2014 | Markovic | D9/431 |
| 9,382,030 | B2 * | 7/2016 | Miranda | B65D 5/0005 |
| 2010/0108623 | A1 * | 5/2010 | Virvo | A47F 5/112 211/49.1 |
| 2011/0192814 | A1 * | 8/2011 | Chen | A47B 43/02 211/135 |
| 2017/0042345 | A1 * | 2/2017 | Jolley | A47F 5/114 |

* cited by examiner

RETAIL DISPLAY TRAY AND KNOCKDOWN

REFERENCE TO RELATED APPLICATIONS

This is a non-provisional application of 62/204,539 filed Aug. 13, 2015, which is hereby incorporated herein by reference in its entirety.

FIELD OF THE INVENTION

The present invention relates to product displays, and more particularly to retail displays such as those used for small product packages.

BACKGROUND OF THE INVENTION

Display trays are widely used in retail stores or the like to display packaged items such as food, candy, DVDs, CDs, vitamin supplements, consumer packaged goods, toys, or the like. One style of display trays are known as PDQ trays, which stands for "Pretty Darn Quick". PDQ trays are assembled and the consumer goods are loaded on the assembled tray and sent to a retail location. At the retail location, the display tray is simply unwrapped or removed from a container and placed on a shelf such that the consumer goods are neatly displayed for purchase, i.e., they are "ready out of the box" and thus the name PDQ. Such trays are designed to be placed on retail shelves with minimum labor costs to the retailer. These trays can be printed with high end color graphics to showcase a branding message or color coated to meet various retailer driven specific needs. PDQ trays are a standard in the industry and have a multitude of tray styles.

Such PDQ point of purchase display trays, however, may have many parts and assembly is often time consuming, at least for the packer. Thus, there is a need in the art for display trays, particularly of the PDQ type, which are easy to produce, assemble, and ship to a packer, while maintaining satisfactory aesthetics and rigidity and the ease of use by the retailer.

SUMMARY OF THE INVENTION

The present invention provides an improved display tray that is assembled from a knockdown. A knockdown refers to a flat, unassembled display tray that can be opened and folded to form the completed display tray.

In one form, the invention provides a knockdown that can be assembled into a display tray and includes a bottom panel positioned between opposed front and rear panels and opposed side panels when assembled into the display tray form. An alignment panel is connected to one of the side walls along a fold line, the alignment panel having an alignment portion and a connection portion connected to one another along a fold line which intersects proximate a corner of the rear panel, the bottom panel, and the one side panel. The knockdown further includes an upper planar section of panels which includes the alignment portion, the connection portion and the one side panel. A lower planar section of panels includes the rear panel and the bottom panel. The upper and lower planar sections are adjacent to one another in a face to face relation and connected to one another along a fold line and at the connection portion. The alignment portion is foldable into face to face relation with the connection portion about the fold line therebetween so as to align the side panels and the rear panel into their display tray positions.

In a particular embodiment, the opposed side panels are connected to the rear panel along respective fold lines and the connection portion is attached in face to face relation to the bottom panel.

In another particular embodiment, the opposed side panels are connected to the bottom panel along respective fold lines and the connection portion is attached in face to face relation to the rear panel.

A unitary sheet of material, such as corrugated paperboard is preferred. As further described below, the invention provides flexibility for use in many different configurations.

BRIEF DESCRIPTION OF THE FIGURES

The foregoing summary and the following detailed description may be better understood when read in conjunction with the accompanying drawings. For the purpose of illustrating the invention, several preferred embodiments are shown in the drawings. It is understood, however, that this invention is not limited to the precise arrangements shown.

FIGS. 30-32 are plan views of the blank of FIG. 29 illustrating steps of assembly of a knockdown which may be opened into the display tray of FIG. 28 with FIG. 32 illustrating the completed knockdown.

FIGS. 50-51 are plan views of the blank of FIG. 49 illustrating steps of assembly of a knockdown which may be opened into the display tray of FIG. 48, with FIG. 51 illustrating the completed knockdown.

FIGS. 61-62 are perspective views illustrating steps of assembly of the knockdown into the display tray of FIG. 57.

DETAILED DESCRIPTION

The invention disclosed herein is a novel display tray and knockdown therefore. Described below with reference to the Figures appended hereto are several embodiments of the invention. Similar elements in the different embodiments are identified with the same reference number. Although several preferred embodiments are described below, it is recognized that the invention is not limited to the embodiments described herein.

First Embodiment

Figure 1:
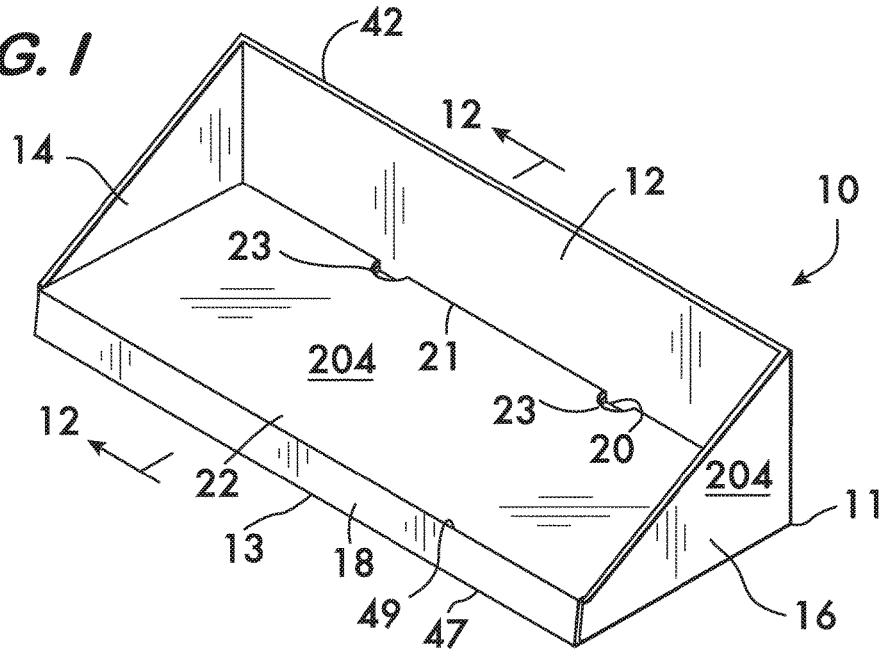
FIG. 1 is a perspective view of a display tray made in accordance with an embodiment of the present invention.

Reference now will be made in detail to a first preferred embodiment of the invention as illustrated in FIG. 1 showing a display tray 10 for displaying goods. The display tray 10 includes a rear panel 12, a front panel 18, opposed side panels 14 and 16 extending about a bottom panel 20 (see FIG. 10), and a shelf panel 22 which extends from the front panel 18 towards the rear panel 12 over the bottom panel 20 as described further below. In the illustrated embodiment, the side panels 14 and 16 each taper from the top of the rear panel 12 to the top of the front panel 18, however, the side panels 14 and 16 may have other configurations. For example, the side panels 14 and 16 may have a rear height less than the height of the rear panel 12 and/or a front height larger than a height of the front panel 18. Additionally, while the edge of each side panel 14, 16 is illustrated as having a straight configuration, such is not required and the edge may be curved or otherwise shaped.

In the illustrated embodiment, the rear edge 21 of the shelf panel 22 rests on bottom panel 20 proximate the junction of the bottom panel 20 and the rear panel 12. As such, the shelf panel 22 is sloped downwardly from the front panel 18 toward the rear panel 12. Such slope helps to maintain the goods on the shelf panel 22, however, the display tray 10 may be configured such that the shelf panel 22 is generally perpendicular to the front and rear panels 18, 12 (as described in other embodiments below) or even slopes upwardly from the front panel 18 to the rear panel 12. In one such exemplary embodiment, tabs (not shown here) extending from the rear edge 21 of the shelf panel 22 engage corresponding slots in the rear panel 12, with the location of the slots defining the slope of the shelf panel 22. In the presently illustrated embodiment, the rear edge 21 of the shelf panel 22 includes finger sized notches 23 which facilitate disassembly of the display tray 10 back to the knockdown configuration, for example, for reduced disposal size.

Figure 2:
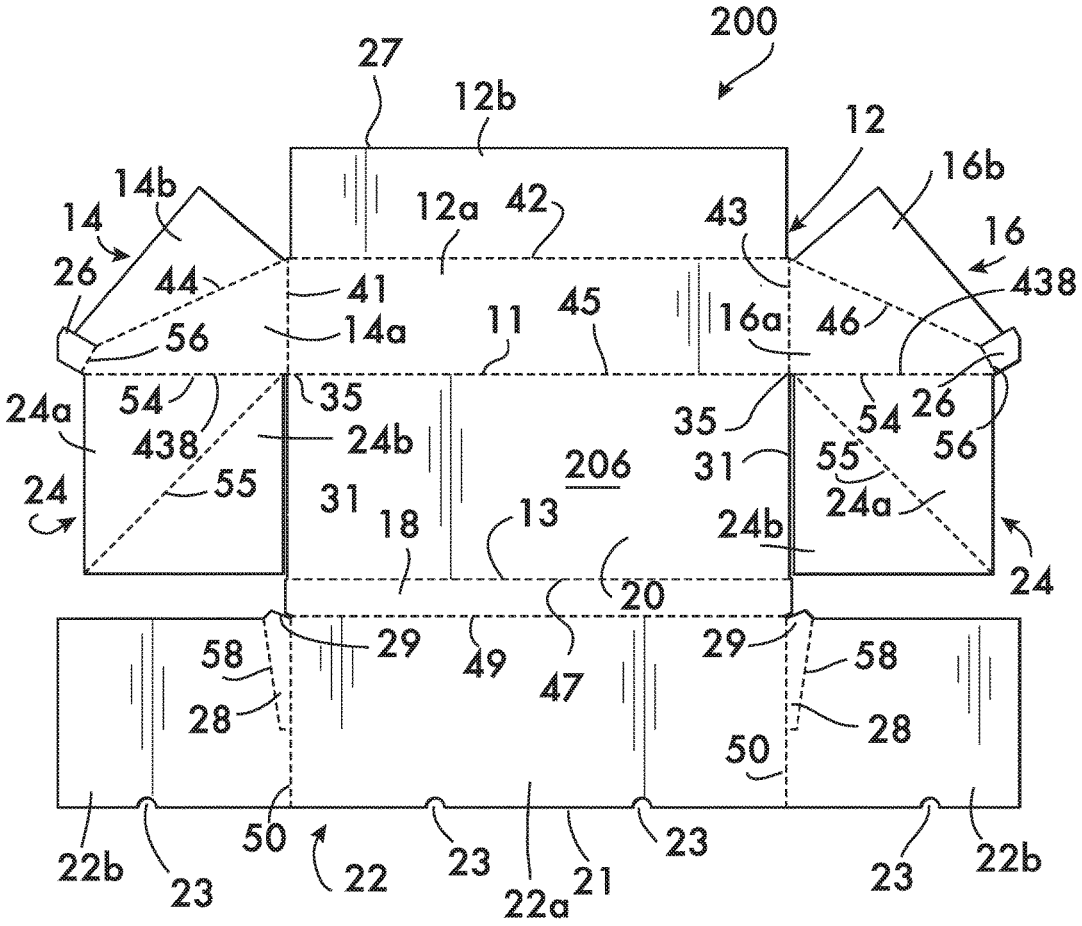
FIG. 2 is a plan view of a blank for forming the display tray shown in FIG. 1.

Referring to FIG. 2, a blank 200 for making the display tray 10 is now described. As will be described below, the blank 200 is assembled to form the knockdown 100 shown in FIG. 7, which knockdown 100 can be opened into the display tray 10 as shown in FIG. 1. The blank 200 is preferably die cut from a unitary sheet of corrugated paperboard, the illustrated embodiment preferably using mottled white corrugated sheet having an outer face 204 (see FIGS. 1 and 4) with a white paper finish that is ideal for printing, and an unfinished kraft inner face 206. The preferred corrugated grades and thickness are E, B and C, however, the invention is not limited to such. The blank 200 is oriented in FIG. 2 to show the inner face 206 of the blank 200 with the outer face 204 unseen on the underside of the blank. The term face as used herein in regard to the surfaces of the blank 200, e.g., the inner and outer faces 206 and 204, refers to the major surfaces of the blank 200 and the various panels and sections thereof.

The blank 200 includes as an integral unit the rear, side, front and bottom panels 12, 14, 16, 18 and 20, as well as the shelf panel 22. As seen, the opposing rear and front panels 12, 18, and opposing side panels 14, 16 are interconnected to one another by the bottom panel 20 which forms the bottom support surface of the display tray 10. The side panels 14, 16 are connected to the rear panel 12 along fold lines 41, 43, respectively. The rear panel 12 is connected to the bottom panel 20 along the fold line 45 which defines a rear edge 11 of the bottom panel 20. The bottom panel 20 is in turn connected to the front panel 18 along the fold line 47 which defines a front edge 13 of the bottom panel 20. The front panel 18 is connected to the shelf panel 22 along the fold line 49 which defines an upper edge of the front panel 18.

In the illustrated embodiment, the rear panel 12, the side panels 14, 16 and the shelf panel 22 include panel portions of the blank 200 folded or rolled over upon itself. More specifically, the rear panel 12 is formed by rollover panel portion 12*b* extending from a main rear panel portion 12*a* along fold line 42, and which rollover panel portion 12*b* can be folded about fold line 42 and glued to main rear panel portion 12*a* as further described below. Side panel 14 is formed by rollover panel portion 14*b* folded about fold line 44 and glued to main side panel portion 14*a*. Similarly, side panel 16 is formed by a rollover panel portion 16*b* folded about fold line 46 and glued to main side panel portion 16*a*. The shelf panel 22 is formed by a pair of rollover panel portions 22*b* extending from and folded over respective fold lines 50. Folding roll over panel portions of the blank 200 upon itself to form the panels 12, 14, 16 and shelf panel 22 provides greater rigidity, provides clean edges and the white paper finish of outer face 204 on both sides of the panels 12, 14, 16. It is understood that one or more of the panels 12, 14, 16 and/or shelf panel 22 may be formed as a single layer without the respective portion 12*b*, 14*b*, 16*b*, 22*b* of the blank 200 folded upon itself. Examples of such constructions are illustrated in additional embodiments described below.

In addition to the panels 12, 14, 16, 18 and 20 and the shelf panel 22, the blank 200 also includes a pair of alignment panels 24, a pair of tuck tabs 26 and a pair of slant back returns 28. Each alignment panel 24 extends from a respective side panel 14, 16 along a fold line 54. The alignment panels 24 each include a diagonal fold line 55 which divides the panel 24 into an alignment panel portion 24*a* and a connection panel portion 24*b*. Each diagonal fold line 55 extends from and/or intersects proximate a common corner 35 of the rear panel 12 (main portion 12*a*), the bottom panel 20, and the respective side panels 14, 16 (main panel portions 14*a*, 16*a*) at about a preferable 45 degree angle as shown. Use of the term "intersect" in this context does not mean that the fold line necessarily contacts proximate the common corner 35, but that a line extending along the fold line 55 would intersect, see, e.g., FIG. 17. As will be explained in more detail hereinafter, in forming the knockdown, each connection portion 24*b* is glued to the bottom panel 20 with the alignment panel portion 24*a* foldable relative thereto along the fold line 55 and configured to generally automatically align the respective side panels 14, 16 and rear panel 12 upon opening of the knockdown 100. In the present embodiment, the alignment panels 24, particularly the connection portions 24*b*, are shown detached from the adjacent bottom panel 20 along edge 31, although optionally it may be connected to the adjacent bottom panel 20 along a fold line as described below in reference to other embodiments. The tuck tabs 26 extend from the respective side panels 14, 16 along fold lines 56 and are configured to engage with the slant back returns 28 which are formed in the shelf panel 22, via cut lines 58, to lock the side panels 14, 16 in position upon opening of the knockdown 100 as explained in more detail hereinafter. The various fold lines are formed preferably with scores, however, it is understood that any suitable line of weakness may be used.

The blank 200 can be formed from any material suitable for use as a display, including corrugated board and chip board, e.g. mottled white corrugated board, kraft on the inside face 206 and white paper on the outside face 204. A single die cut piece of corrugated board is preferable for the illustrated embodiment. Any suitable type of score, creases, perforations, etc., may be used for the fold lines shown as known in the art.

Figure 3:
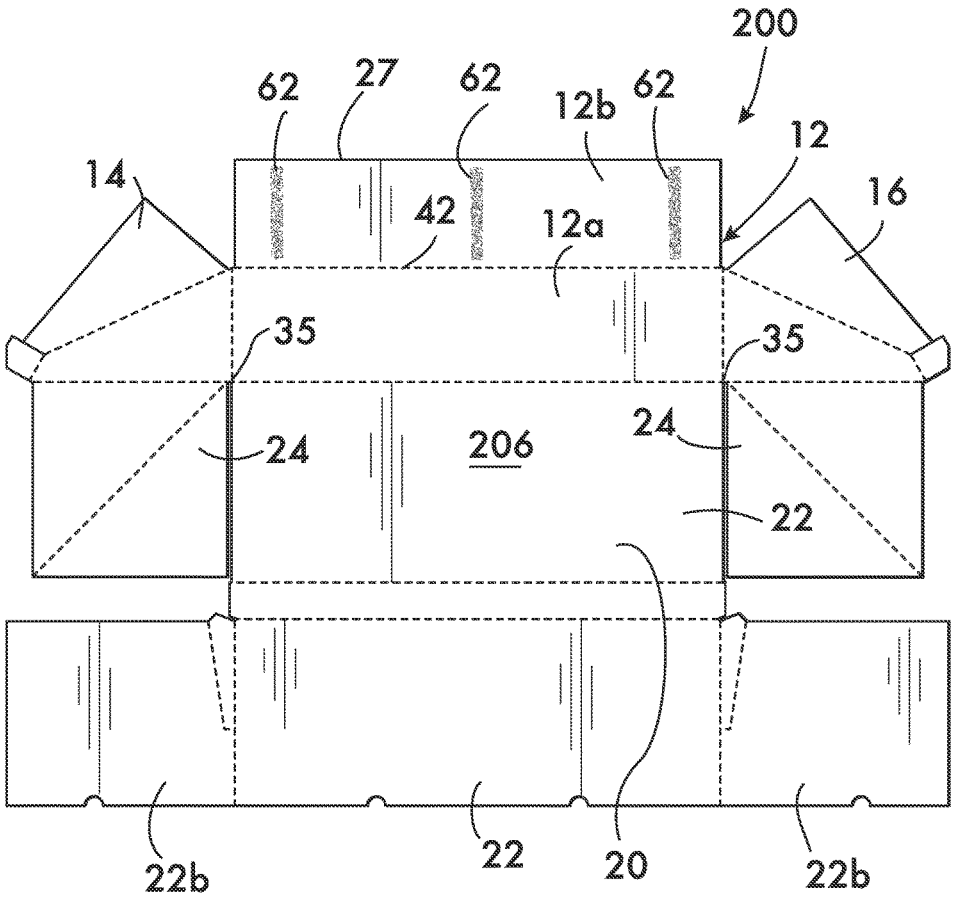
FIGS. 3-7 are plan views of the blank of FIG. 2 illustrating steps of assembly of a knockdown which may be opened into the display tray of FIG. 1, with FIG. 7 illustrating the completed knockdown.
Figure 4:
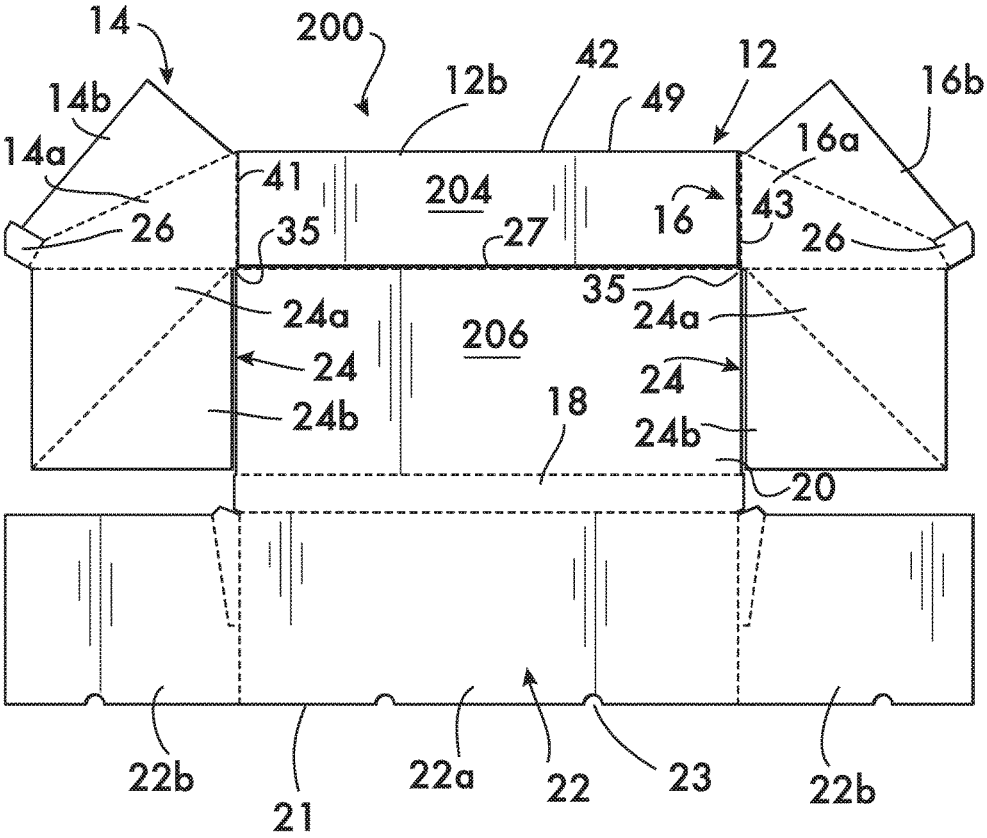

Referring to FIGS. 3-7, assembly of the knockdown 100 from the blank 200 will be described. With reference to FIG. 3, adhesive, such as a hot melt glue, is applied to the inside face 206 of the blank 200 along the glue lines 62 on the rollover portion 12*b* of the rear panel 12. Five to six dots of glue are believed sufficient for each glue line, but more or less can be used as needed. The rollover portion 12*b* then can be folded over fold line 42 and secured to the main portion 12*a* of the rear panel 12 putting the inner faces 206 of rollover portion 12*b* and main portion 12*a* in face to face relation as illustrated in FIG. 4. The edge 27 of the rollover portion 12*b* now forms a lower inside edge of the rear panel 12. A benefit of the roll over portion 12*b* is a finished edge along fold line 42 for the rear panel 12.

Figure 5:
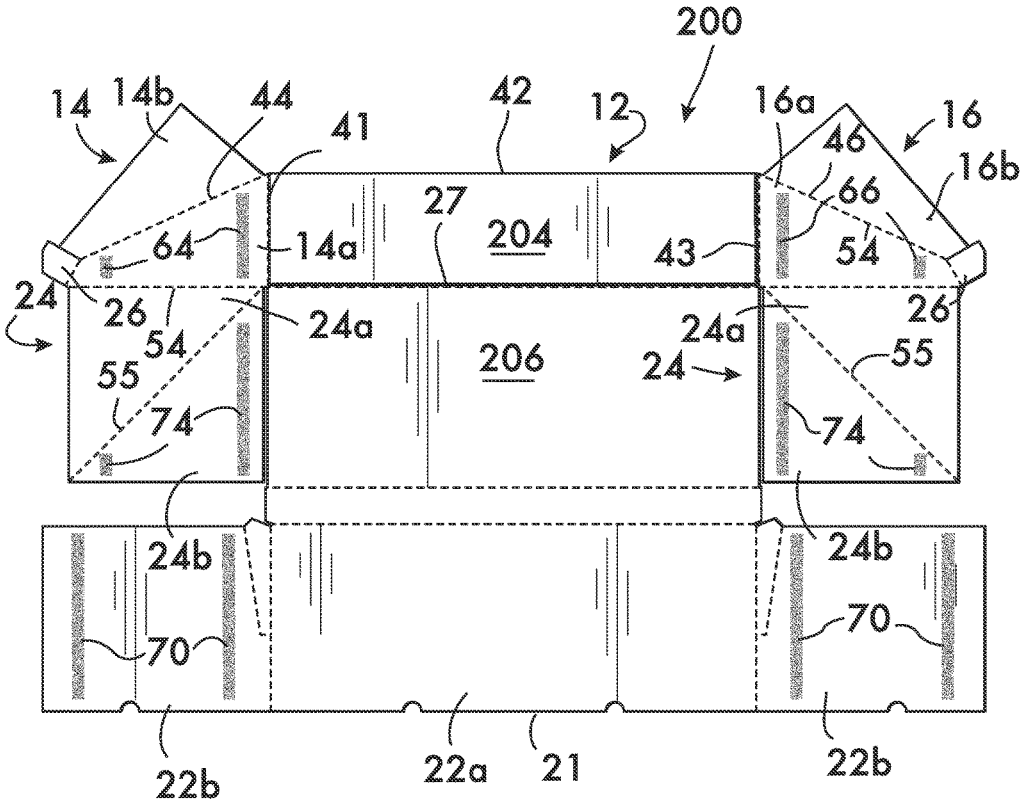
Figure 6:
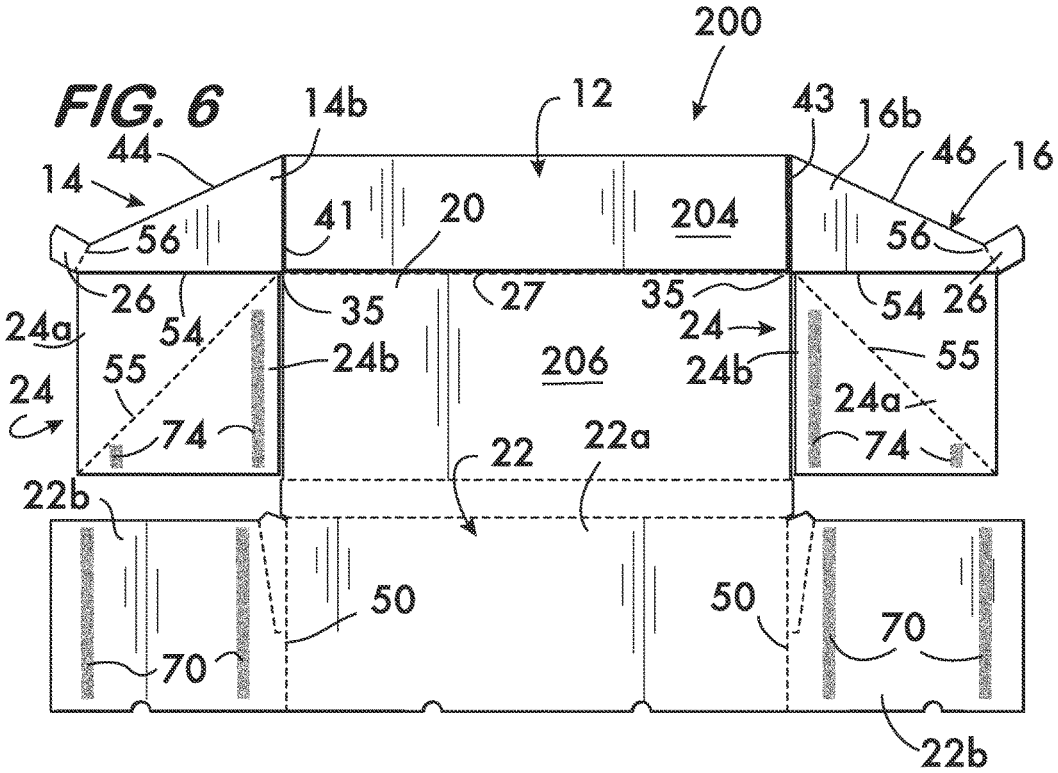
Figure 7:
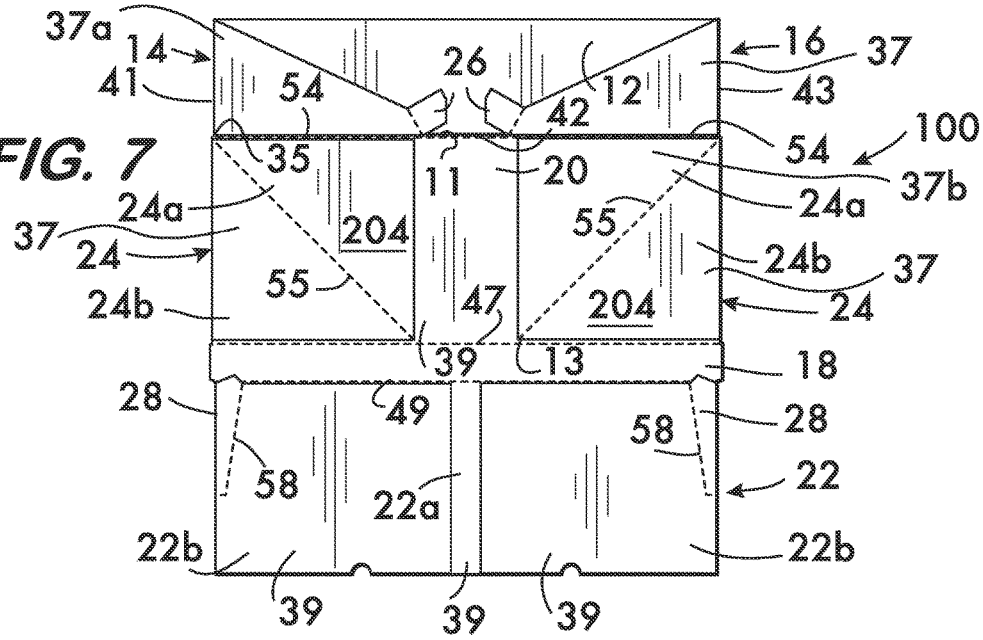

Referring to FIG. 5, adhesive, such as a hot melt glue, is applied to the inside face 206 of the blank 200 along the glue lines 64 on the main portion 14*a* of the side panel 14, along the glue lines 66 on the main portion 16*a* of the side panel 16, along the glue lines 70 on each extending rollover portion 22*b* of the shelf panel 22 and along the glue lines 74 on the connection portion 24*b* of each alignment panel 24. Turning to FIG. 6, the side panel rollover portions 14*b*, 16*b* are folded over the respective fold lines 44, 46 and secured to the respective main portion 14*a*, 16*a* in a face to face relation along their faces 206 to form the side panels 14, 16. The fold lines 44, 46 provide finished edges for the side panels 14, 16. Similarly, the rollover portions 22*b* of the shelf panel 22 are folded over the respective fold lines 50 and secured to the main portion 20*a* of the shelf panel 22 as illustrated in FIG. 7. Finally, the side panels 14, 16 with the alignment panels 24 connected thereto are folded over the fold lines 41, 43 as a unit to bring the side panels 14, 16 and alignment panels 24 into face to face relation with the rear panel 12 and bottom panel 20, bringing the inner faces 206 of connection portions 24*b* into contact with the inner face 206 of bottom panel 20. The connector panel portions 24*b* are secured to the bottom panel 20 by the glue lines 74 while the alignment panel portions 24*a* and the side panels 14, 16 remain free relative to the face of the bottom panel 20 and the rear panel 12 for movement as described below.

As seen in FIG. 7, in the final knockdown form 100, the alignment panel portion 24*a*, connection panel portion 24*b*, and the side panels 14, 16 form a substantially same upper planar section 37, having first and second portions 37*a*, 37*b*, which is positioned adjacent to and in face to face relation with rear panel 12 and bottom panel 20 which together form a substantially same lower planar section 39, which lower planar section also includes the front panel 18 and the shelf panel 22. Put another way, the knockdown 100 includes upper and lower planar sections 37 and 39 in a proximate face to face parallel relation connected to one another at edges defined by fold lines 41 and 43 and at glue joints (glue lines 74) between the connection portion 24*b* and the bottom panel 20. The upper planar section 37, which includes portion 37*a* and 37*b*, includes side panels 14, 16, alignment portion 24*a*, and connection portion 24*b* (the side panel 14 and respective alignment panel 24 connected thereto forming the first upper planar portion 37*a*, the side panel 16 and its respective alignment panel 24 connected thereto forming the second upper planar portion 37*b*). The lower planar section 39 includes the rear panel 12, bottom panel 20, front panel 18, and shelf panel 22. It is appreciated that the term "planar section" as used in this context allows for tolerances due to bending and warping of the paperboard material and the thickness of the planar sections due to rollovers, for example, the side panels 14, 16, which include main side panel portions 14*a*, 16*a* and rollover side panel portions 14*b*, 16*b*, adhered thereto are all included in the upper planar section 37. The knockdown 100 is now complete and may be shipped to a packer in the flat form illustrated in FIG. 7.

Figure 8:
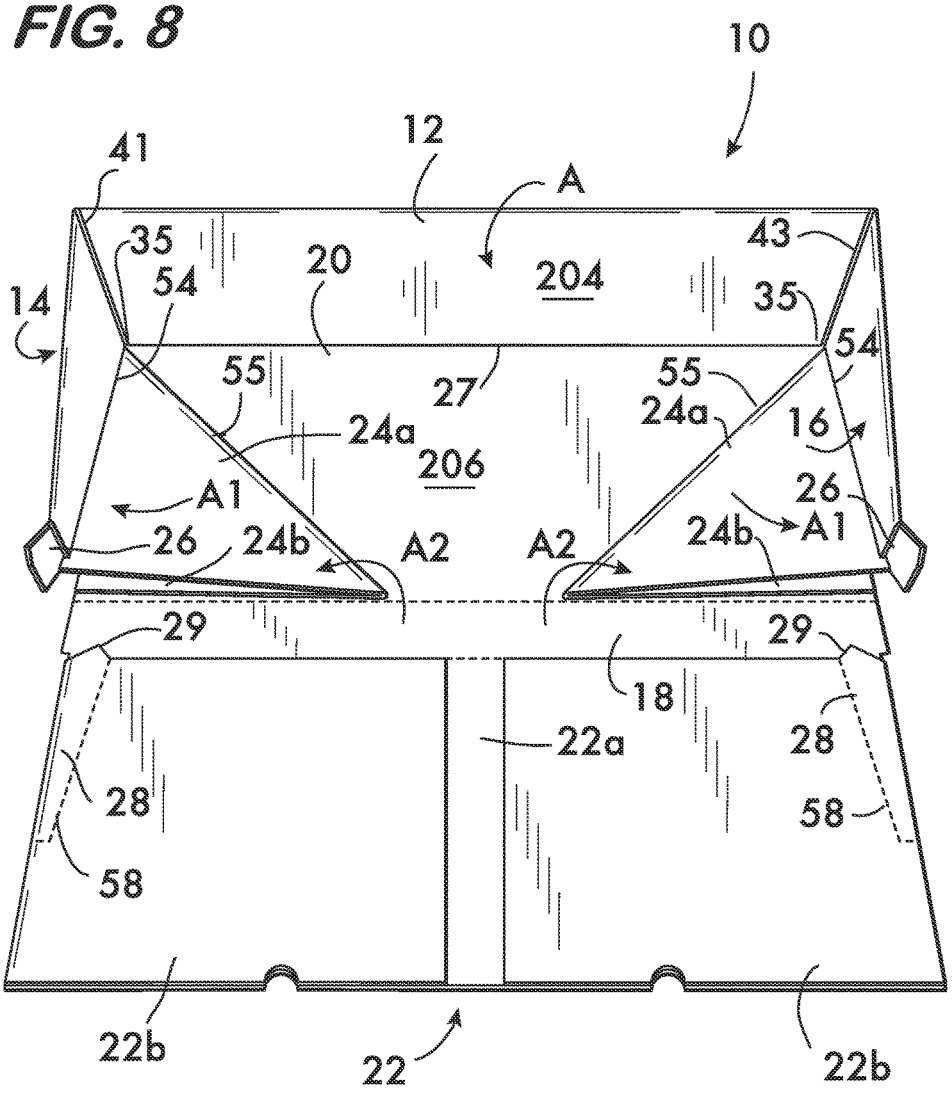
FIGS. 8-10 are perspective views illustrating steps of assembly of the knockdown into the display tray of FIG. 1.

Assembly of the knockdown 100 into the display tray 10 will be described with reference to FIGS. 8-16. First, the rear and side panels 18, 14, 16 are moved from the knockdown form into the alignment of their display tray positions (see FIG. 1) using the alignment panels 24. Referring to FIG. 8, it is seen that as each alignment panel portion 24*a* folds about fold line 55 onto its respective connection portion 24*b* into a face to face relation of their outer faces 204 as indicated by arrow A2, in response thereto, the rear panel 12 and the side panels 14, 16 move simultaneously towards their final display tray 10 positions, folding around respective fold lines 45, 54. This can be initiated in various different ways. One way is to rotate the rear panel 12 upward around fold line 45 as indicated by arrow A into its display tray position which causes the folding of the alignment panel 24 as discussed above, which in turn causes the side panels 14, 16 to rotate around fold line 54 outward as indicated by the arrows A1. The side panels 14, 16 also unfold relative to the rear panel 12 around the fold lines 41, 43. The alignment panels 24 thereby align each side panel 14, 16 to generally align with a respective side edge of the bottom panel 20, with the side panels 14, 16 and the rear panel 12 generally perpendicular to the bottom panel 20. Put another way, and with reference to FIG. 8, as the rear panel 18 is folded about fold line 45 as shown by arrow A, the alignment portion 24*a* folds about the fold line 55 into face to face relation with the connection portion 24*b*, which causes the side panels 14, 16 to move out of the first planar section 37 towards their final display tray positions.

Alternatively, one could initiate the assembly by movement of the side panels 14, 16 folding around fold lines 54 as shown by arrows A1, which causes the alignment panel 24*a* to fold around the fold line 55 onto the connection portion 24*b* as shown in FIG. 8, while at the same time causing the movement of the rear panel 12 as shown by arrow A into its display tray form. In either case, it is seen that alignment panel portion 24*a* rotating around the fold line 55, bringing together in face to face relation the outer faces 204 of the alignment and connection portions 24*a*, 24*b*, regardless of whether initiated by moving the side panels 14,16, the rear panel 12 or any other way, causes the side panels 14, 16 and rear panel 12 to move into their display tray positions.

Figure 9:
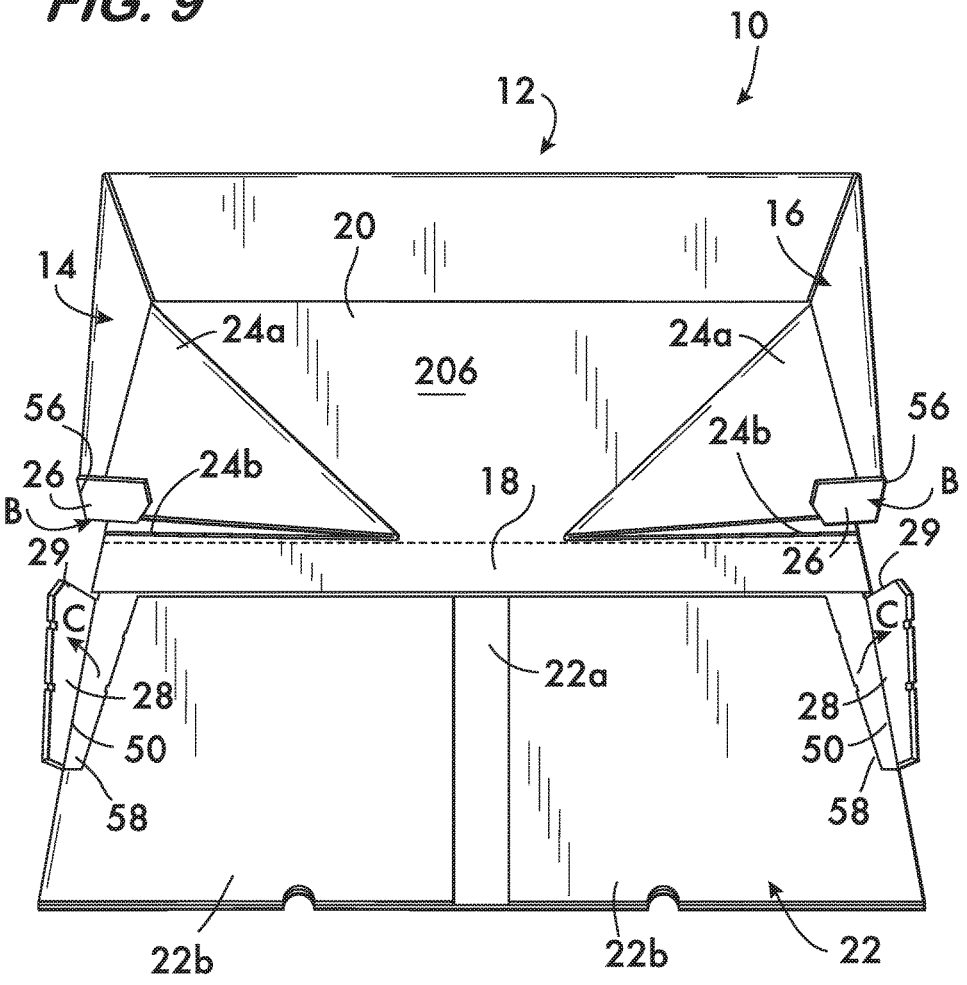

Turning to FIG. 9, each of the tuck tabs 26 is folded along fold line 56 in the direction indicated by arrow B to a position wherein each tuck tab 26 is generally parallel with the front edge 13 of the bottom panel 20. Also, each of the slant back returns 28 is released from the respective extending rollover panel 20*b* along the cut lines 58 and rotated outward as indicated by arrow C. Each of the slant back returns 28 remains connected to the shelf panel main panel 20*a* along the respective fold line 50.

Figure 15:
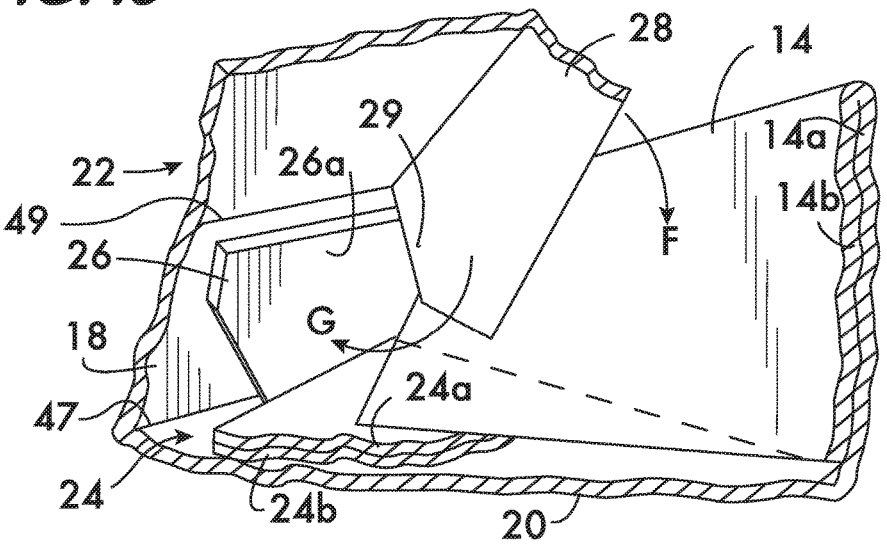
FIG. 15 is an expanded perspective view illustrating positioning of the slant back returns relative to the tuck tabs.
Figure 10:
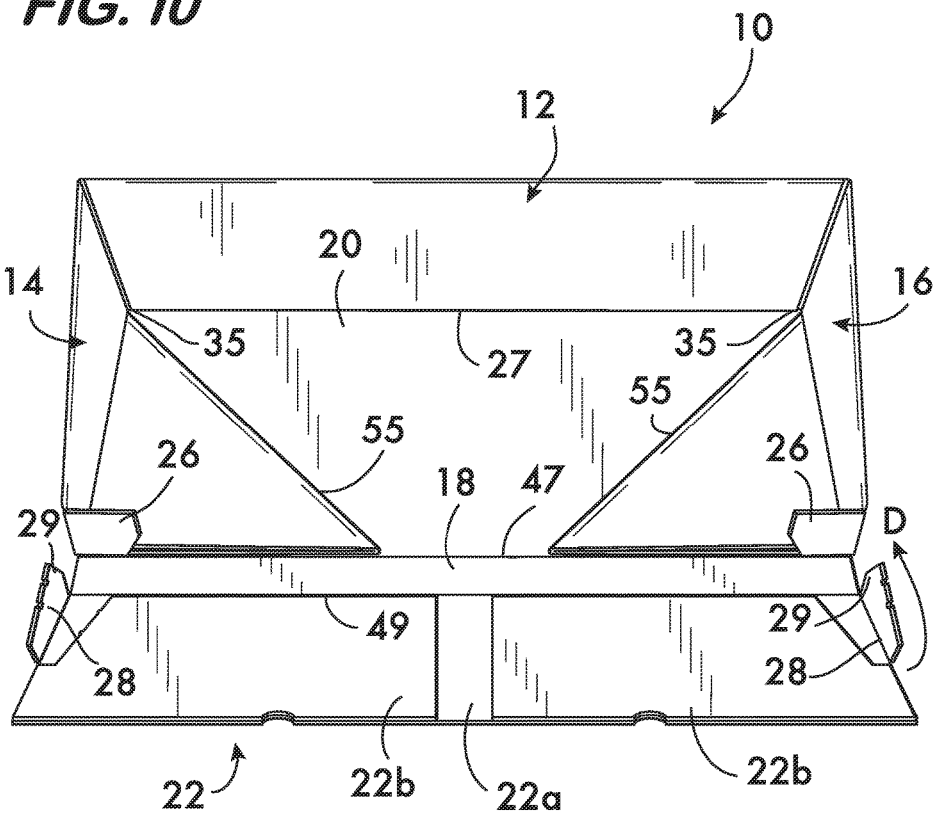
Figure 11:
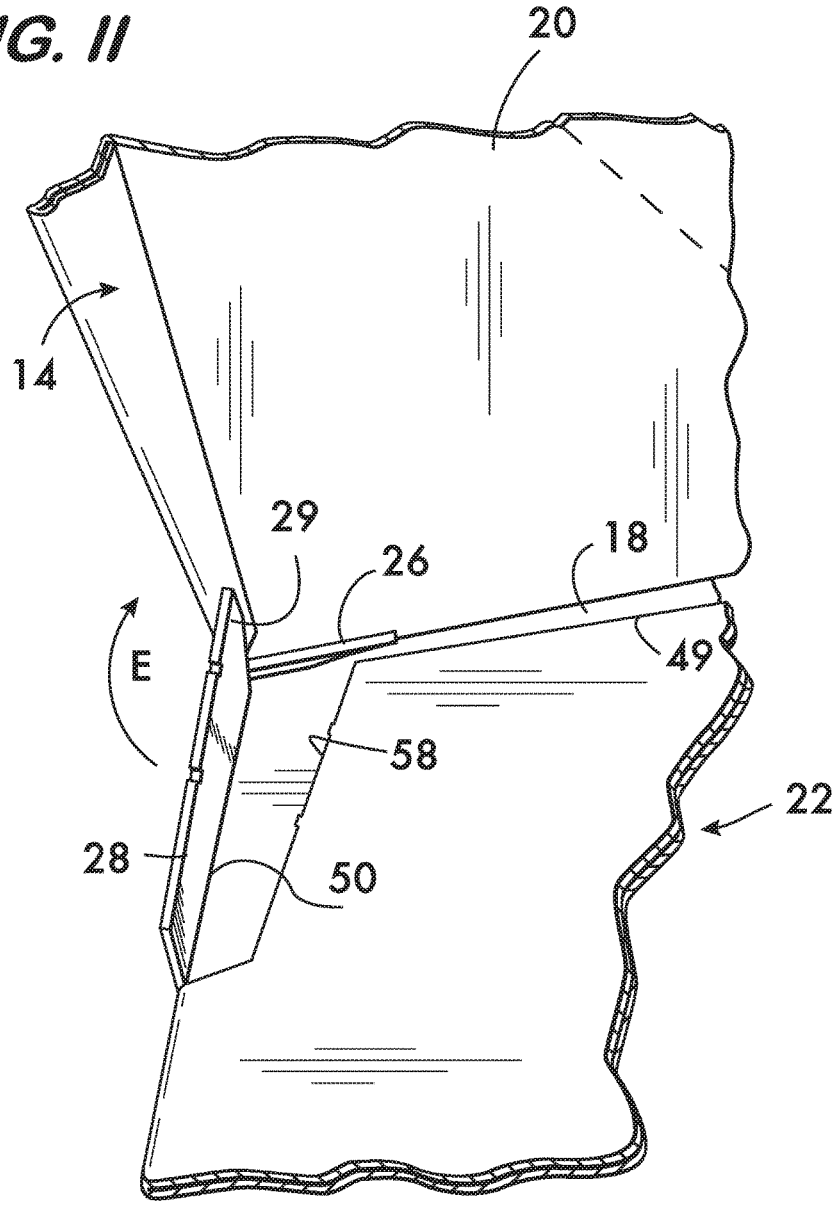
FIG. 11 is an expanded perspective view illustrating a step of assembly of the knockdown into the display tray of FIG. 1.
Figure 12:
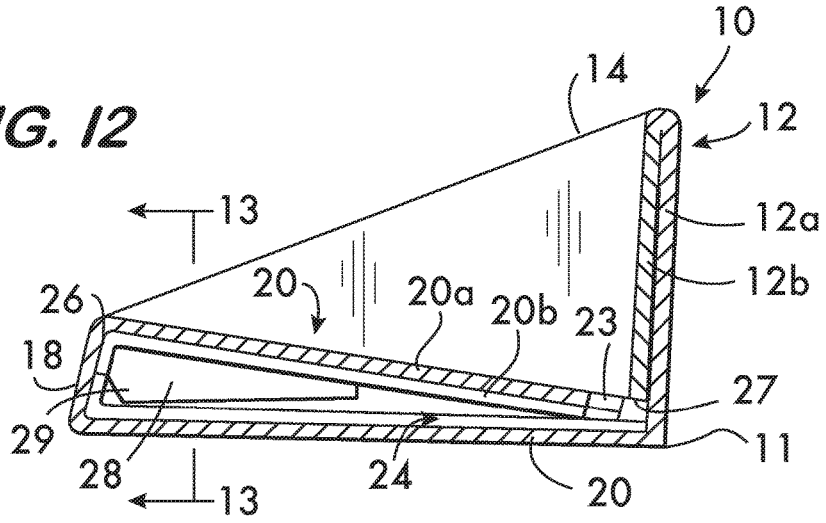
FIG. 12 is a cross-sectional view along the line 12-12 in FIG. 1.
Figure 13:
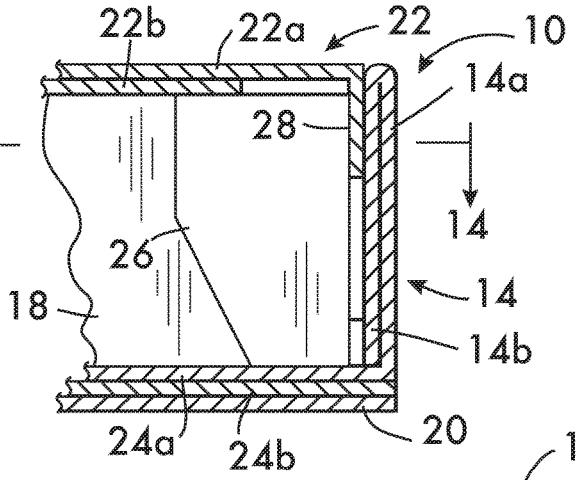
FIG. 13 is a cross-sectional view along the line 13-13 in FIG. 12.
Figure 14:
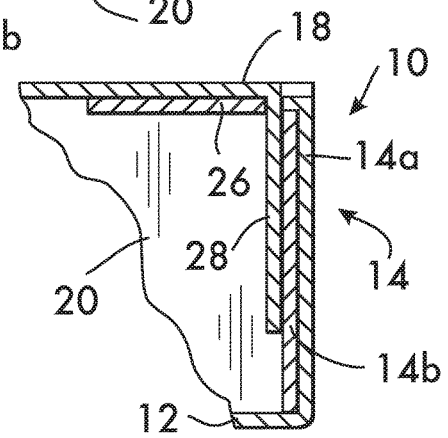
FIG. 14 is a cross-sectional view along the line 14-14 in FIG. 13.

Referring to FIG. 10, the front panel 18 and the shelf panel 22 are pivoted about the fold lines 47 and 49, as indicated by arrow D, such that the slant back returns 28 move toward the tuck tabs 26. As illustrated in FIG. 11, the projecting portions 29 of the slant back returns 28 are guided over the tuck tabs 26 as the front panel 18 approaches the tuck tabs 26 and the shelf panel 22 continues to pivot about fold line 49 as indicated by arrow E. Turning to FIG. 15, as the shelf panel 22 is further pivoted, as indicated by arrow F, the projection portion 29 of each slant back return 28 engages the inside surface 26*a* of the respective tuck tab 26 as indicated by arrow G. The shelf panel 22 is pivoted until the back edge 21 thereof is proximate the rear of the bottom panel 20, as shown in FIGS. 1 and 12, and assembly of the display tray 10 is thereby complete. Referring to FIGS. 12-14, with the shelf panel 22 positioned in the final assembly position, the tuck tab 26 is retained in the space between the projecting portion 29 of the slant back return 28 and the front panel 18. The display tray 10 maintains the assembled configuration without the need for any further fasteners or the like. Additionally, since the display tray 10 is assembled from a single knockdown 100 simply by folding the side panels 14, 16 and/or rear panel 12 (movement of one moves the other), and then the shelf panel 22 with the integral slant back returns 28 about the tuck tabs 26, assembly is simplified and the assembly time reduced.

Second Embodiment

A second embodiment of the present invention is now described with reference to FIGS. 16 to 27. Differences between the display tray 300 of FIG. 16 and the display tray 10 of FIG. 1 include the inclusion of tabs 302 which extend from the shelf panel 22 for engagement with corresponding slots 304 in rear panel 12, and reinforcement panels 308 and 310 as seen in FIG. 17 which reinforce front panel 18 and shelf panel 22.

Figure 17:
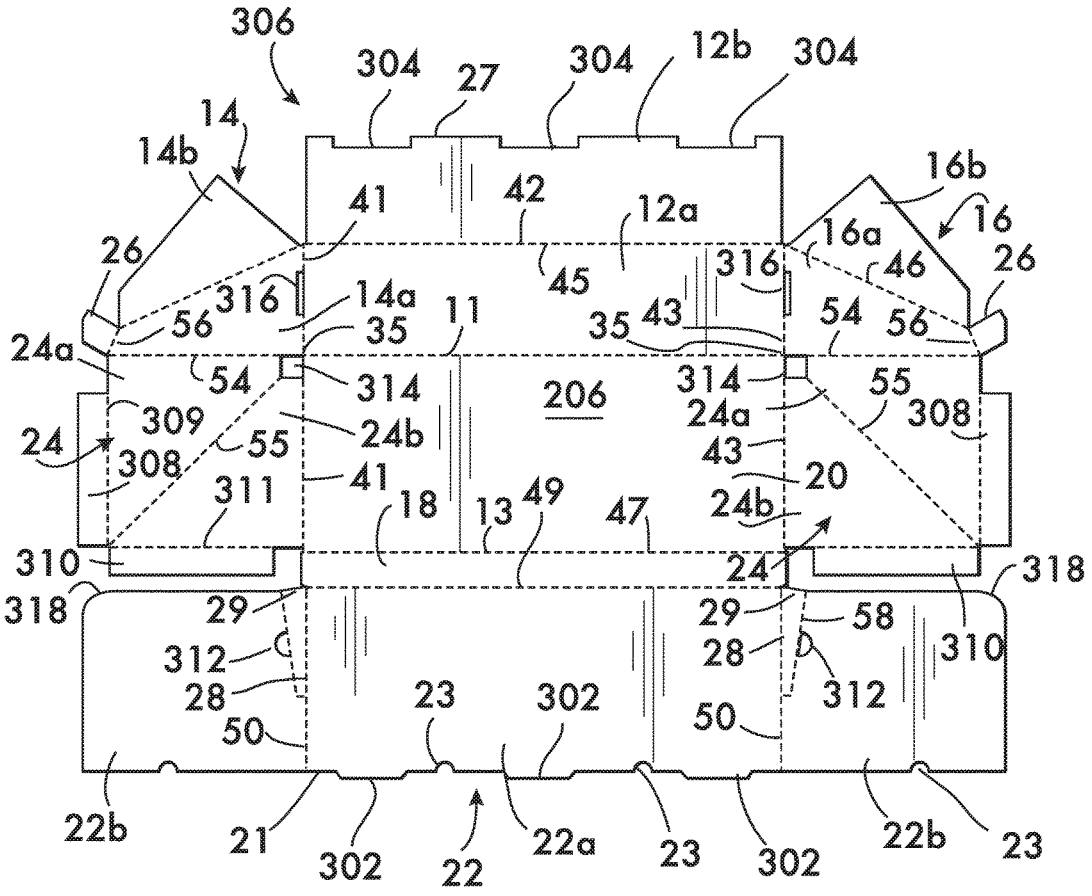
FIG. 17 is a plan view of a blank for forming the display tray shown in FIG. 16.
Figure 21:
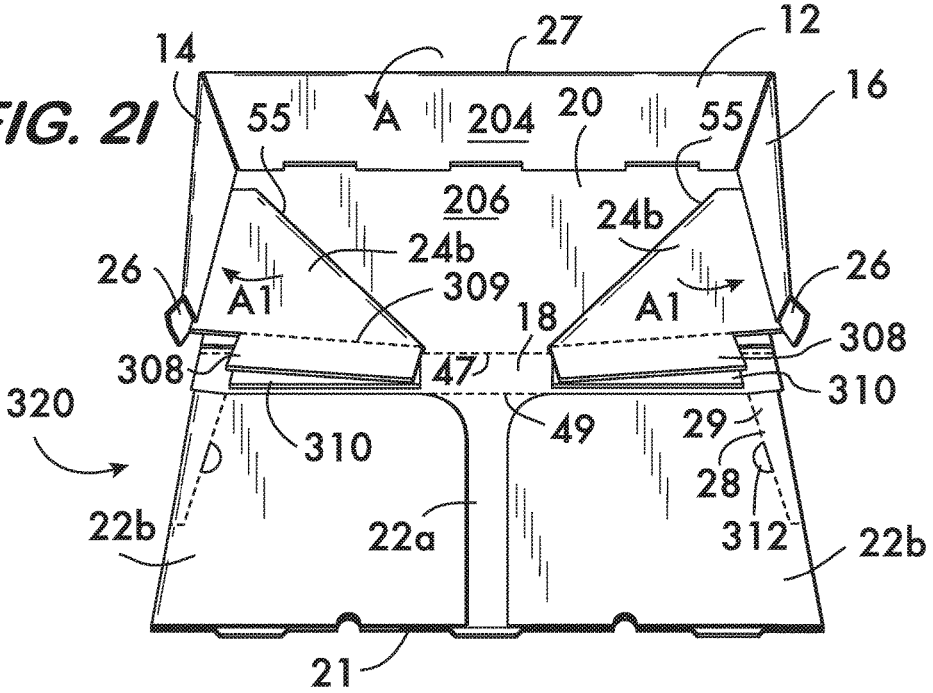
FIGS. 21-23 are perspective views illustrating steps of assembly of the knockdown into the display tray of FIG. 16.

Referring to FIG. 17, a blank 306 for making the display tray 300 is illustrated. It is similar to that described above for blank 100 with the exceptions now described. The blank 306 includes the tabs 302 extending from the rear edge 21 of the shelf panel 22, and the corresponding slots 304 in the edge 27 of the rear rollover panel 12*b*. The blank 306 further includes reinforcement panels 308 integrally connected to an edge of the alignment portions 24*a* along fold line 309, and reinforcement panels 310 integrally connected to an edge of the connection portions 24*b* along fold line 311. The fold lines 309 and 311 can be configured to be offset from one another when the alignment panel portions 24*a* and the connection panel portions 24*b* are folded onto one another as seen in FIG. 21 so that the two reinforcement panels 308 and 310 can pivot upwardly without interfering with each other (see FIG. 27). The reinforcement panels 308 and 310 add strength and stiffness to the front panel 18 and the shelf panel 22 as described below, it being appreciated that the reinforcing panels are optional and that one or both sets of panels 308 or 310 can be provided depending on the strength desired.

Cutouts 312 in the shelf panel rollover portions 22*b* for the user's finger facilitate the release of slant back returns 28 during assembly. Additionally, the corner edge 318 of the extending portions 22*b* are rounded as compared to the prior described embodiment. Unlike the previous embodiment, here, the alignment panels 24, i.e., the connection portions 24*b* thereof, are connected to the adjacent bottom panel 20 along fold lines 41 and 43 respectively. Finally, cutouts 314 and 316 make the folding process easier during assembly by reducing bunching.

Figure 16:
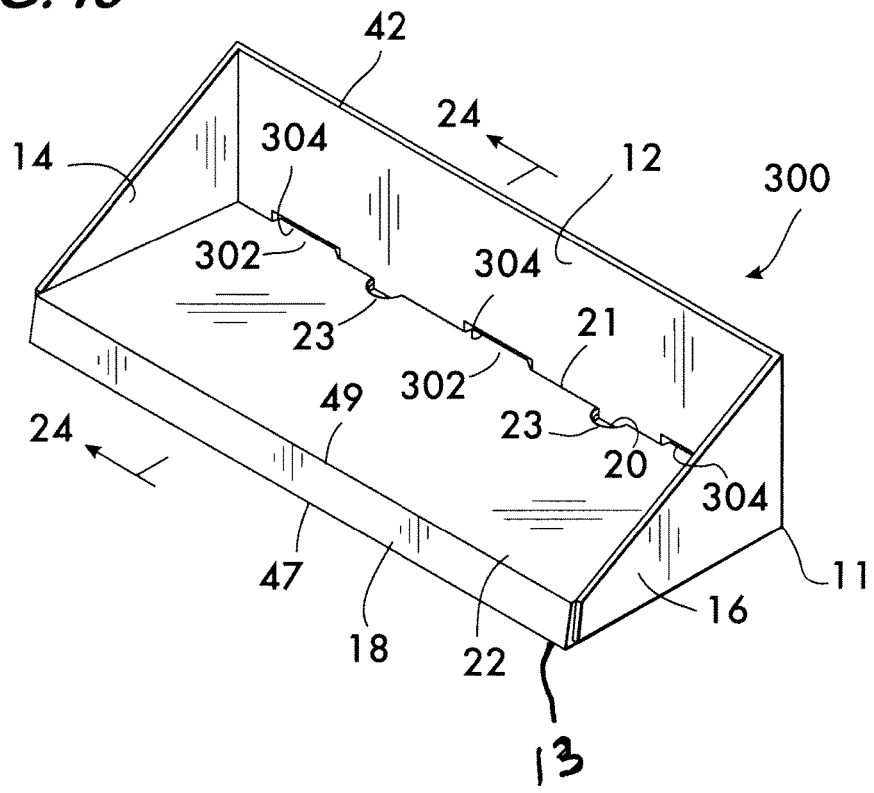
FIG. 16 is a perspective view of a display tray made in accordance with a second embodiment of the present invention.
Figure 18:
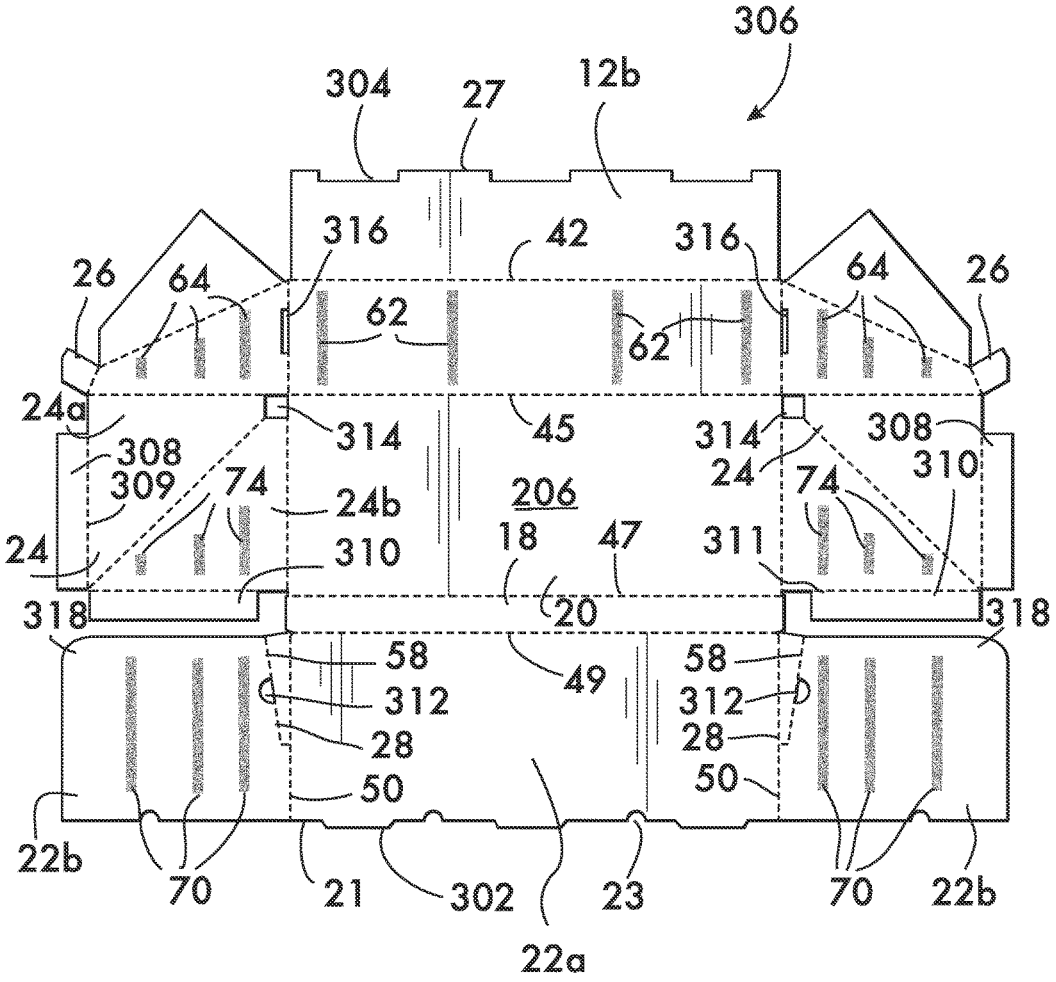
FIGS. 18-20 are plan views of the blank of FIG. 17 illustrating steps of assembly of a knockdown which may be opened into the display tray of FIG. 16, with FIG. 20 illustrating the completed knockdown.
Figure 19:
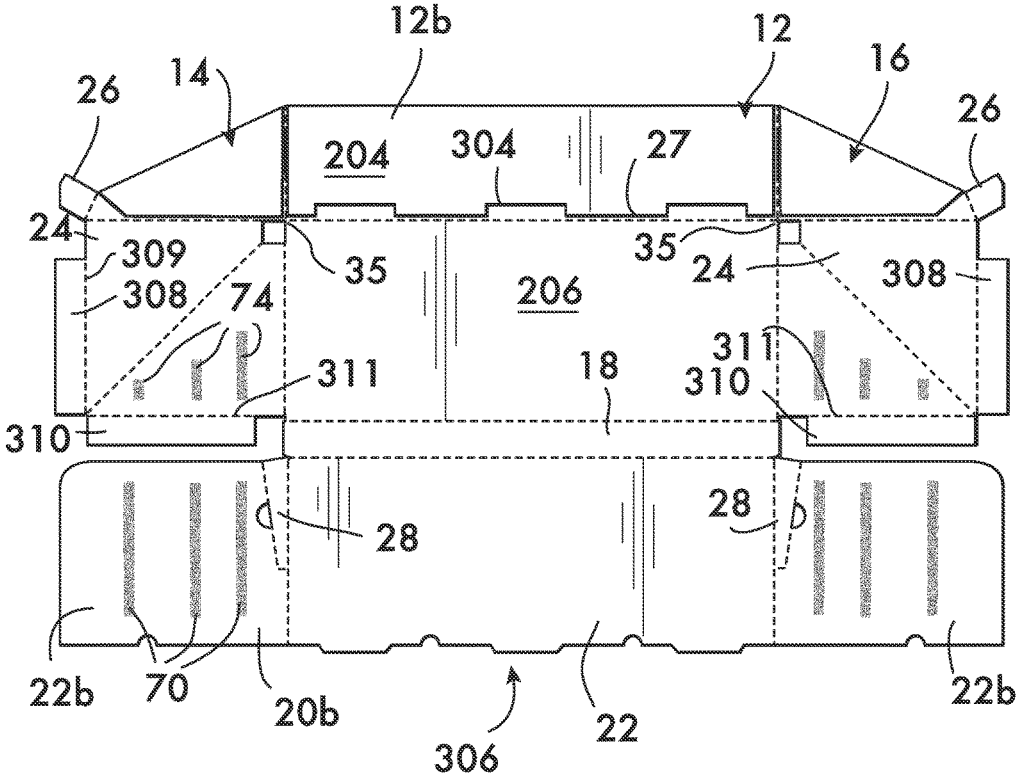
Figure 20:
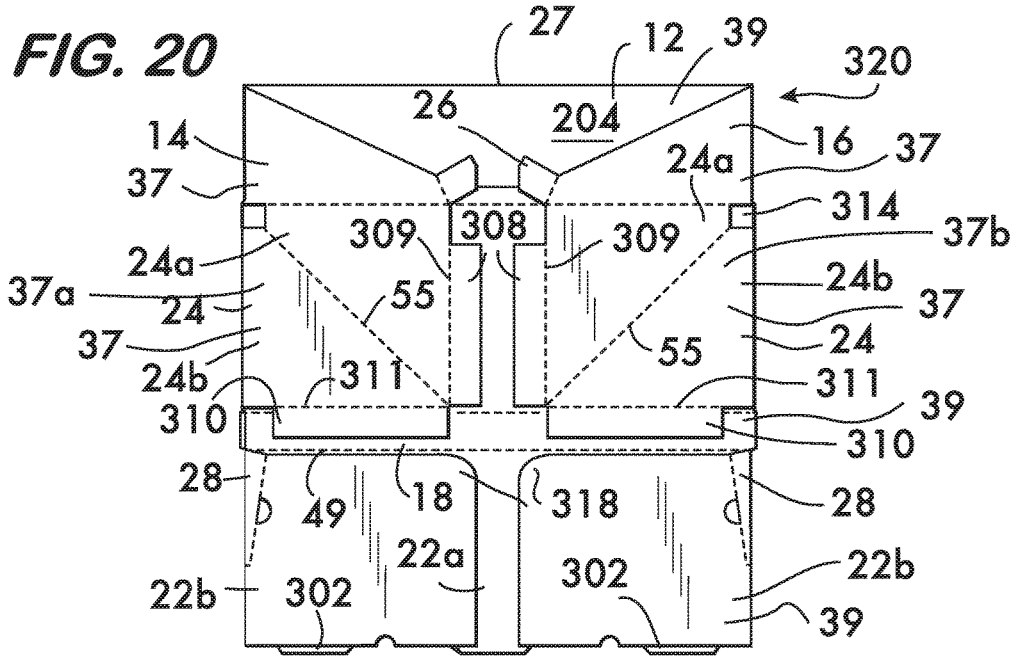

The blank 306 is assembled to form the knockdown 320 shown in FIG. 20, which knockdown can be opened into the display tray 300 shown in FIG. 16. The assembly process illustrated in FIGS. 18-20 is similar to that described above with reference to display tray 10, although alternative adhesive patterns for glue lines 62, 70 and 74 are shown. Additionally, with reference to FIG. 20, it is seen that the reinforcement panels 308 and 310 extending from the alignment panels 24 form part of the upper planar section 37 of the knockdown, which sit over the lower planar section 39.

Assembly of the knockdown 306 into the display tray 300 is illustrated in FIGS. 21-26 and is done as described above for the display tray 100 with minor differences. As noted previously, the side panels 14, 16 and rear panel 12, and tuck panels 26 are moved into their display tray positions. The slant back returns 28 are easily released from the respective rollover shelf panels 20*b* along the cut lines 58 using cut out 312 and rotated outward as indicated by arrow C. Each of the slant back returns 28 remains connected to the shelf main panel 20*a* along the respective fold line 50.

Figure 22:
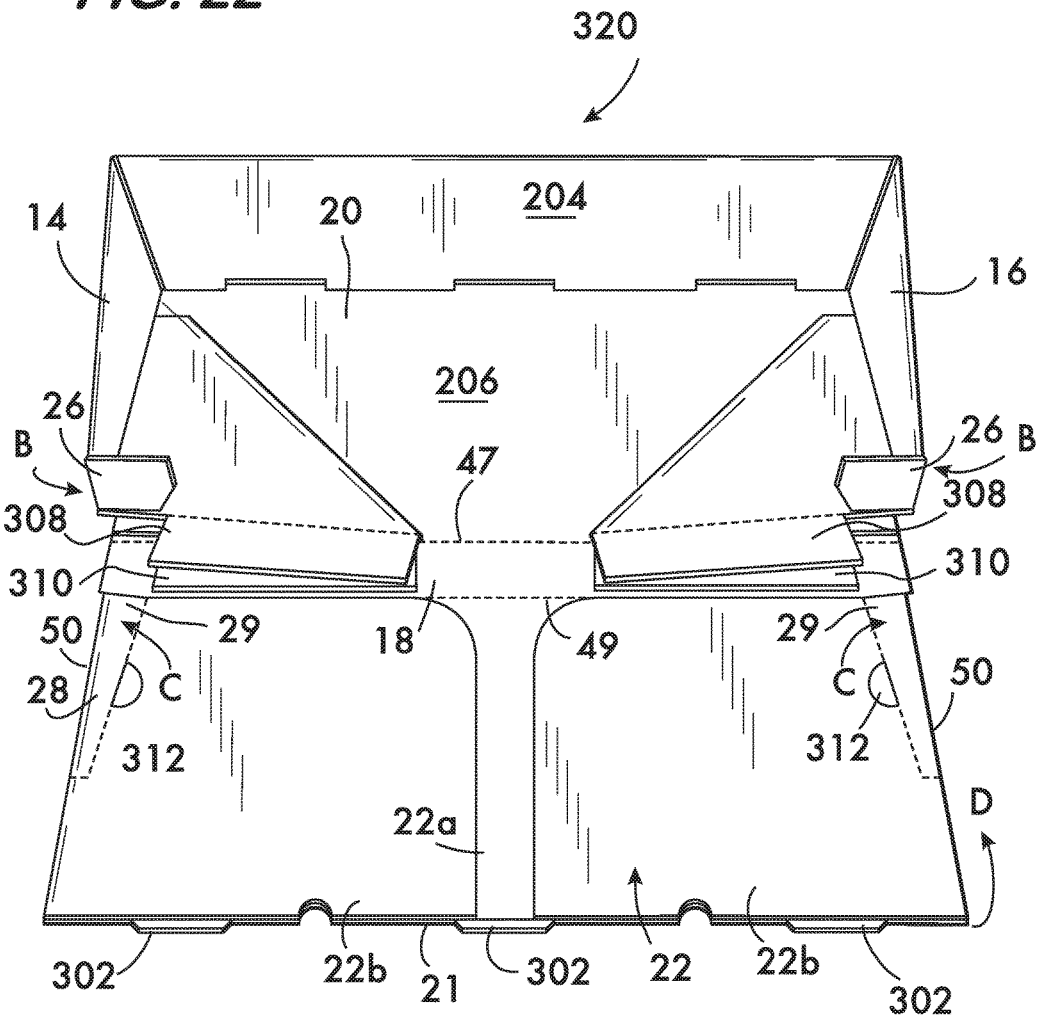
Figure 23:
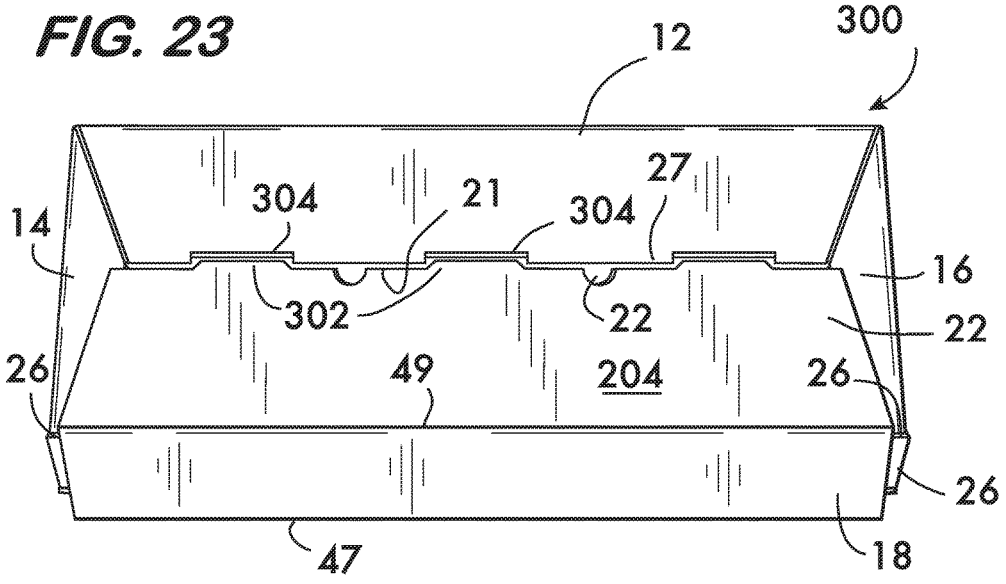
Figure 27:
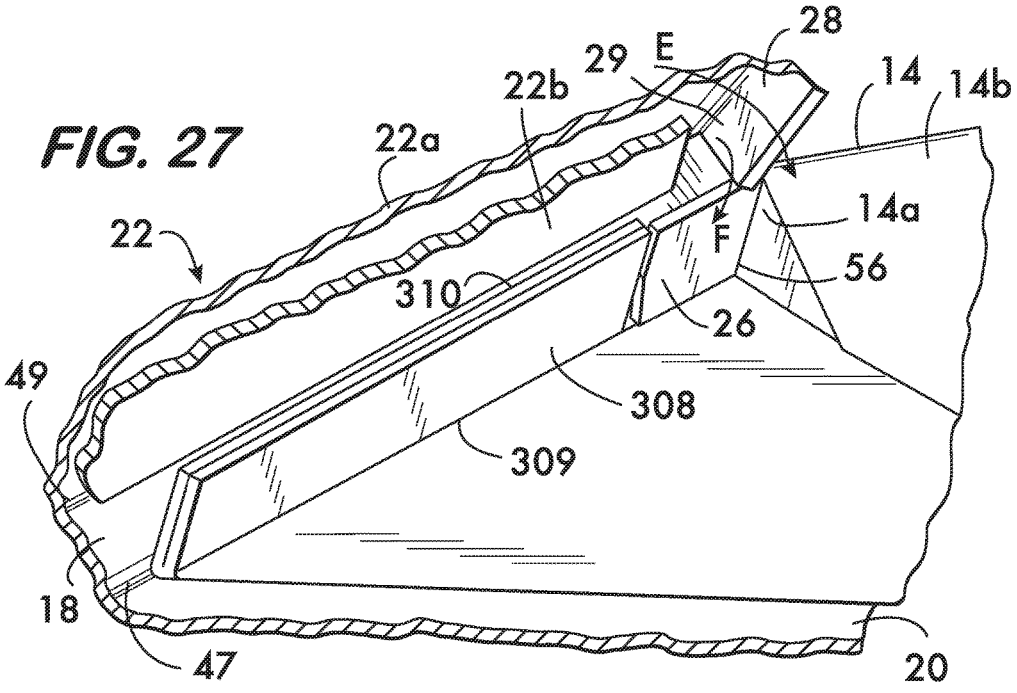
FIG. 27 is an expanded perspective view illustrating the position of the reinforcing panels.

With reference to FIGS. 22 and 27, it is appreciated that the front panel 18 and the shelf panel 22 are pivoted about the fold lines 47 and 49, as indicated by arrow D, such that the slant back returns 28 move toward the tuck tabs 26 as in the previous embodiment. The projecting portions 29 of the slant back returns 28 are guided over the tuck tabs 26 as the front panel 18 approaches the tuck tabs 26, and, unlike the previous embodiment, the reinforcing panels 308 and 310 fold and align with the front panel 18 as the shelf panel 22 is continued to be pivoted about fold line 49 as indicated by arrow E. Turning to FIG. 27, as the shelf panel 22 is further pivoted in the direction indicated by arrow E, the projection portion 29 of each slant back return 28 engages the inside surface of the respective tuck tab 26 as indicated by arrow F. The shelf panel 22 is pivoted until the back edge 21 thereof is proximate the bottom panel 20, as shown in FIG. 23, whereby the tabs 302 engage corresponding slots 304 and assembly of the display tray 10 is thereby complete. See also FIGS. 24-26.

Figure 24:
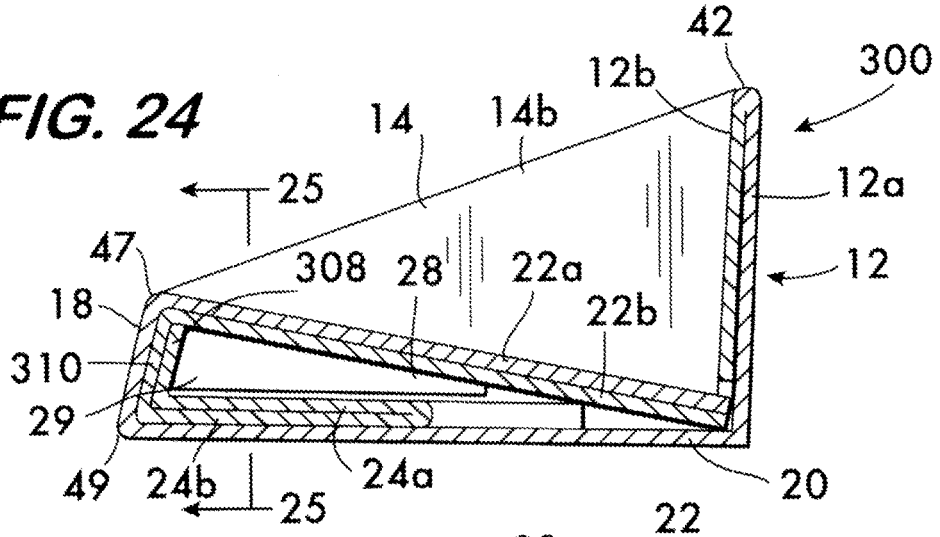
FIG. 24 is a cross-sectional view along the line 24-24 in FIG. 16.
Figure 25:
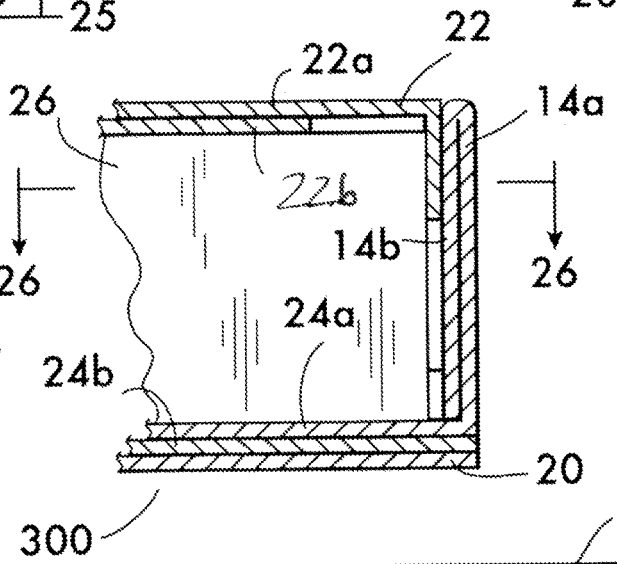
FIG. 25 is a cross-sectional view along the line 25-25 in FIG. 24.
Figure 26:
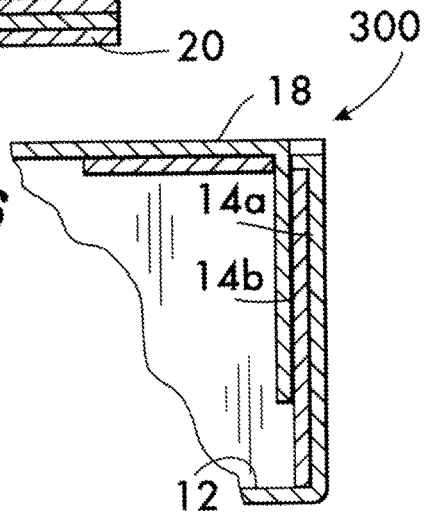
FIG. 26 is a cross-sectional view along the line 26-26 in FIG. 25.

Referring to FIGS. 27 and 24, it is appreciated that the reinforcing panels 308 and 310 disposed behind the front panel 18 under the shelf panel 22 provide additional stiffness across the front edge of the display tray 300 thereby allowing the display tray 300 to hold heavier items without warping or false scoring along the front of the display tray.

Third Embodiment

A third embodiment will now be described with reference to FIGS. 28-37 showing a display tray 350 similar to the display tray 10 shown in FIGS. 1-15, but with squared side walls 14, 16 and with a non-sloped recessed shelf panel 22.

Figure 29:
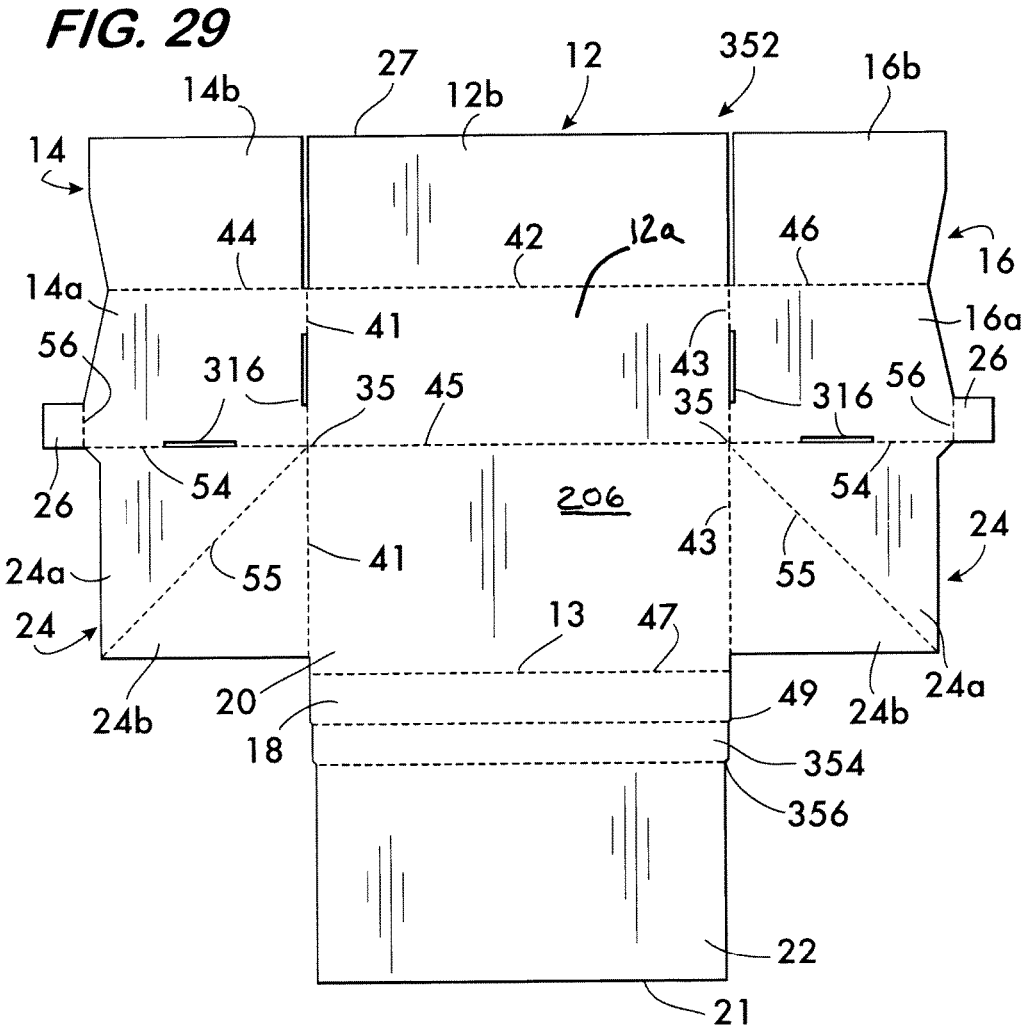
FIG. 29 is a plan view of a blank for forming the display tray shown in FIG. 28.

Referring to FIG. 29, the blank 352 for the display tray 350 includes as an integral unit the rear, side, front and bottom panels 12, 14, 16, 18 and 20, and the shelf panel 22. The side panels 14, 16 are shaped to form square sides when folded along fold lines 44, 46, and are connected to the rear panel 12 along fold lines 41, 43, respectively. The rear panel 12 is connected to the bottom panel 20 along the fold line 45. The bottom panel 20 is in turn connected to the front panel 18 along the fold line 47. The front panel 18 is connected to a rollover front panel 354 along fold line 49, and the rollover front panel 354 is connected to the shelf panel 22 along fold line 356. As with the embodiments described above, the rear panel 12, and the side panels 14, 16 include portions of the blank 352 folded or rolled over upon themselves—the rear panel 12 is formed by rollover portion 12*b* folded about fold line 42 and glued to main rear panel portion 12*a*; side panel 14 is formed by rollover portion 14*b* folded about fold line 44 and glued to main side panel portion 14*b*; and side panel 16 is formed by rollover portion 16*b* folded about fold line 46 and glued to main side panel portion 16*a*. The shelf panel 22 here is formed of the single panel 22 as the rollover portions 22*b* provided in the previous embodiments (see, e.g. FIG. 2) are not needed for strength since the shelf panel 22 will rest on panels beneath as described below.

As with the previously described embodiment, the blank 352 also includes a pair of alignment panels 24, and a pair of tuck tabs 26. The slant back returns 28 of prior described embodiments are not provided in this embodiment.

Figure 28:
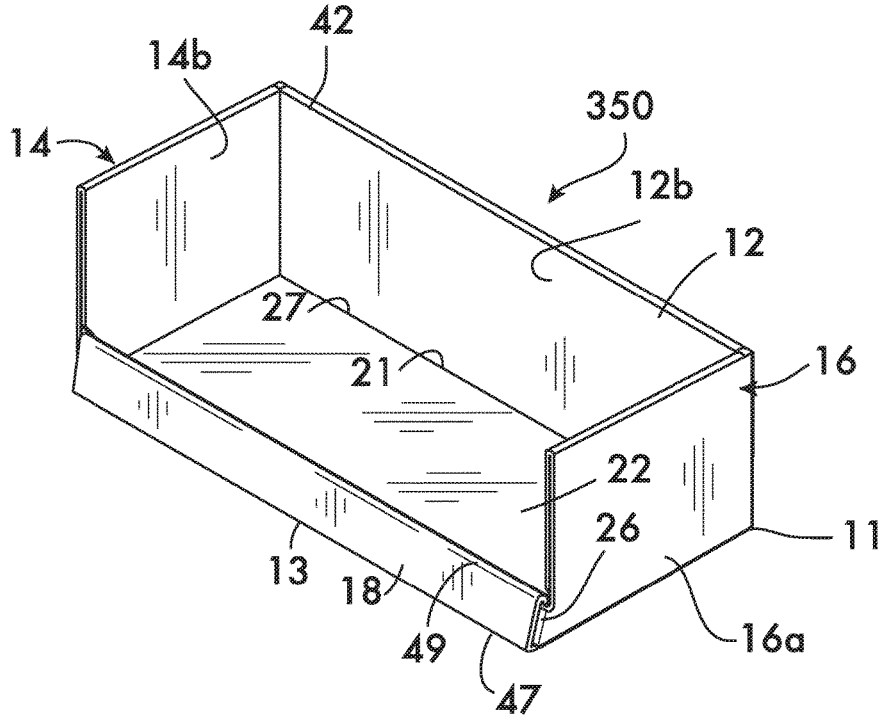
FIG. 28 is a perspective view of a display tray made in accordance with a third embodiment of the present invention.
Figure 30:
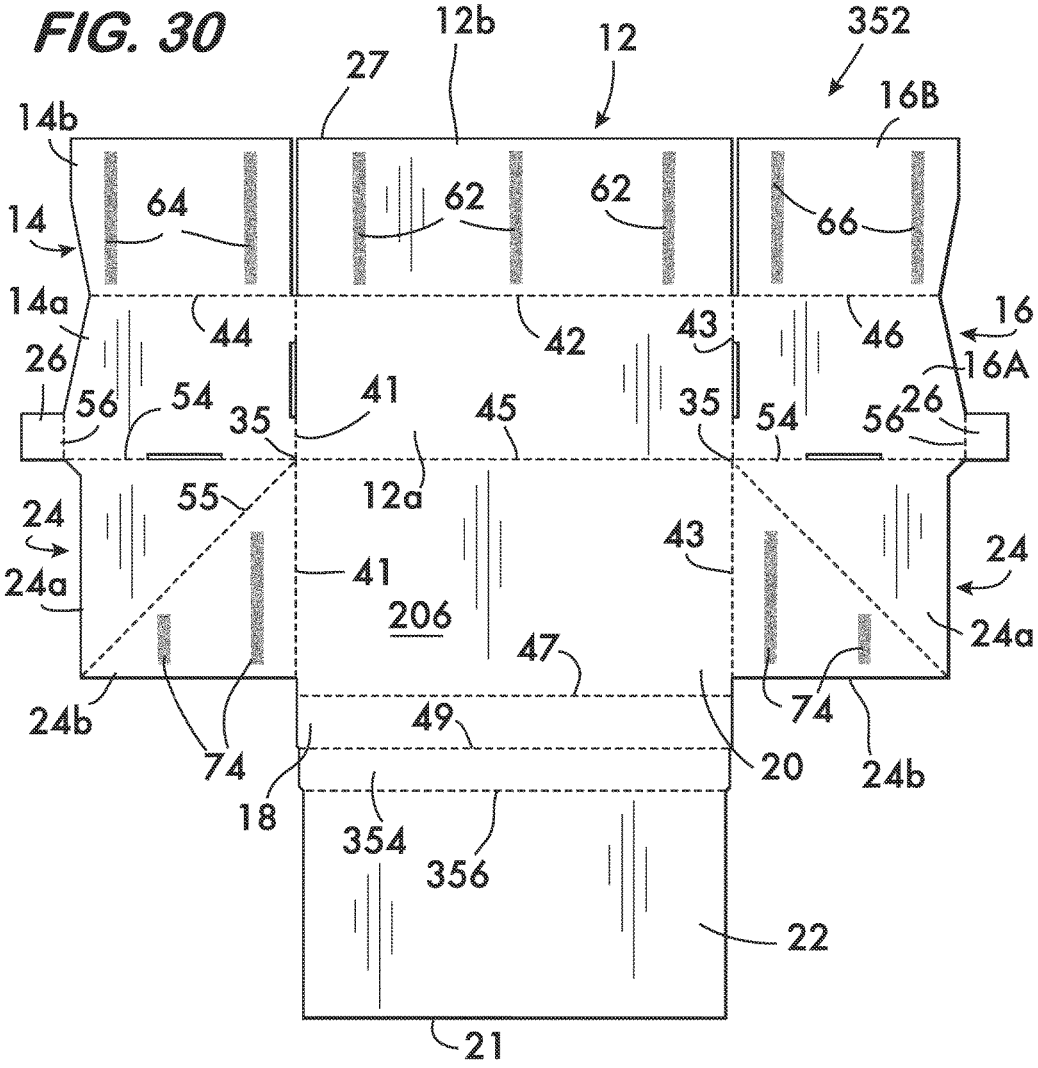
Figure 3I:
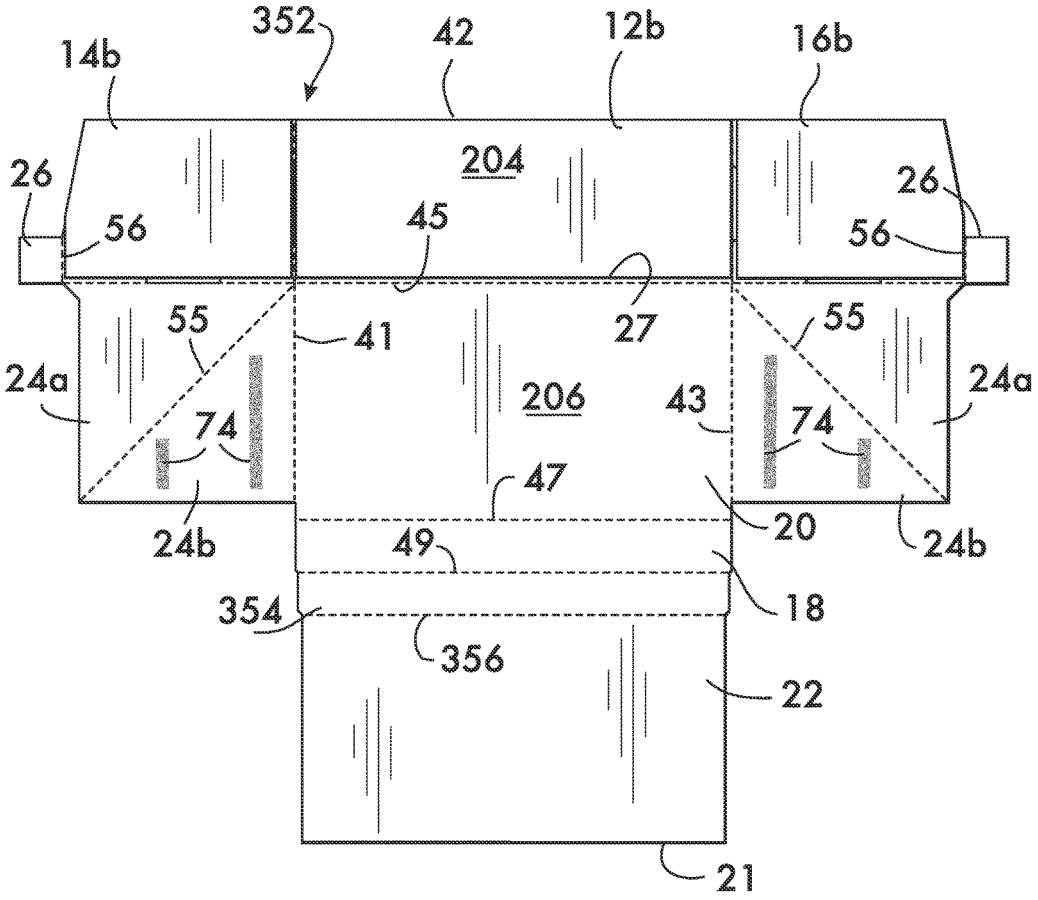
Figure 32:
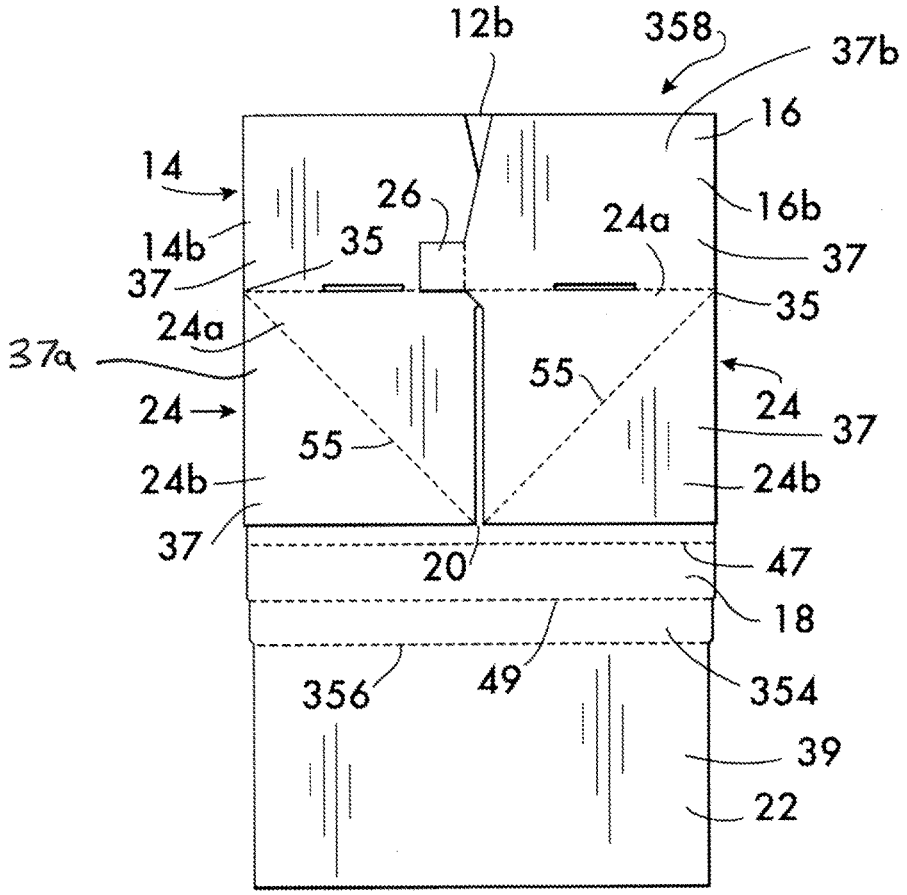

The blank 352 is assembled to form the knockdown 358 shown in FIG. 32, which knockdown can be opened into the display tray 350 shown in FIG. 28. Referring to FIGS. 30-32, assembly of the knockdown 358 is illustrated which is similar to that described above for blank 100 (FIG. 2). With specific reference to FIG. 30, adhesive, such as a hot melt glue, is applied to the inside face 206 of the blank 352 along the glue lines 64, 66, 62 and 74 as shown. Turning to FIG. 31, the side panel roll over portions 14*b*, 16*b* and the rear panel rollover portion 12*b* are folded over the respective fold lines 44, 46, and 42 and secured to the respective main portions 14*a*, 16*a*, and 12*a* to form the side and rear panels 14, 16, and 12. Finally, the side panels 14, 16 with the alignment panels 24 (24*a* and 24*b*) connected thereto are folded about the fold lines 41, 43 to bring the connection portions 24*b* into contact with the inner face 206 of the bottom panel 20. The connection portions 24*b* are secured at the glue lines 74 while the alignment portions 24*a* and the side panels 14, 16 remain free relative to the face of the bottom panel 20 and the rear panel 12 for movement as described below.

With all of the panels adhered, the knockdown 358 is now complete in the flat form illustrated in FIG. 32. As seen, the knockdown 358 includes upper and lower planar sections 37 and 39 in a proximate face to face parallel relation connected to one another at edges defined by fold lines 41 and 43. The upper planar section 37 includes side panels 14, 16, alignment portion 24*a*, and connection portion 24*b* (first portion 37*a* includes side panel 14 and alignment and connection portions 24*a*, 24*b*; second portion 37*b* includes side panel 16 with its respective alignment and connection portions 24*a*, 24*b*); the lower planar section 39 includes the rear panel 12, bottom panel 20, front panel 18, rollover front panel 354 and shelf panel 22.

Figure 33:
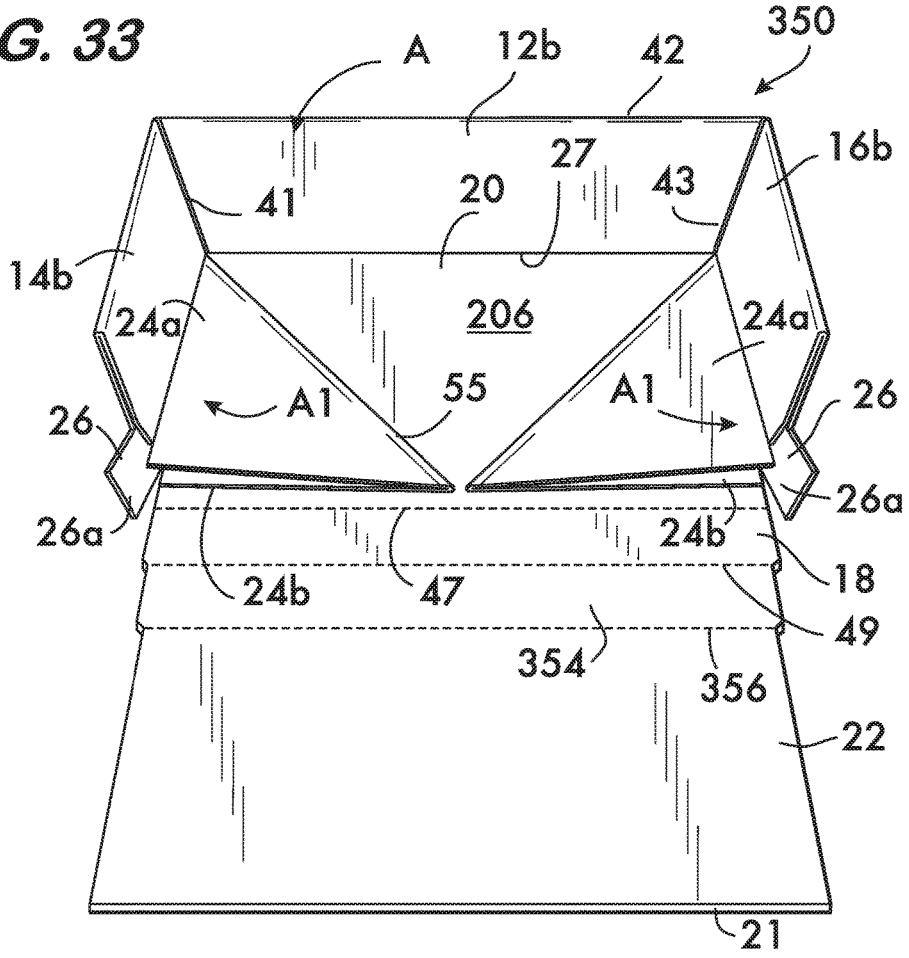
FIGS. 33-35 are perspective views illustrating steps of assembly of the knockdown into the display tray of FIG. 28.

The knockdown 358 can be assembled into the display tray 350 in a similar manner to that described above for knockdown 100 (FIG. 7) with some exceptions as now described with reference to FIGS. 33-37. Referring initially to FIG. 33, it is seen that as the alignment panel 24 folds along fold line 55 bringing the outer face 204 of the alignment portion 24*a* into face to face contact with the outer face 204 of the connection portion 24*b*, the rear panel 12 and the side panels 14, 16 move into their final display tray 350 positions. This can be initiated by either rotating the rear panel 12 upwardly about fold line 45 as indicated by arrow A, which causes each of the side panels 14, 16, via the folding of the alignment panels 24, to rotate outward as indicated by the arrows A1, or by rotating the side panels 14, 16 outward into their display tray position as indicated by arrows A1 which causes, via the alignment panels 24, the movement of the rear panel 12 as shown by arrow A into its display tray form. Thus the alignment panels 24 cause each side panel 14, 16 to generally align with a respective side edge of the bottom panel 20 (at fold line 41 and 43), and cause the side panels 14, 16 and the rear panel 12 into a generally perpendicular position relative to the bottom panel 20.

Figure 34:
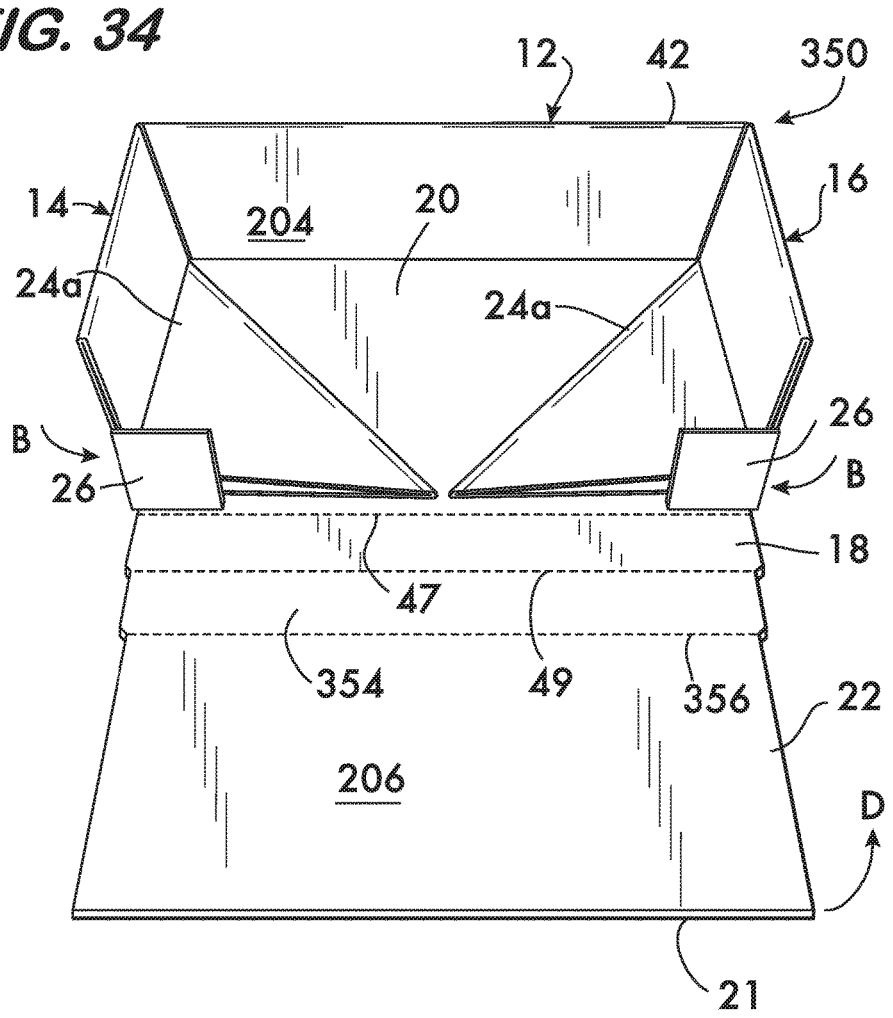
Figure 35:
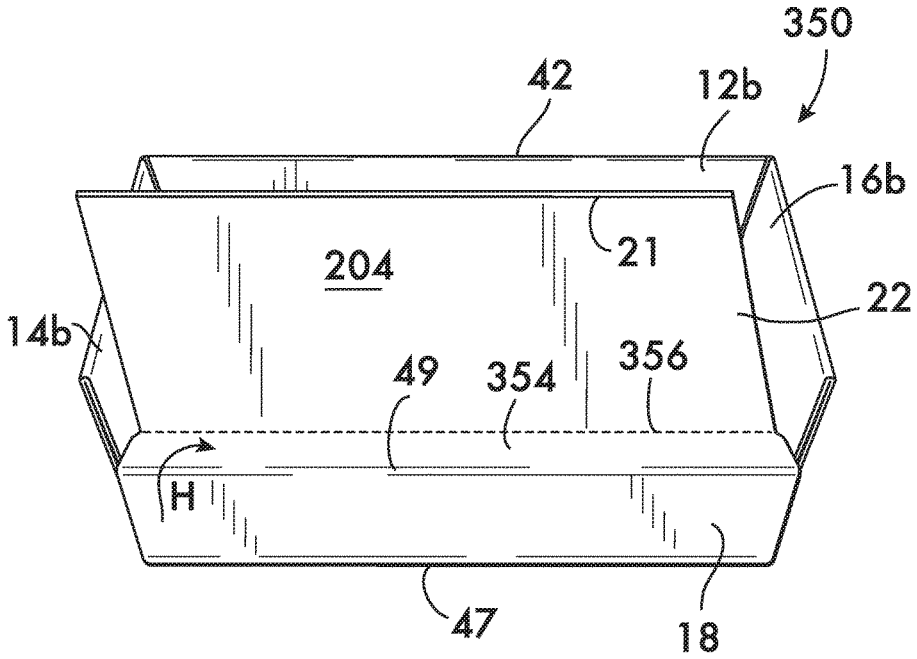
Figure 36:
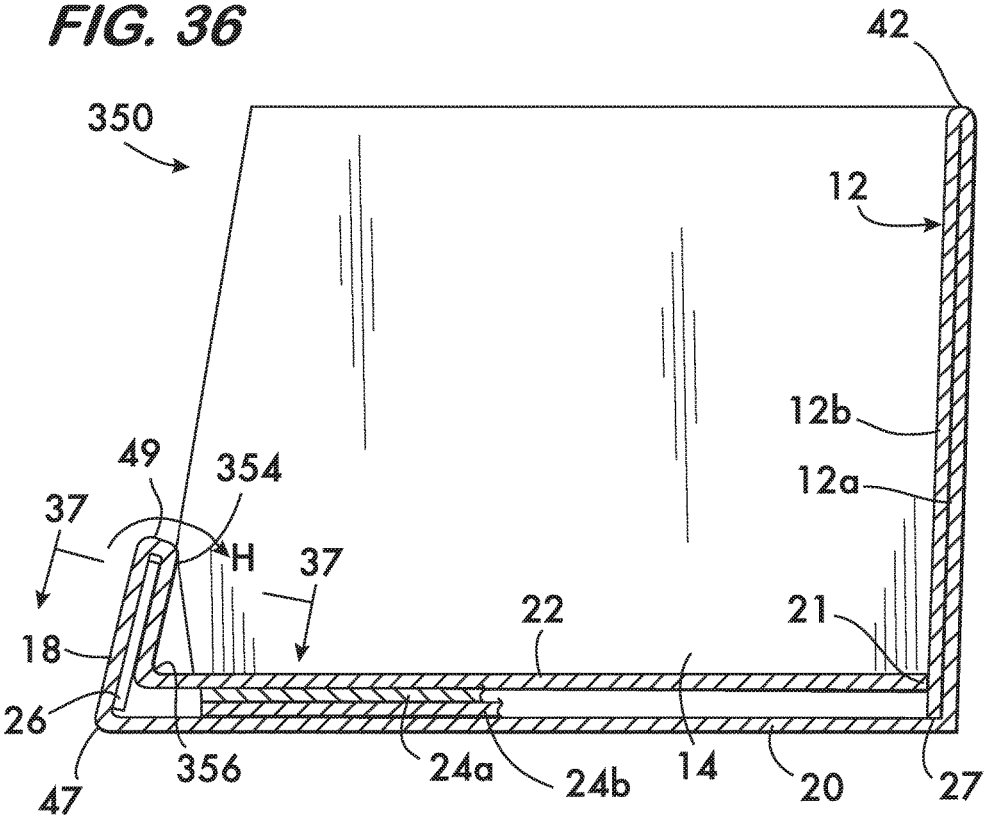
FIG. 36 is a cross-sectional view along the line 36-36 in FIG. 28.
Figure 37:
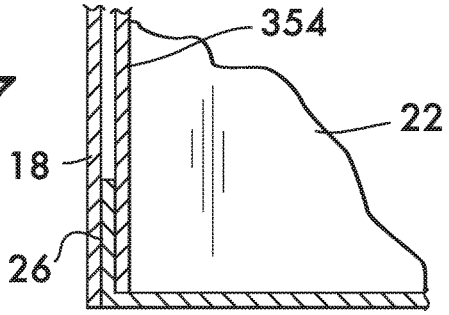
FIG. 37 is a cross-sectional view along the line 37-37 in FIG. 36.

Turning to FIG. 34, the tuck tabs 26 are folded in the direction indicated by arrow B to a position as shown. With further reference to FIG. 35, the front panel 18 and the shelf panel 22 are pivoted about the fold line 47, as indicated by arrow D (FIG. 34), moving front panel 18 into its final display tray position. The rollover front panel 354 is further pivoted as indicated by the arrow H about fold line 49 such that the front rollover panel 354 engages the inside surface 26*a* (see FIGS. 35 and 36) of the respective tuck tab 26 while the shelf panel 22 folds in the opposite direction about fold line 356 and is pushed into a flat position onto folded alignment panels 24 (panels 24*a* and 24*b*), which in turn sit over bottom panel 20 as seen in FIG. 36, thereby completing the display tray as seen in FIG. 28.

Fourth Embodiment

Figure 38:
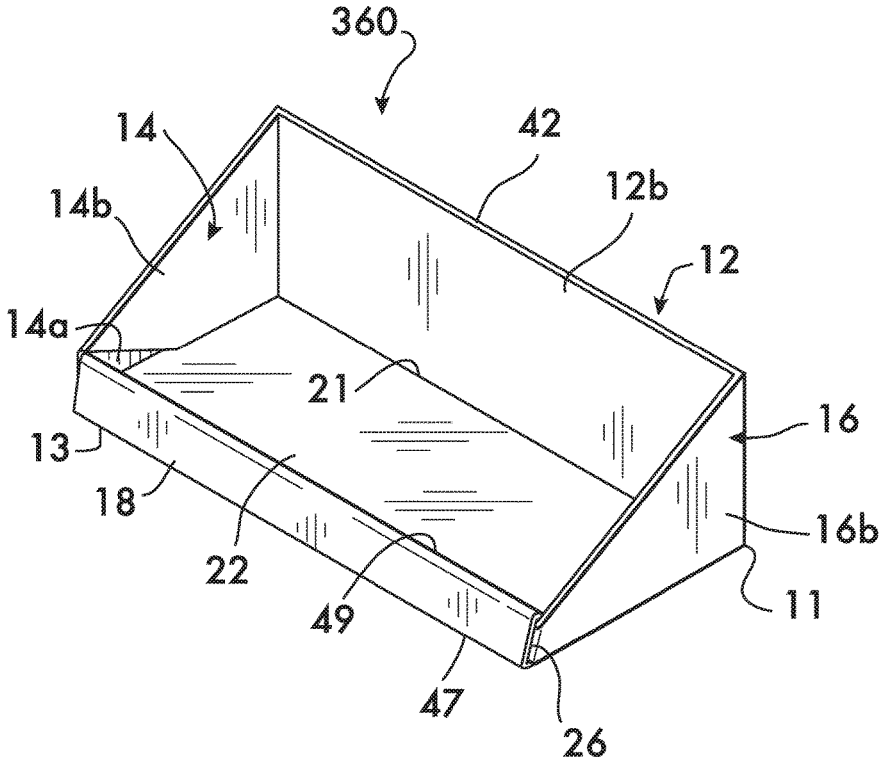
FIG. 38 is a perspective view of a display tray made in accordance with a fourth embodiment of the present invention.
Figure 39:
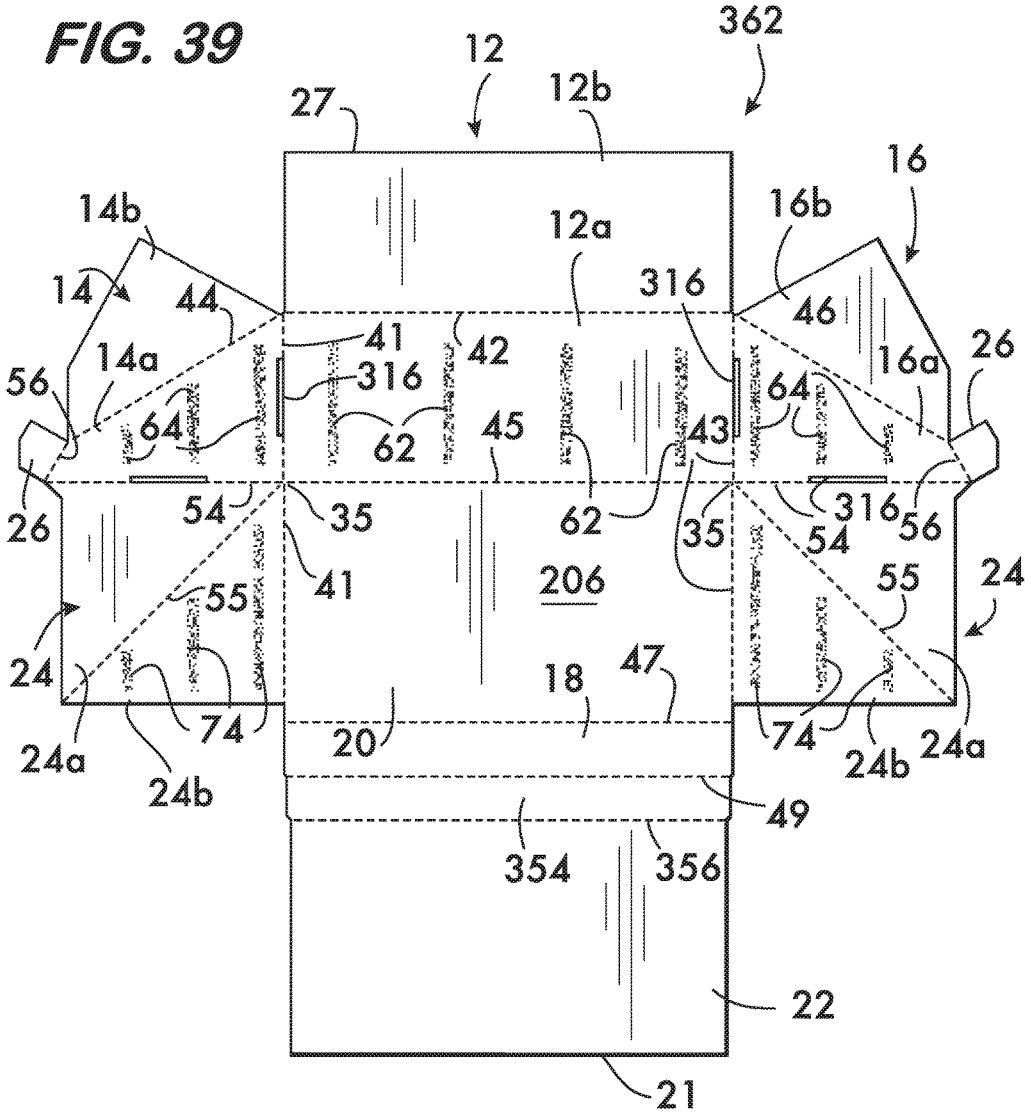
FIG. 39 is a plan view of a blank for forming the display tray shown in FIG. 38.
Figure 40:
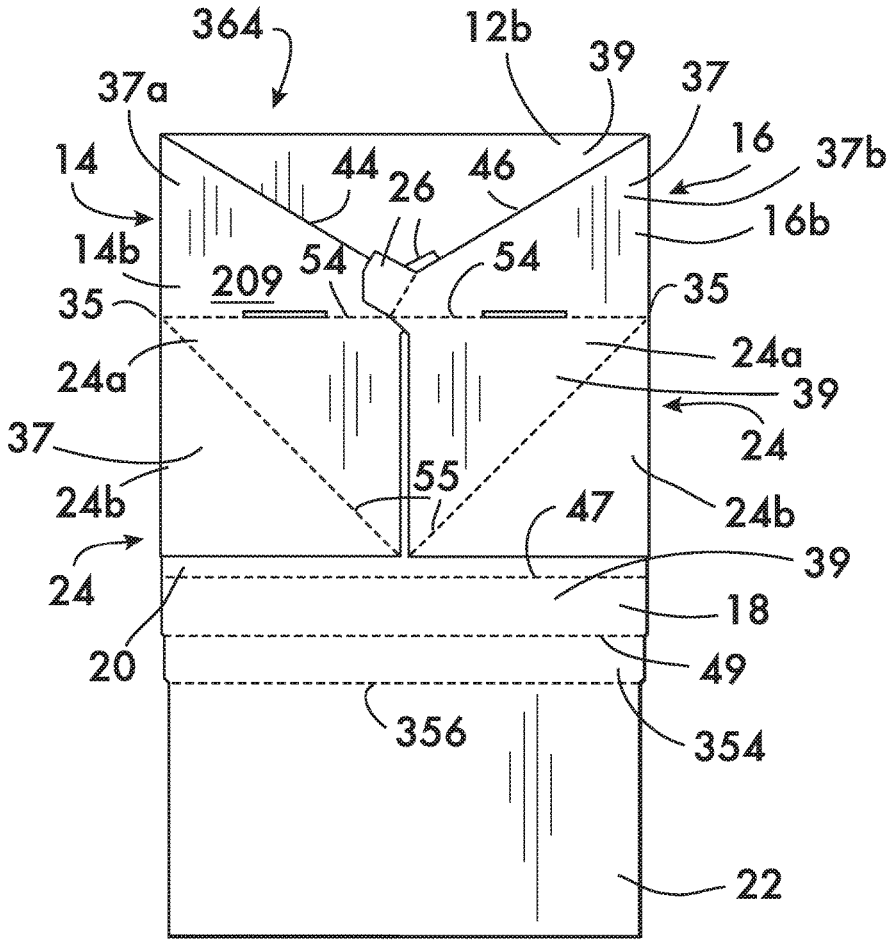
FIG. 40 is a plan view of a knockdown assembled from the blank shown in FIG. 39, which knockdown may be opened into the display tray of FIG. 38.

A fourth embodiment shown in FIGS. 38-40 is similar to the third embodiment shown in FIGS. 28-37 but here the display tray 360 has slanted side panels 14 and 16 as shown.

With reference to FIG. 39, a blank 362 for forming the knock down 364 from which the display tray 360 is assembled is shown. Again, it is similar to the blank 352 shown in FIG. 29 but for the angled side panels 14 and 16 which are similar to those shown for the blank 200 in FIG. 2. The knockdown 364 formed from the blank 362 is shown in FIG. 40 and is formed similarly as the knockdown 358 shown in FIG. 32, although it is appreciated that alternative glue patterns can be used.

Finally, the knockdown 364 is assembled into the display tray 360 in a similar manner as described above for display tray 350. This embodiment highlights the flexibility of the present invention which can combine different features.

Fifth Embodiment

Figure 41:
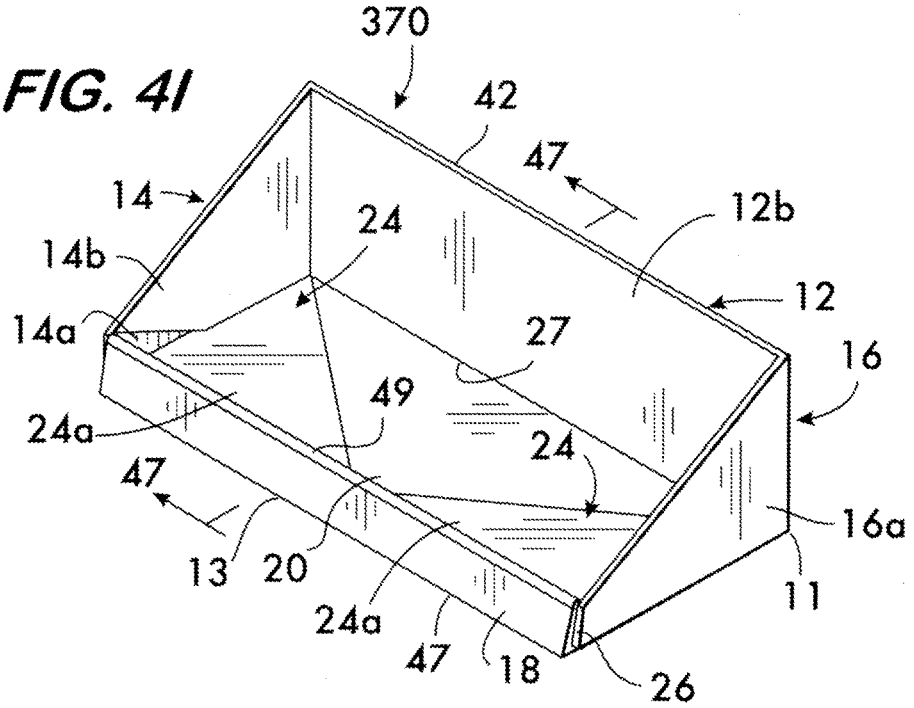
FIG. 41 is a perspective view of a display tray made in accordance with a fifth embodiment of the present invention.

A fifth embodiment will now be described with reference to FIGS. 41-47 showing a display tray 370 which is similar to the display trays 350 and 360 shown in FIGS. 28 and 38 respectively, but without a shelf panel 22. With reference to FIG. 41, the display tray 370 includes a front panel 18, rear panel 12 and opposed side panels 14 and 16 extending about bottom panel 20 as do the previously described embodiments. With no shelf panel 22, this embodiment is useful where a finished bottom shelf is not needed and the retail products can sit on the bottom panel 20.

Figure 42:
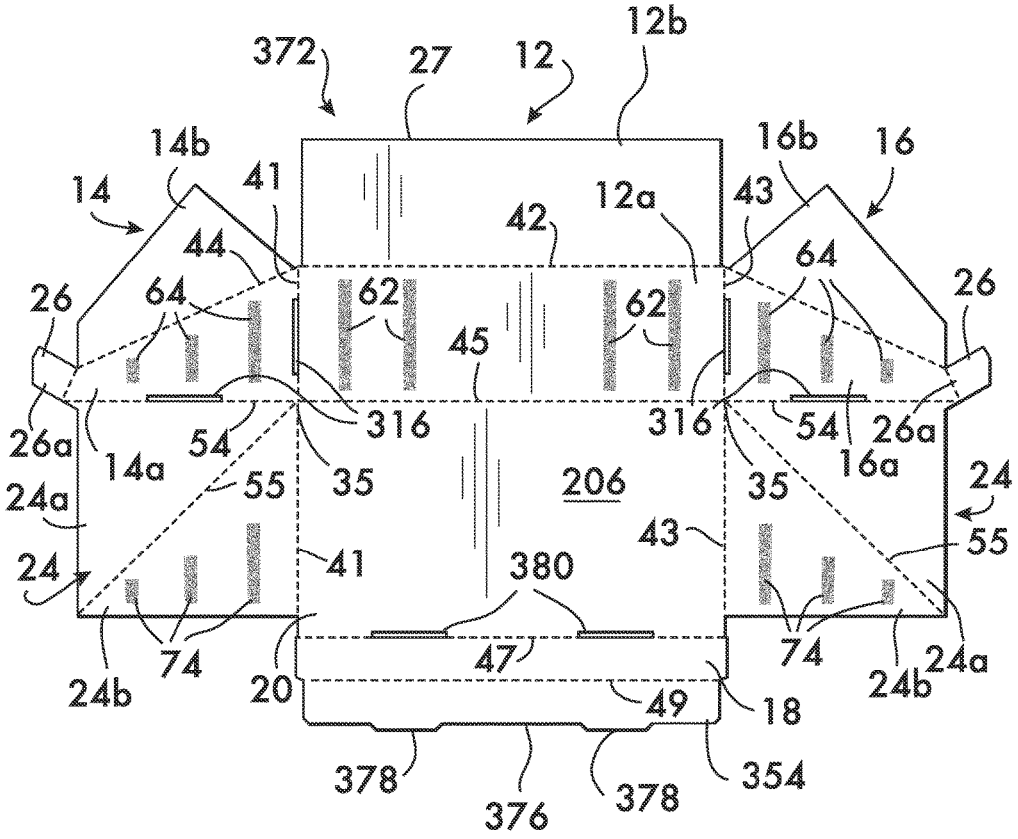
FIG. 42 is a plan view of a blank for forming the display tray shown in FIG. 41 and also shows a step in forming a knockdown.

Referring to FIG. 42, a blank 372 for making the display tray 370 is shown. It is similar to those described previously (see, e.g., the description for the blank 352 in reference to FIG. 29 above). The blank 372 includes as an integral unit the rear, side, front and bottom panels 12, 14, 16, 18 and 20. The bottom panel 20 is connected to the front panel 18 along the fold line 47, and the front panel 18 is connected to the rollover front panel 354 along fold line 49. The rollover front panel 354 has an edge 376 and tabs 378 extending therefrom. Slots 380 correspond to tabs 378 as further described below. As with the embodiments described above, the rear panel 12, and the side panels 14, 16 include portions of the blank 372 to be folded or rolled over upon itself—the rear panel 12 is formed by portions 12*a* and 12*b*, side panel 14 is formed by portions 14*a* and 14*b*; and side panel 16 is formed by portions 16*a* and 16*b*. As with the previously described embodiments, the blank 372 also includes a pair of alignment panels 24 (each formed of an alignment portion 24*a* and a connection portion 24*b*), and a pair of tuck tabs 26. Glue lines 62, 64 and 74 are shown in FIG. 42 for assembly purposes described below.

Figure 43:
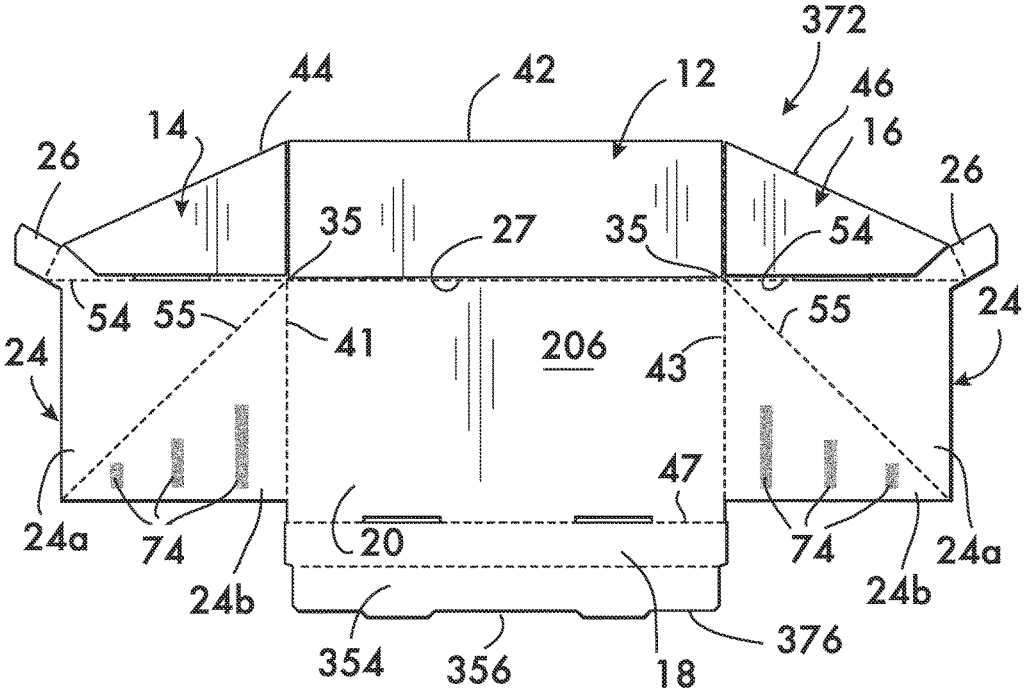
FIGS. 43-44 are plan views of the blank of FIG. 42 illustrating additional steps of assembly of a knockdown which may be opened into the display tray of FIG. 41, with FIG. 44 illustrating the completed knockdown.
Figure 44:
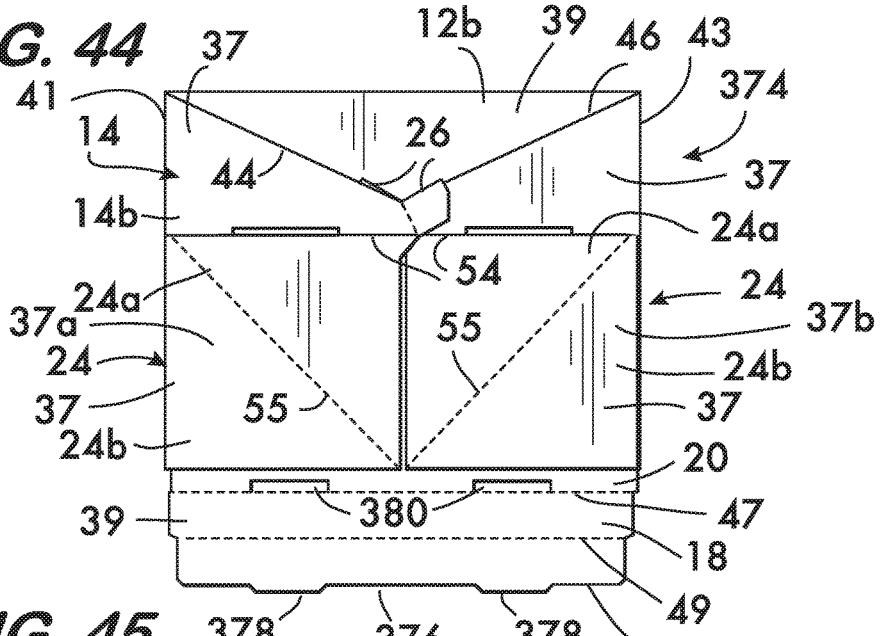
Figure 45:
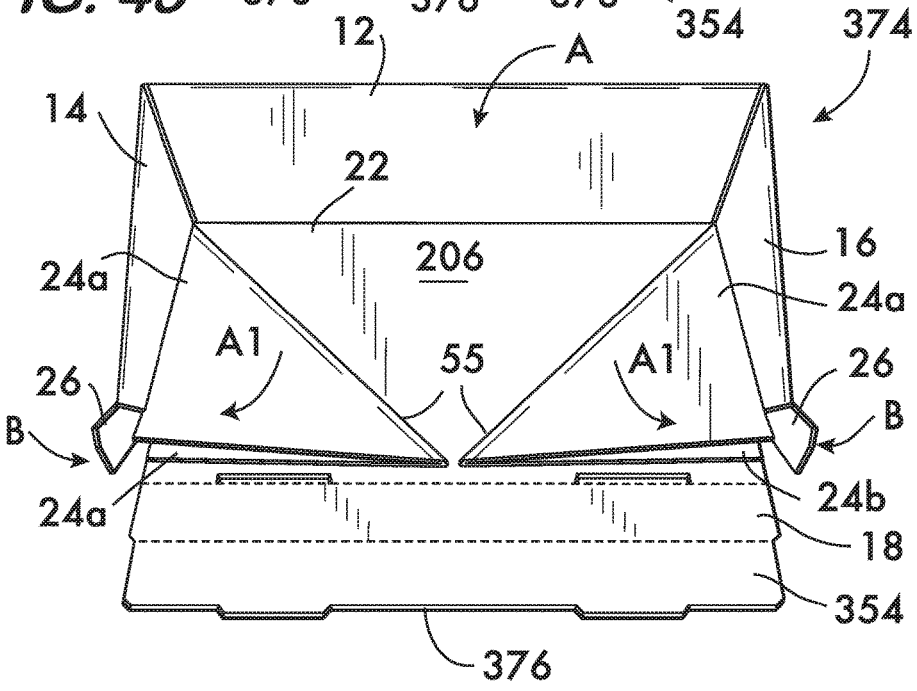
FIGS. 45-46 are perspective views illustrating steps of assembly of the knockdown into the display tray of FIG. 41.

The blank 372 is assembled to form the knockdown 374 shown in FIG. 44, which knockdown 374 can be opened into the display tray 370. Referring to FIGS. 42-44, assembly of the knockdown 374 is illustrated, although it is similar to that described above for blanks 352 and 362 (FIGS. 29 and 39). With specific reference to FIG. 42, adhesive is applied to the inside face 206 of the blank 372 along the glue lines 62, 64, 74 as shown. With further reference to FIG. 43, the side panel roll over portions 14*b*, 16*b* and the rear panel rollover section 12*b* are folded over the respective fold lines 44, 46, and 42 and secured to the respective main portions 14*a*, 16*a*, and 12*a* to form the side and rear panels 14, 16, and 12. Finally, the side panels 14, 16 with the alignment panels 24 (portions 24*a* and 24*b*) connected thereto are folded over the fold lines 41, 43 onto the rear panel 12 and of the bottom panel 20. The connection portions 24*b* are secured to the inner face 206 of the bottom panel 20 at the glue lines 74 while the alignment portions 24*a* and the side panels 14, 16 remain free relative to the face of the bottom panel 20 and the rear panel 12 for movement as described below.

As with the prior embodiments, the knockdown 374 includes upper and lower planar sections 37 and 39, the upper planar section 37 including first and second portions 37*a* and 37*b*. With all of the panels adhered, the knockdown 374 is now complete in the flat form illustrated in FIG. 44.

The knockdown 374 can be assembled into the display tray 370 in a similar manner to that described above for knockdowns 358 and 364 (FIGS. 32 and 40) with some exceptions and as described below with reference to FIGS. 45-48. Initially, as described above with prior embodiments and with reference to FIG. 45, the side panels 14, 16 and rear panel 12 are moved into their display tray positions via the alignment panel 24.

Figure 47:
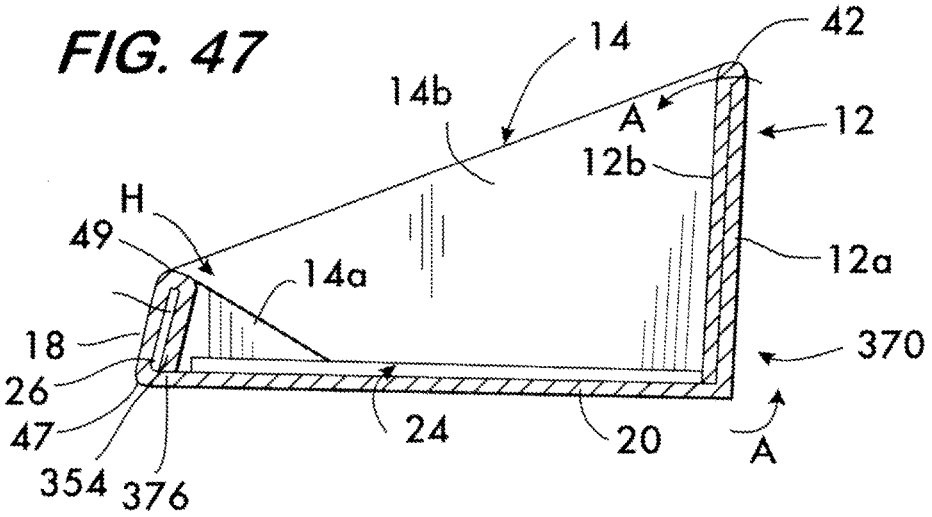
FIG. 47 is a cross-sectional view along the line 47-47 in FIG. 41.
Figure 46:
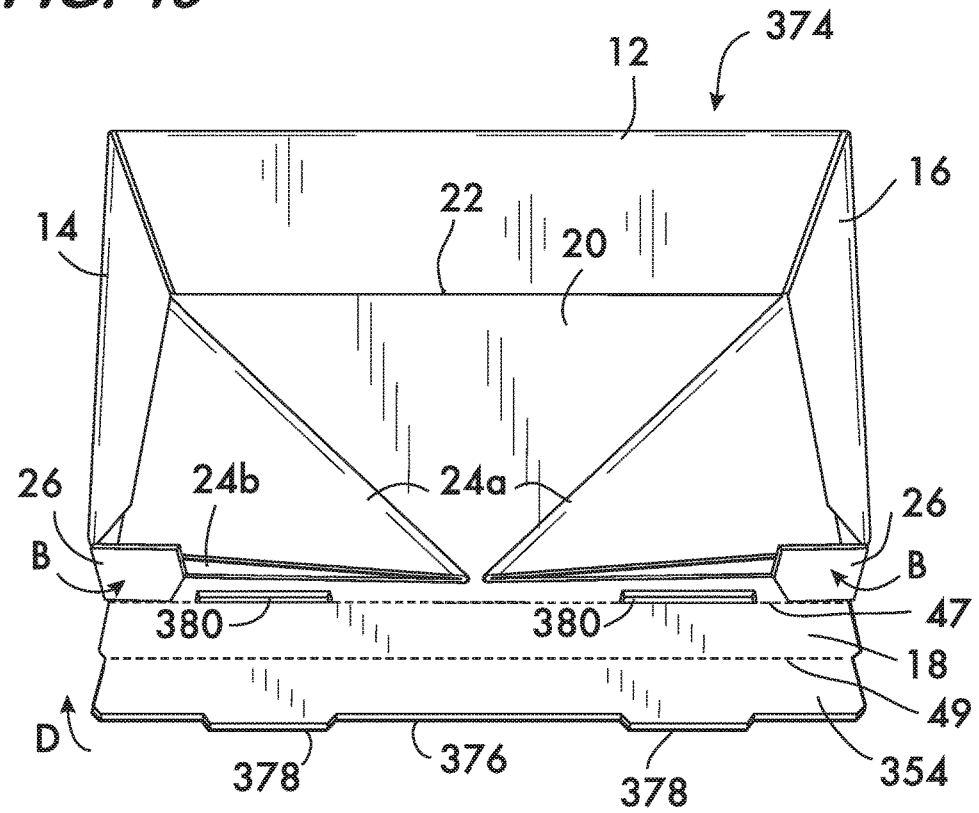

Turning to FIG. 46, the tuck tabs 26 are folded in the direction indicated by arrow B to a position as shown. With further reference to FIG. 47 the front panel 18 is pivoted about the fold line 47, as indicated by arrow D (FIG. 46), moving front panel 18 into its final display tray position. The rollover front panel 354 is further pivoted about the fold line 49 as indicated by the arrow H such that the rollover front panel 354 engages the inside surface 26*a* (see FIG. 47) of the respective tuck tab 26, and the tabs 378 of the rollover front panel 354 lock into corresponding slots 380 thereby completing the display tray as seen in FIG. 41.

Sixth Embodiment

A sixth embodiment will now be described with reference to FIGS. 48-56 showing a display tray 390 which is similar to the display tray 370 shown in FIGS. 41-47, but which include product support panels 392 used for supporting and separating retail goods therein.

Figure 48:
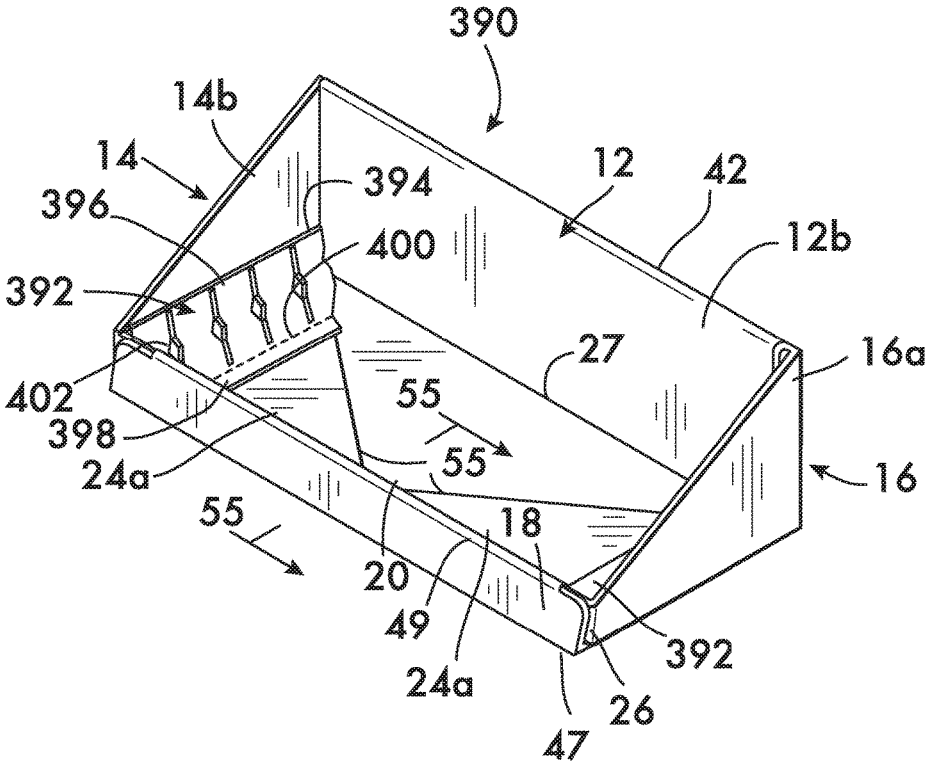
FIG. 48 is a perspective view of a display tray made in accordance with a sixth embodiment of the present invention.

With initial reference to FIG. 48, the display tray 390 includes front panel 18, rear panel 12, opposed side panels 14, 16, bottom panel 20, and alignment panels 24 as do the previously described embodiments. Here, however two product support panels 392 are provided on opposite sides of the display tray 390 (see also partially assembled display tray in FIG. 54). Each product support panel 392 extends integrally from an edge of a respective side panel 14, 16 along fold line 394, has a cutout section 396, and an end panel section 398 separated from the cutout section 396 by a fold line 400. Each end panel section 398 sits on a respective alignment portion panel 24*a* and may be attached thereto with adhesive or unattached for slidable movement thereon as in this particular embodiment. Each cutout section 396 includes slots 402 which align with corresponding slots 402 on the opposing product support panel 392 to receive therein retail product.

Figure 49:
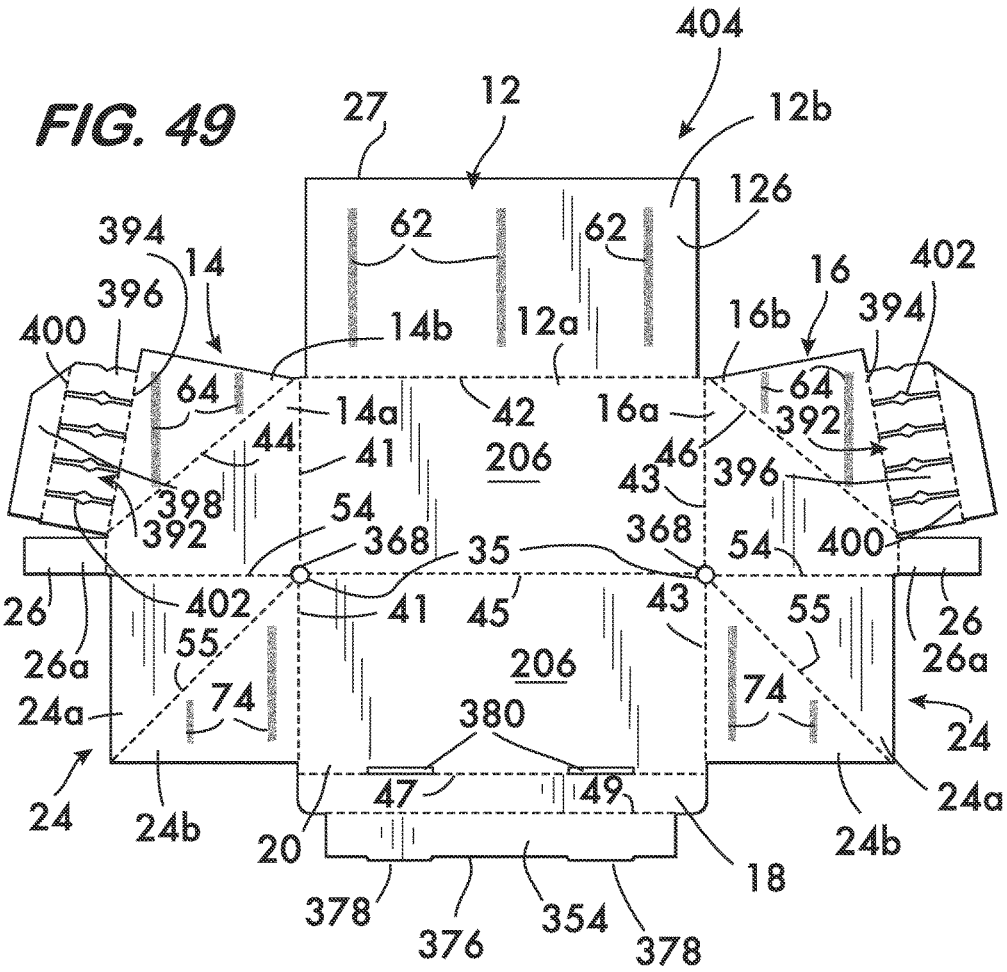
FIG. 49 is a plan view of a blank for forming the display tray shown in FIG. 48.

Referring to FIG. 49, a blank 404 for making the display tray 390 is shown. It is similar to the blank 372 described above with reference to FIG. 42. Here, each product support panel 392 is seen extending integrally from a respective side panel 14*b* and 16*b* along fold line 394, followed by the cutout section 396, then fold line 400 and finally end panel section 398. Cutouts 368 are provided to ease folding by preventing bunching at common corners 35 where fold lines 55 extend from and/or intersects proximate the common corner of the rear panel 12 (main panel portion 12*a*), the bottom panel 20, and the respective side panels 14, 16 (main portions 14*a*, 16*a*).

Figure 50:
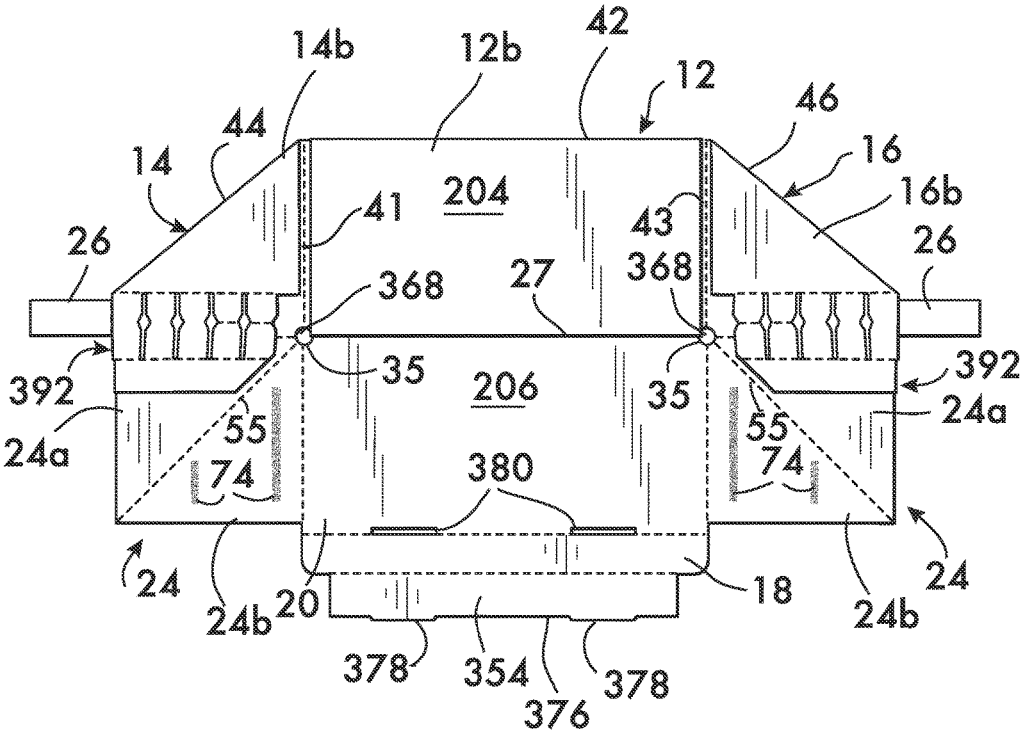
Figure 5I:
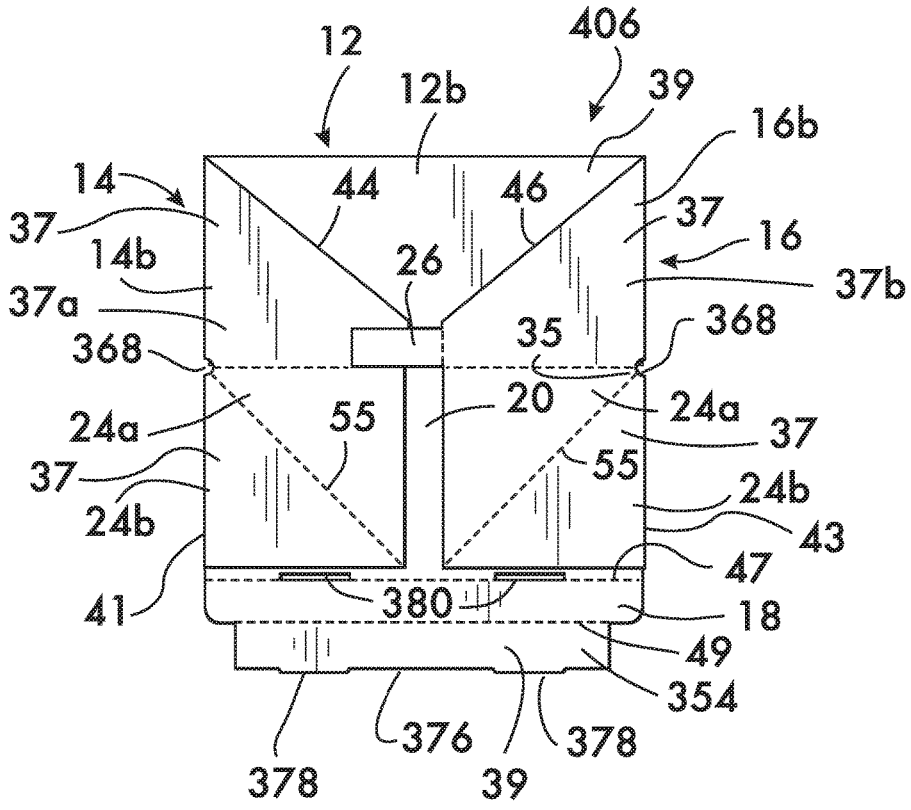

The blank 404 is assembled to form the knockdown 406 shown in FIG. 51, which knockdown 406 can be opened into the display tray 390. Referring to FIGS. 49-51, assembly of the knockdown 406 is illustrated, although it is similar to that described above for knockdown 374 (FIG. 44). With specific reference to FIG. 49, adhesive is applied along the glue lines 62, 64, 74 in the pattern shown. Turning to FIG. 50, side panel roll over portions 14*b*, 16*b* and rear panel rollover section 12*b* are folded over respective fold lines 44, 46, and 42 and secured to respective main portions 14*a*, 16*a*, and 12*a* to form the side and rear panels 14, 16, and 12. It is seen that the product support panels 392 integrally connected to respective side panels 14*b*, 16*b* fold therewith. Finally, side panels 14, 16, product support panels 392, tuck tabs 26 and alignment panels 24 (portions 24*a* and 24*b*) as a unit are folded over respective fold lines 41, 43 to bring them into face to face relation with the rear panel 12 and bottom panel 20, bringing the inner faces 206 of connection portions 24*b* into contact with the inner face 206 of the bottom panel 20. The connection portions 24*b* are secured at the glue lines 74 while the alignment portions 24*a* and the side panels 14, 16 and connected product support panels 392 remain free relative to the face of the bottom panel 20 and the rear panel 12 for movement as described below. As seen in FIG. 51, and similar to the previously described embodiments, the knockdown 406 includes upper and lower planar sections 37 and 39 in a proximate face to face parallel relation connected to one another at edges defined by fold lines 41 and 43. The upper planar section 37 includes side panels 14, 16, alignment portion 24*a*, connection portion 24*b* and product support panels 392; the lower planar section 39 includes the rear panel 12, bottom panel 20, rear panel 18, and rollover rear panel 354. With all of the panels adhered, the knockdown 406 is now complete in the flat form illustrated in FIG. 51.

Figure 52:
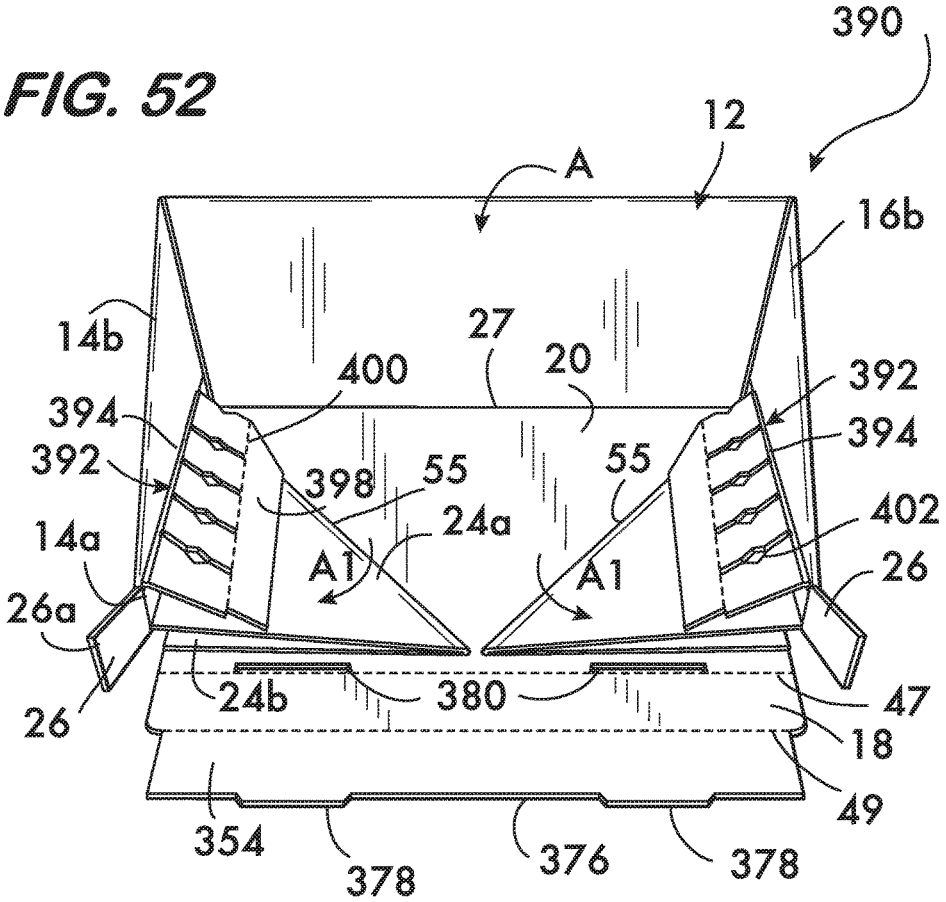
FIGS. 52-54 are perspective views illustrating steps of assembly of the knockdown into the display tray of FIG. 48.

The knockdown 406 can be assembled into the display tray 390 in a similar manner to that described above for the display tray 370 (FIG. 41) and is now described with reference to FIGS. 51-56. Referring initially to FIG. 52, initially, as described in previous embodiments, the side panels 14, 16 and rear panel 12 are moved into their display tray positions via alignment panels 24. It is seen further that as the side panels 14, 16 unfold, the product support panels 392 extend away from the side panels 14, 16, pivoting about fold line 394 as the end panel sections 398 slides over the alignment portion 24*a*.

Figure 53:
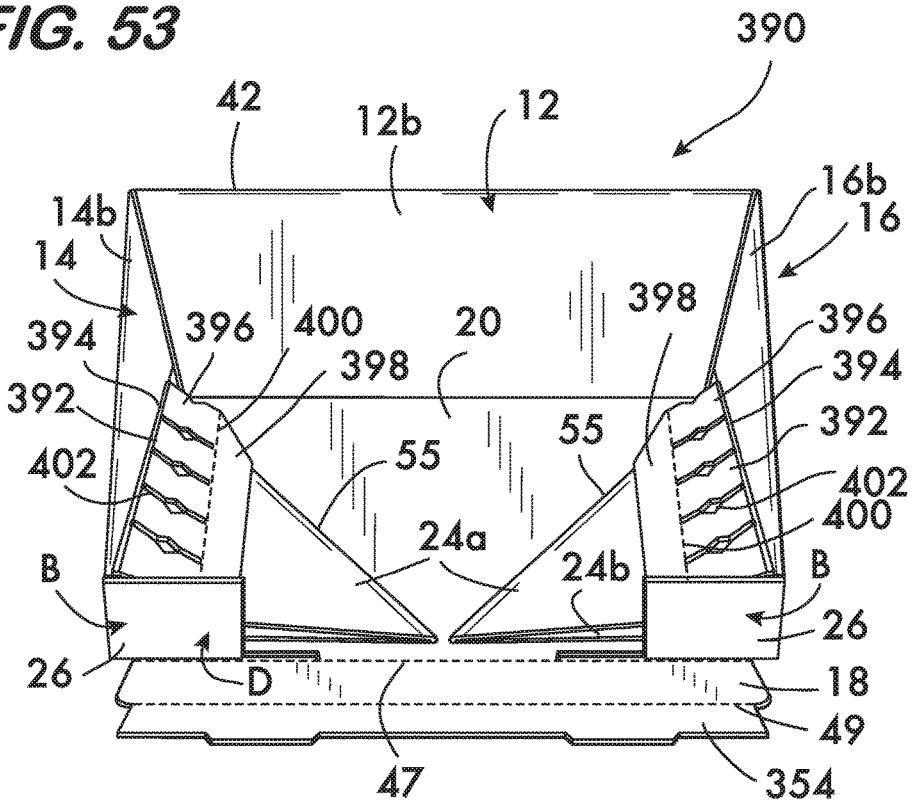
Figure 54:
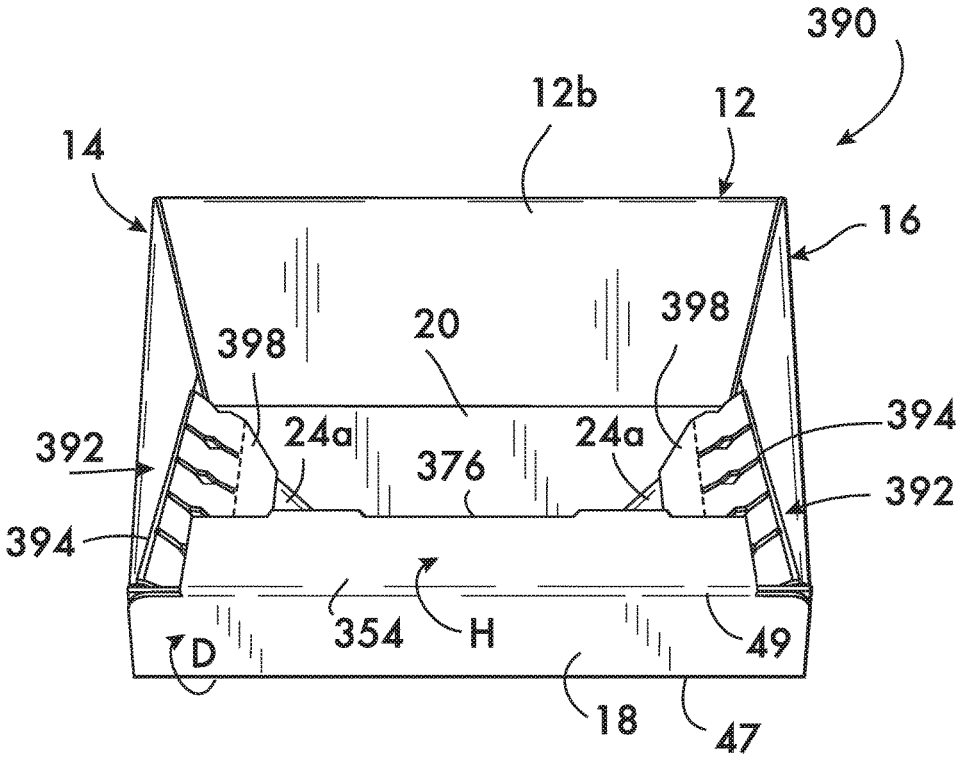
Figure 55:
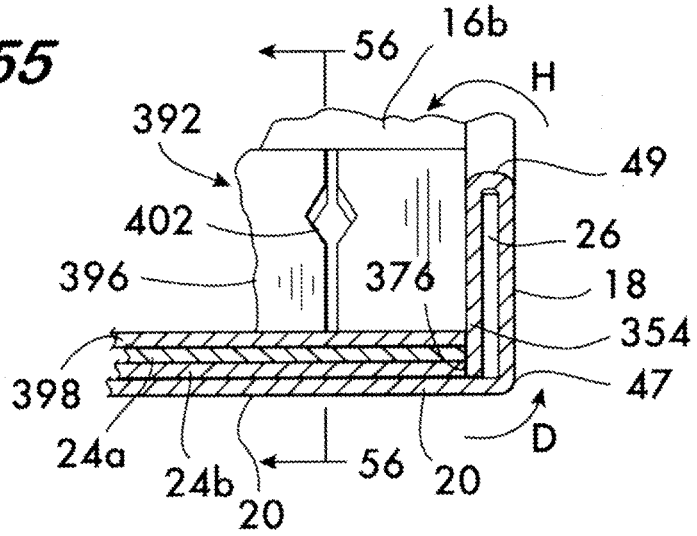
FIG. 55 is a cross-sectional view along the line 55-55 in FIG. 48.
Figure 56:
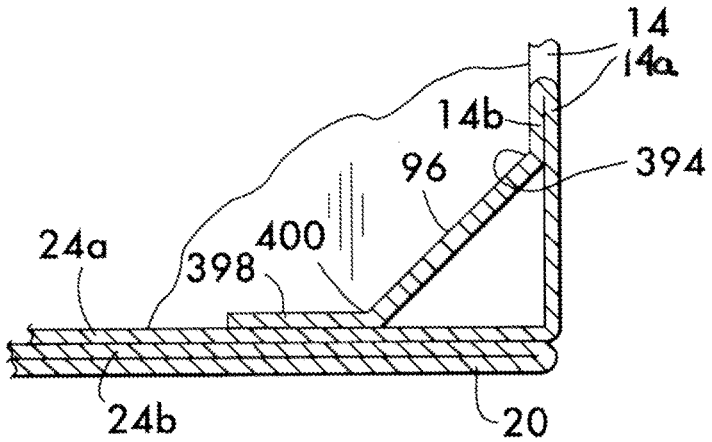
FIG. 56 is a cross-sectional view along the line 56-56 in FIG. 55.
Figure 57:
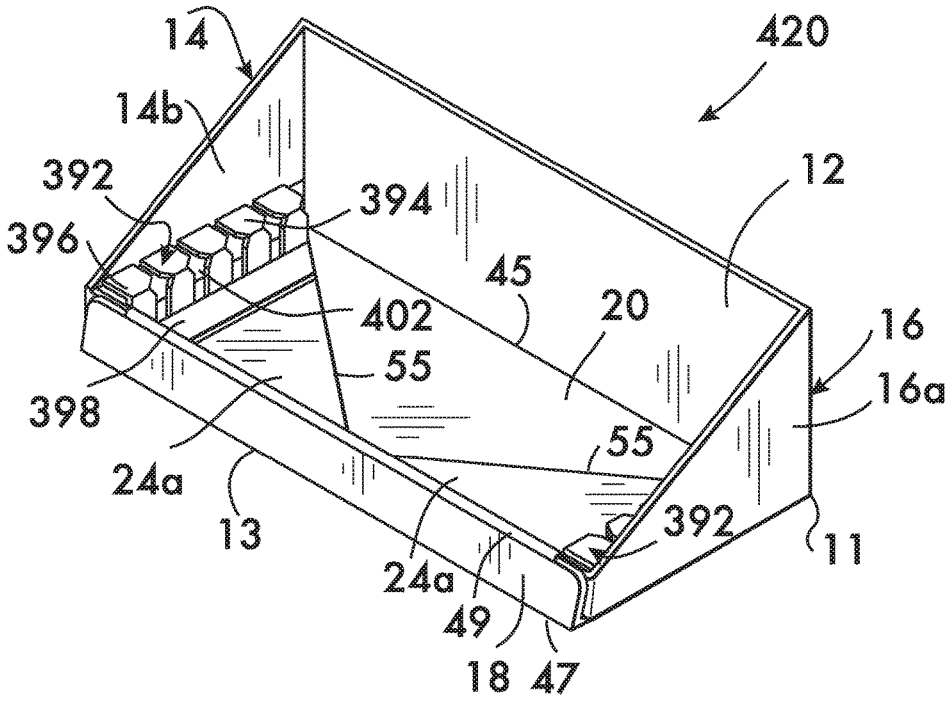
FIG. 57 is a perspective view of a display tray made in accordance with a seventh embodiment of the present invention.

Turning to FIG. 53, the tuck tabs 26 are folded in the direction indicated by arrow B to a position as shown. With further reference to FIGS. 54 and 55 the front panel 18 is pivoted about the fold line 47, as indicated by arrow D, moving front panel 18 into its final display tray position. The rollover front panel 354 is further pivoted about the fold line 49 as indicated by the arrow H such that the rollover front panel 354 engages the tuck tabs 26 (see FIG. 55), and the tabs 378 of the rollover front panel 354 lock into corresponding slots 380 thereby completing the display tray as seen in FIGS. 48, 55, 56. The rollover front panel 354 is preferably shorter in length leaving additional space on opposite sides of the rollover front panel 354 as compared to that of the display tray 370 of FIG. 41 to allow clearance for the product support panels 392 when folded over. In its completed form, the display tray 390 can be loaded with retail product that would fit into the slots 402.

Seventh Embodiment

A seventh embodiment will now be described with reference to FIGS. 57-62 showing a display tray 420 similar to the display tray 390 shown in FIGS. 48 to 56. With initial reference to FIG. 57, the display tray 420 includes a front panel 18, rear panel 12 and opposed side panels 14 and 16 extending about the bottom panel 20. Unlike the prior embodiment of FIG. 48, the rear panel 12 is formed of a single panel 12 and does not include a rollover portion although it is recognized that a roll over portion such as that of the display tray 390 of FIG. 48 could be provided. This configuration may be preferred where the added strength of the rollover is not needed, and the white paper finish not desired. The other substantive difference from the prior embodiment is that here the product support panels 392 are square and adhesively fixed to the alignment panel 24*a* beneath it.

Figure 58:
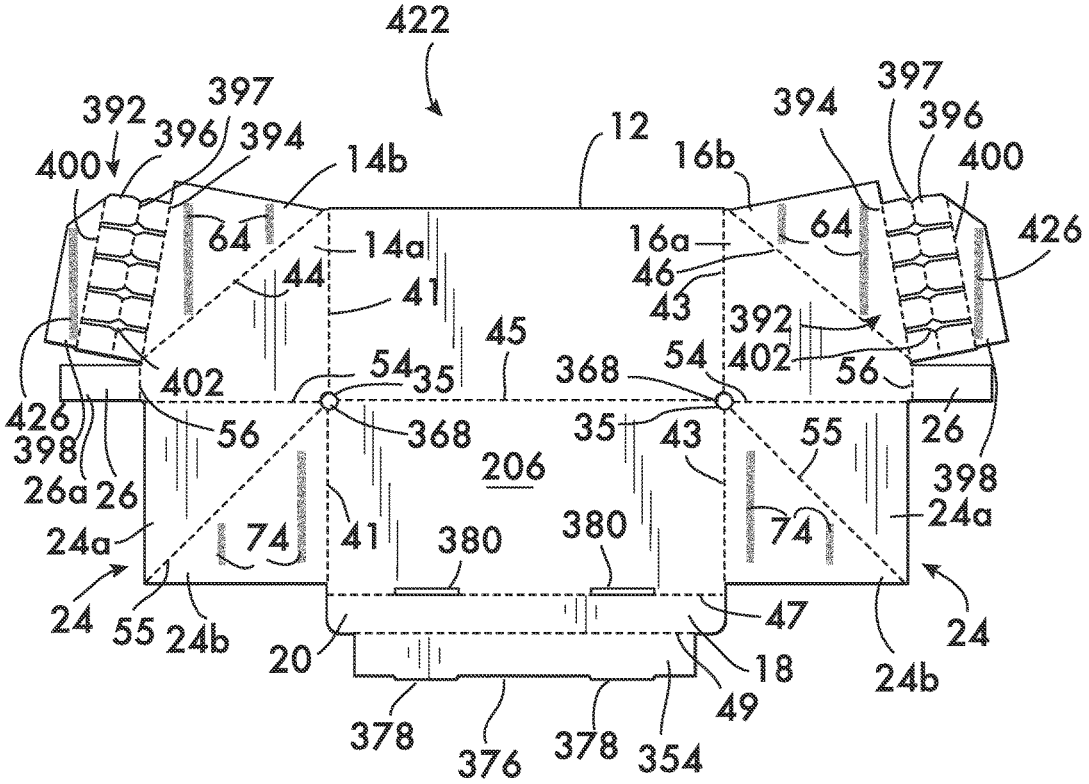
FIG. 58 is a plan view of a blank for forming the display tray shown in FIG. 58.

Referring to FIG. 58, a blank 422 for making the display tray 420 is shown. It is similar to that described above for blank 404 (FIG. 49). Each product support panel 392 is seen extending integrally from a respective side panel 14*b* and 16*b* along fold line 394, followed by the cutout section 396, then fold line 400 and finally end panel section 398, Here, the cutout section 396 is divided in half by a fold line 397, and end panel section 398 serves as a glue panel as further described below. Also, rear panel 12 is formed of a single panel. As shown, rear panel 12 is formed of a single panel/portion.

Figure 59:
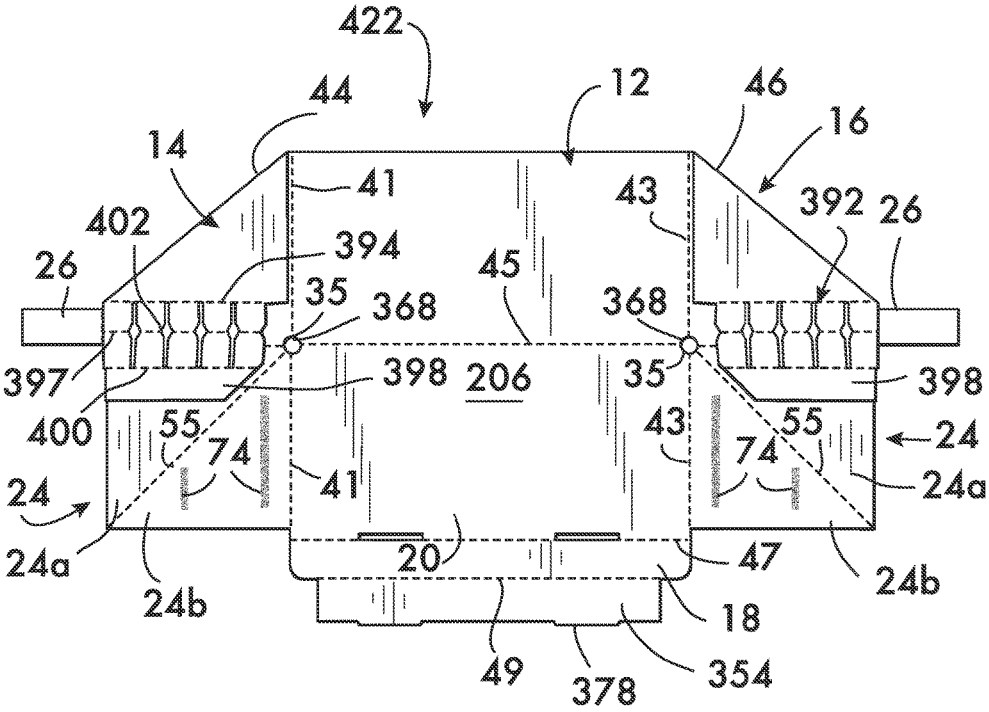
FIGS. 59-60 are plan views of the blank of FIG. 58 illustrating steps of assembly of a knockdown which may be opened into the display tray of FIG. 57, with FIG. 60 illustrating the completed knockdown.
Figure 60:
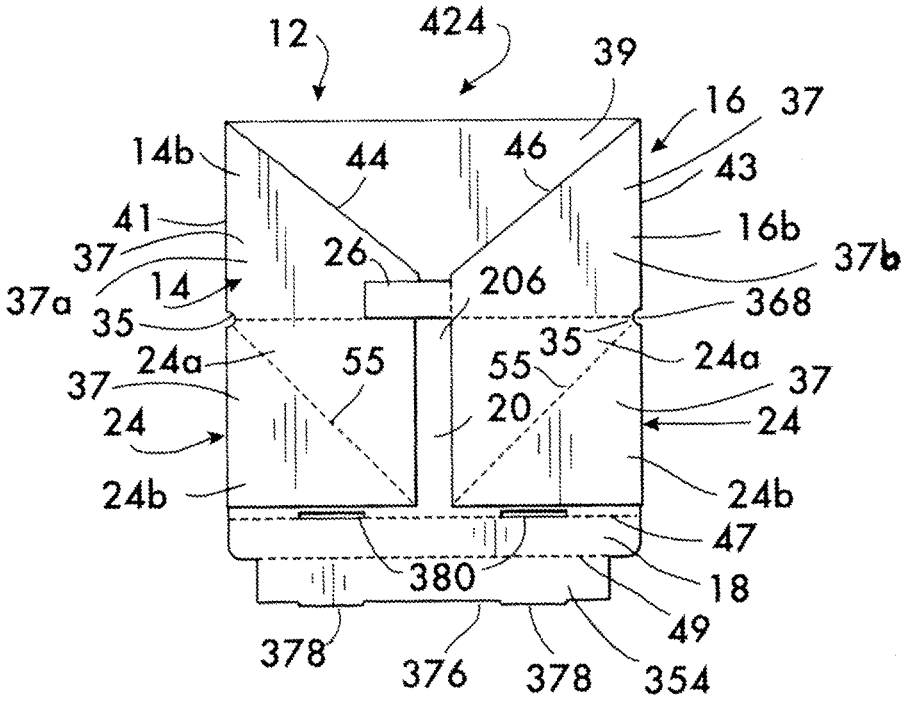
Figure 6I:
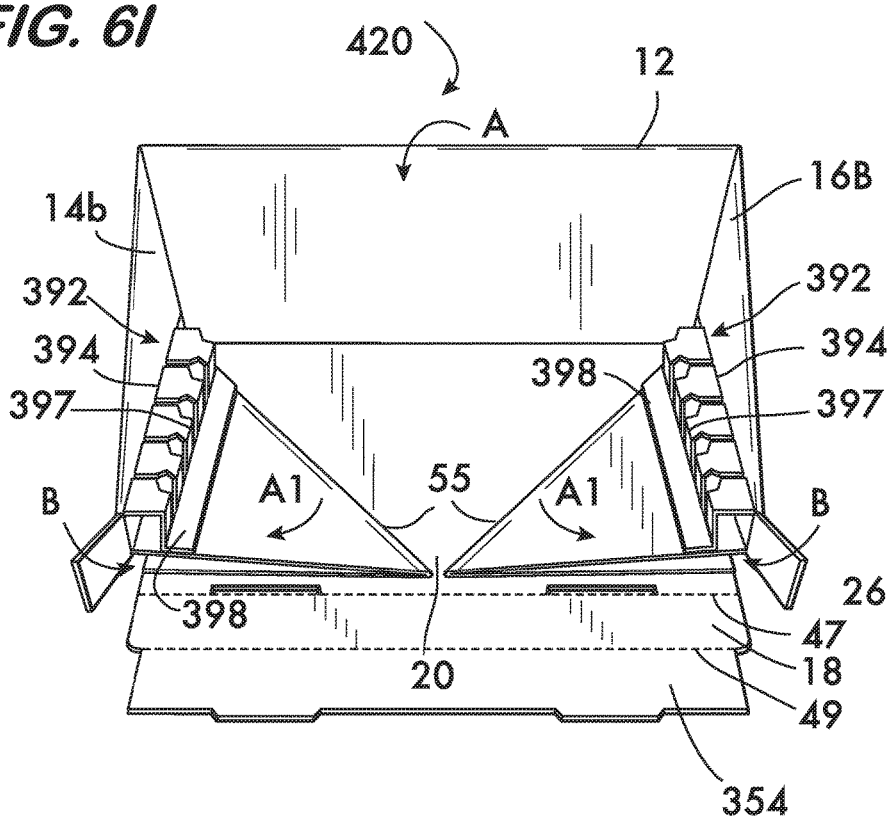

The blank 422 is assembled to form the knockdown 424 shown in FIG. 60, which knockdown 424 can be opened into the display tray 420. Referring to FIGS. 58-60, assembly of the knockdown 424 is illustrated, although it is similar to that described above for knockdown 406 (FIG. 51). With initial reference to FIG. 58, adhesive is applied along the glue lines 64 (on side panels 14 and 16), 74 (on connection portions 24*b*) and 426 (on end panel sections 398) in the patterns shown. Turning to FIG. 59, the side panel roll over portions 14*b*, 16*b* are folded over the respective fold lines 44 and 46 and secured to the respective main portions 14*a*, 16*a* to form the side panels 14, 16. It is seen that the product support panels 392, integrally connected to respective side panels 14*b*, 16*b*, fold therewith and adhere to the inside face 206 of the alignment panels portions 24*a* via glue lines 426. Finally, the side panels 14, 16 with product support panels 392, tuck tabs 26 and alignment panels 24 (24*a* and 24*b*) connected thereto, are folded over respective fold lines 41, 43 into face to face relation with the rear panel 18 and bottom panel 20. The connection portions 24*b* are secured at the glue lines 74 to the bottom panel 20.

As seen in FIG. 60, the upper planar section 37 of the knockdown includes side panels 14, 16, alignment portions 24*a*, connection portions 24*b* and product support panels 390; the lower planar section 39 includes the rear panel 12, bottom panel 20, front panel 18, and rollover rear panel 354. With all of the panels adhered, the knockdown 424 is now complete in the flat form illustrated in FIG. 61.

Figure 62:
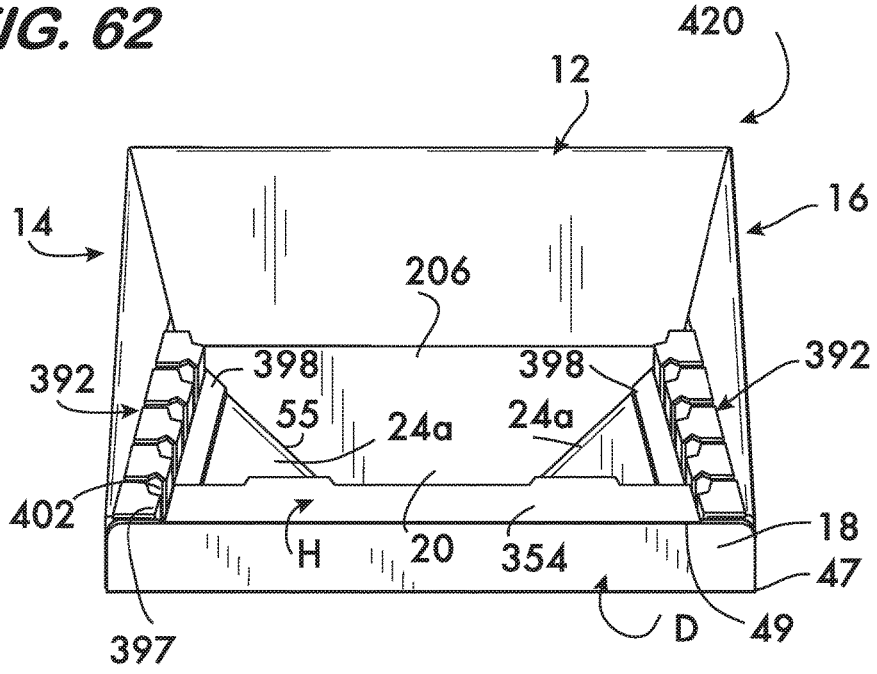

The knockdown 424 can be assembled into the display tray 420 as shown in FIGS. 60-62 in a similar manner to that described above for knockdown 406 (FIG. 51). Here, however, as the side panels 14, 16 unfold, the product support panels 392 extend away from the side panels 14, 16, pivoting about fold line 394, while also folding along fold line 397 due to the end panel sections 398 being adhered to the alignment panel portions 24*a*. It is seen that this configuration causes the product support panels 392 to form a square shape, although other configurations and shapes are possible.

The completion of the display tray is the same as that discussed above with reference to FIG. 53 with regard to the tuck tabs 26, front panel 18 and rollover panel 354.

Eighth Embodiment

Figure 63:
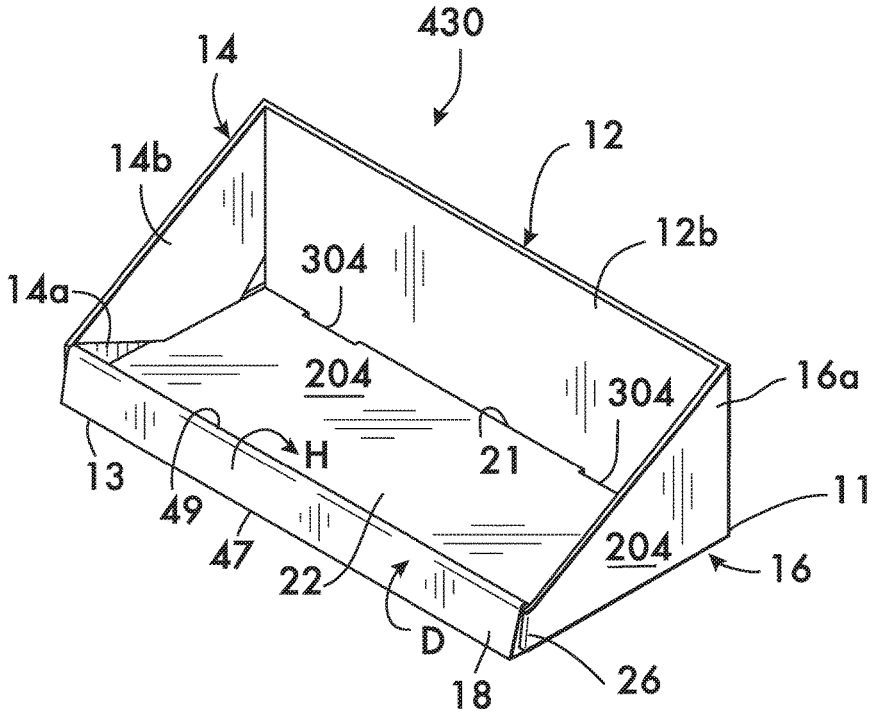
FIG. 63 is a perspective view of a display tray made in accordance with an eighth embodiment of the present invention.

An eighth embodiment will now be described with reference to FIGS. 63-68 showing a display tray 430 similar to the display tray 360 shown in FIGS. 38 to 40, but with the wall panels 14, 16 and alignment panels 24 reversed in position along the blank 432 such that when in the display tray form, the alignment panels 24 are positioned along the face of the rear panel 12 (hidden between the rear panel portions 12*a* and 12*b* as shown in FIG. 63), and not along the bottom panel 20 as in previous embodiments. This embodiment is now described in more detail with elements similar to those of the previously described embodiments identified with the same reference numbers.

With reference to FIG. 63, the display tray 430 includes opposed front and rear panels 18, 12 and opposed side panels 14, 16 extending about and interconnected to one another by the bottom panel 20 (beneath the shelf panel 22). This embodiment includes a front rollover panel 354 and a shelf panel 22 as does the display tray 360 of FIG. 38. Tabs 302 extend from the edge 27 of rear panel 12 (here the edge of the rear rollover panel 12*b* of the rear panel 12) and engage corresponding slots 304 in the edge 21 of shelf panel 22.

Figure 64:
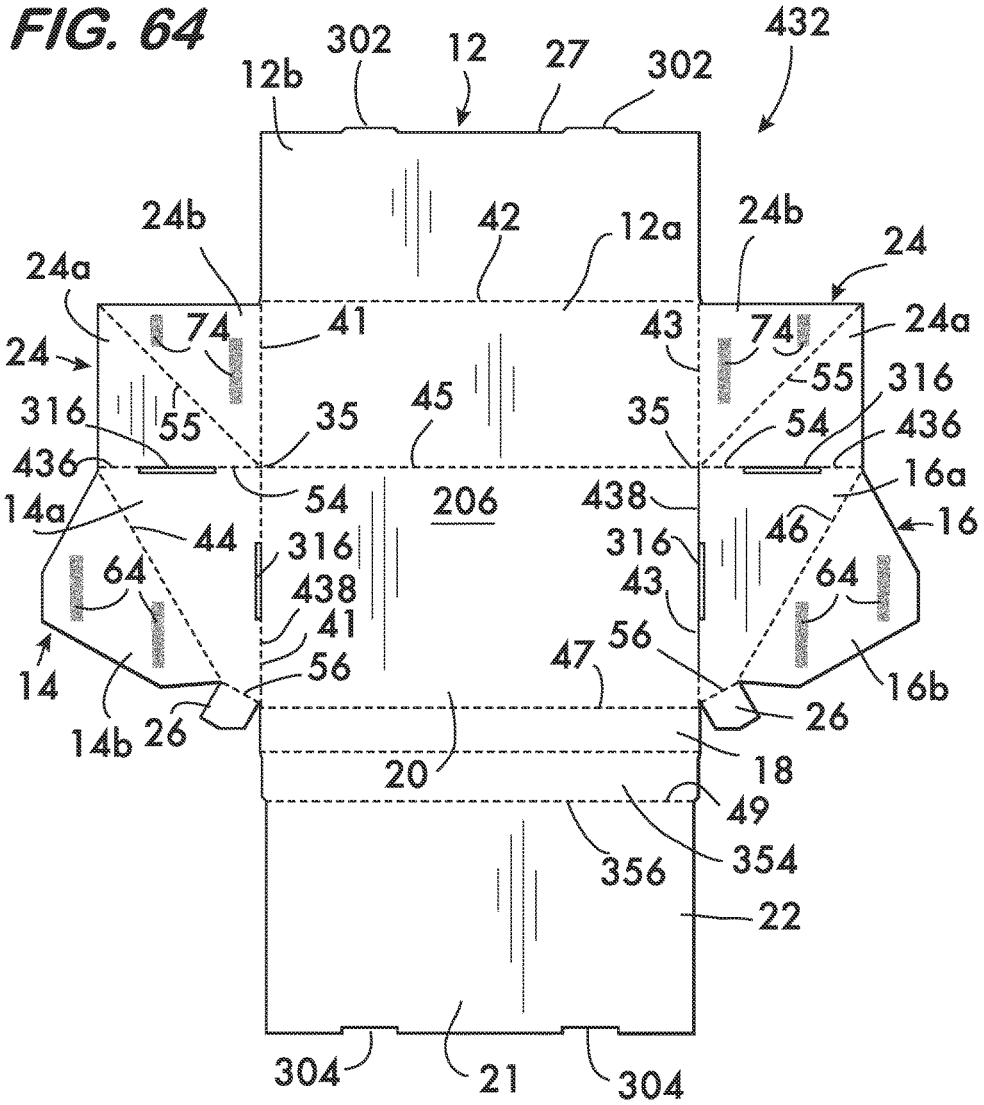
FIG. 64 is a plan view of a blank for forming the display tray shown in FIG. 63.

Referring to FIG. 64, a blank 432 for making the display tray 430 is shown. The blank is oriented to show the inner face 206, the outer face 204 being on the underside and not shown in this figure. The blank 432 includes as an integral unit the rear, side, front and bottom panels 12, 14, 16, 18 and 20, as well as the front rollover panel 354 and shelf panel 22. The rear panel 12 is connected to the bottom panel 20 along the fold line 45. The bottom panel 20 is in turn connected to the front panel 18 along the fold line 47. The front panel 18 is connected to the rollover front panel 354 along fold line 49, and the rollover front panel 354 is connected to the shelf panel 22 along the fold line 356. As with the embodiments described above, the rear panel 12, and the side panels 14, 16 include portions of the blank 432 folded or rolled over upon itself—the rear panel 12 is formed by rollover portion 12*b* folded about fold line 42 and glued to main rear panel portion 12*a*; side panel 14 is formed by rollover portion 14*b* folded about fold line 44 and glued to main side panel portion 14*b*; and side panel 16 is formed by rollover portion 16*b* folded about fold line 46 and glued to main side panel portion 16*a*. Here, however, the side panels 14, 16 are connected directly to the bottom panel 20 along fold lines 41, 43 respectively, and not to the rear panel 12 as in the prior embodiments.

Each alignment panel 24 extends from a respective side panel 14, 16 along fold line 54. Here, however, each alignment panel 24 connects to a side edge 436 of the side panels 14, 16, not the bottom edge 438 (see, e.g., FIGS. 1 and 39) of the side panels as in the prior embodiments. The alignment panels 24 each include diagonal fold lines 55 which divide the panels 24 into alignment portions 24*a* and connection portions 24*b*. Similar to the prior described embodiments, although slightly different in configuration, each diagonal fold line 55 extends from and/or intersects proximate a common corner 35 of the rear panel 12 (main panel 12*a*), the bottom panel 20, and the respective side panels 14, 16 (main panels 14*a*, 16*a*) at about a preferable 45 degree angle as shown, The tuck tabs 26 extend from the respective side panels 14, 16 along fold lines 56. As seen, the main difference from the prior described embodiments is the switching of the positions of the alignment panels 24 and respective side panels 14, 16.

Figure 65:
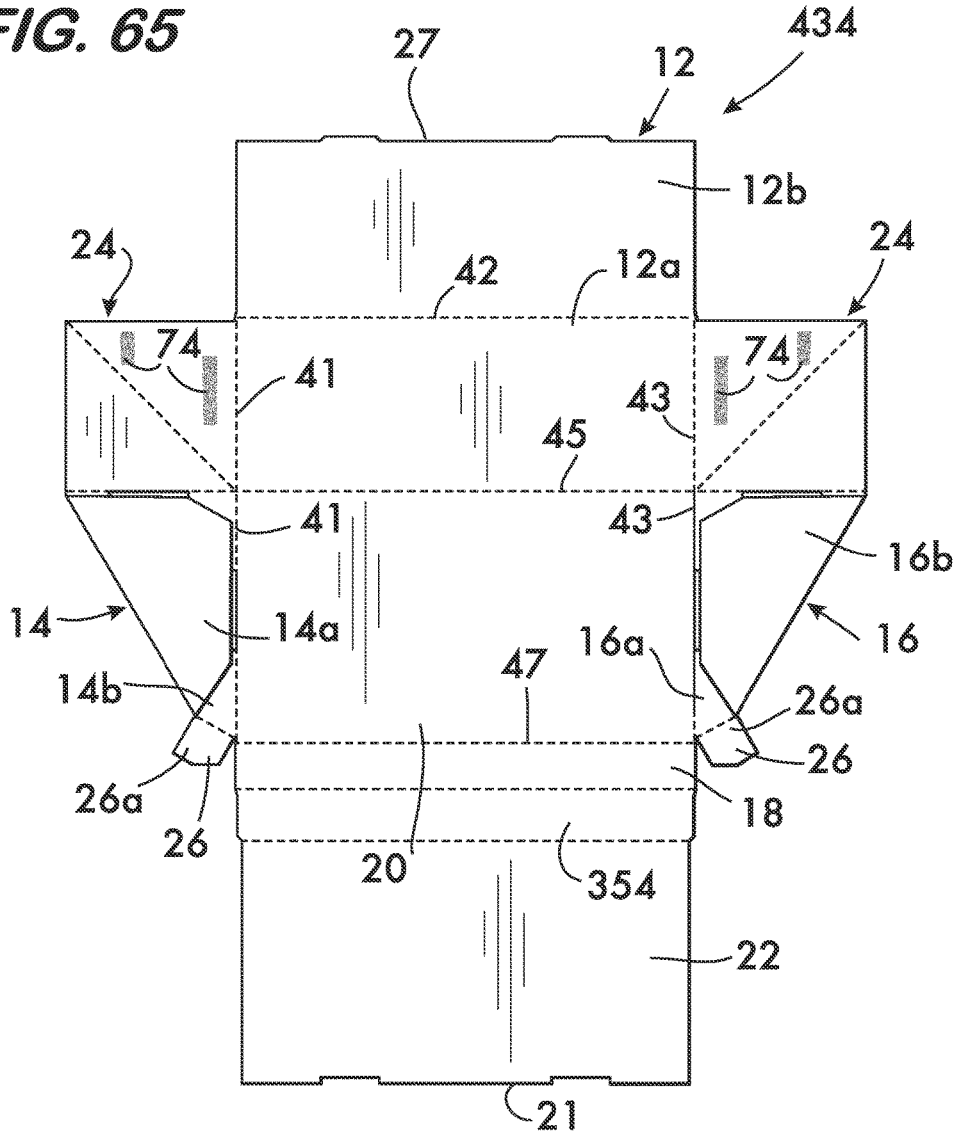
FIGS. 65-66 are plan views of the blank of FIG. 64 illustrating steps of assembly of a knockdown which may be opened into the display tray of FIG. 63, with FIG. 66 illustrating the completed knockdown.
Figure 66:
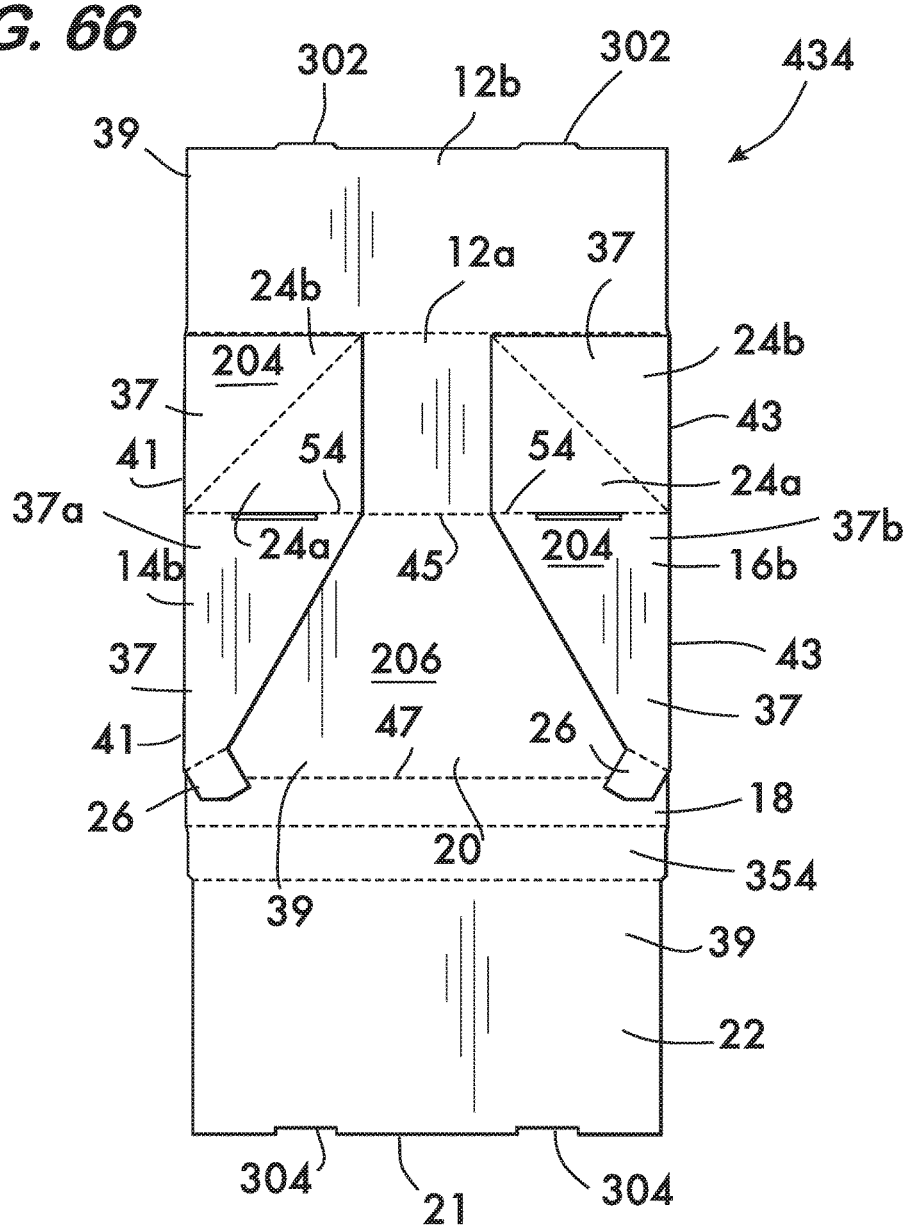

The blank 432 is assembled to form the knockdown 434 shown in FIG. 66, which knockdown 434 can be opened into the display 430 shown in FIG. 63. Referring to FIGS. 64-66, assembly of the knockdown 434 is illustrated. With specific reference to FIG. 64, adhesive is applied to the inside face 206 of the blank 432 along the glue lines 64 and 74 as shown. With further reference to FIG. 65, the side panel roll over portions 14*b*, 16*b* are folded over the respective fold lines 44, 46 and secured to the respective main portions 14*a*, 16*a* to form the side panels 14, 16. Then, side panels 14, 16 with alignment panels 24 (24*a* and 24*b*) connected thereto are folded about respective fold lines 41, 43 to bring the alignment panels 24 and side panels 14, 16 in face to face relation with the inner face 206 of the rear panel 12 (rear main panel 12*a*) and bottom panel 20. The connection portions 24*b* are secured to the main rear panel 12*a* at the glue lines 74 while the alignment portions 24*a* and the side panels 14, 16 remain free relative to the face of the rear panel 12*a* and the bottom panel 20 for movement as described below.

With all of the panels adhered, the knockdown 434 is now complete in the flat form illustrated in FIG. 66. Similar to the previously described embodiments, the knockdown 434 includes upper and lower planar sections 37 and 39 adjacent to and in a proximate face to face parallel relation with each other connected at edges defined by fold lines 41 and 43. The upper section 37 includes alignment portion 24*a*, connection portion 24*b*, and the side panels 14; the lower planar section 39 includes rear panel 12, bottom panel 20, front panel 18, rollover front panel 354 and shelf panel 22. Also, upper section 37 includes first upper portion 37*a* and second upper portion 37*b* each incorporating a respective side wall 14, 16 and alignment panel 24 as shown.

Figure 67:
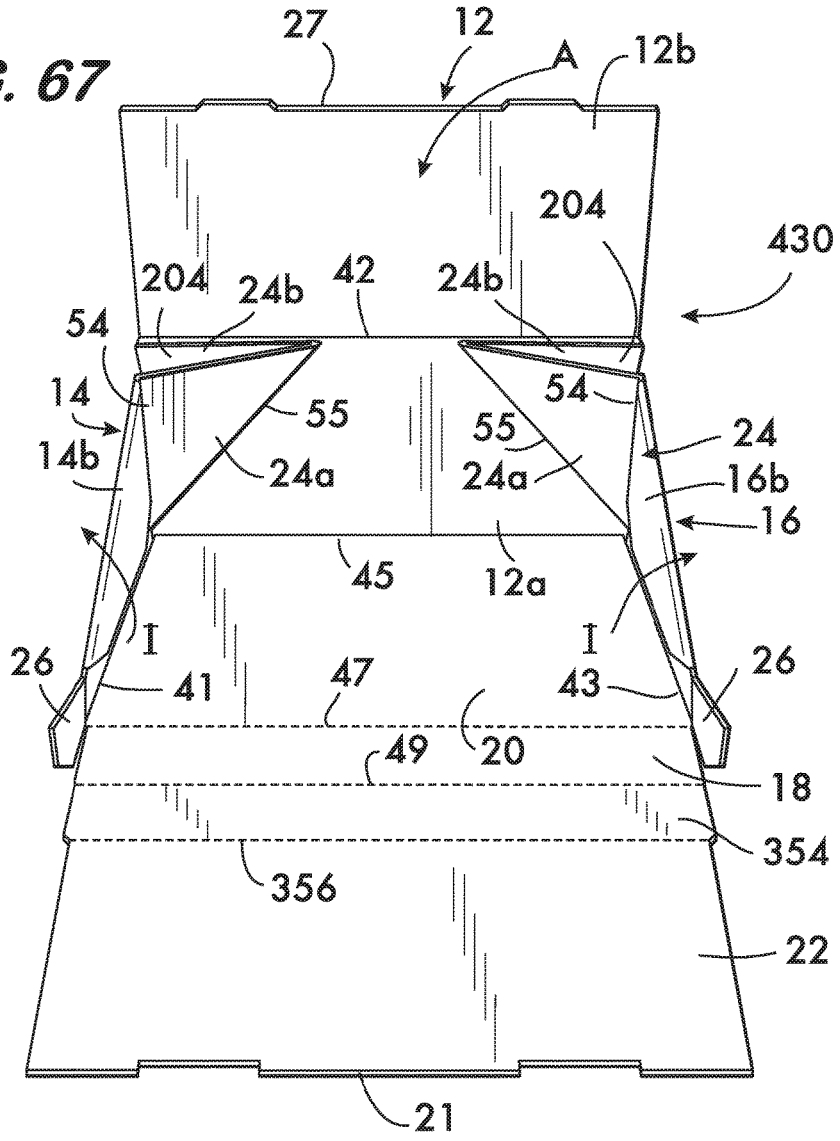
FIGS. 67-68 are perspective views illustrating steps of assembly of the knockdown into the display tray of FIG. 63.

The knockdown 434 can be assembled into the display tray 430 in a similar manner to that described for the other embodiments above, as now described with reference to FIGS. 66-68. Referring initially to FIG. 67, it is seen that as the alignment panel 24 folds along fold line 55 bringing the outer face 204 of the alignment portion 24*a* into face to face relation with the outer face 204 of the connection portion 24*b*, the rear panel 12 and the side panels 14, 16 move into their final display tray 430 positions. This can be initiated in various ways, including by rotating the rear panel 12 upwardly about fold line 45 as indicated by arrow A, which causes the alignment panel 24 to fold about fold line 55 as discussed above, which in turn causes each of the side panels 14, 16 to rotate outward as indicated by the arrows I. A second way to assemble is by rotating the side panels 14, 16 outward into their display tray position as indicated by arrows I which causes, via the alignment panels 24, the movement of the rear panel 12 as shown by arrow A into its display tray form. Thus the folding of the alignment panels 24 cause each side panel 14, 16 to generally align with a respective side edge of the bottom panel 20 (at fold line 41 and 43), and cause the side panels 14, 16 and the rear panel 12 into a generally perpendicular position relative to the bottom panel 20.

Figure 68:
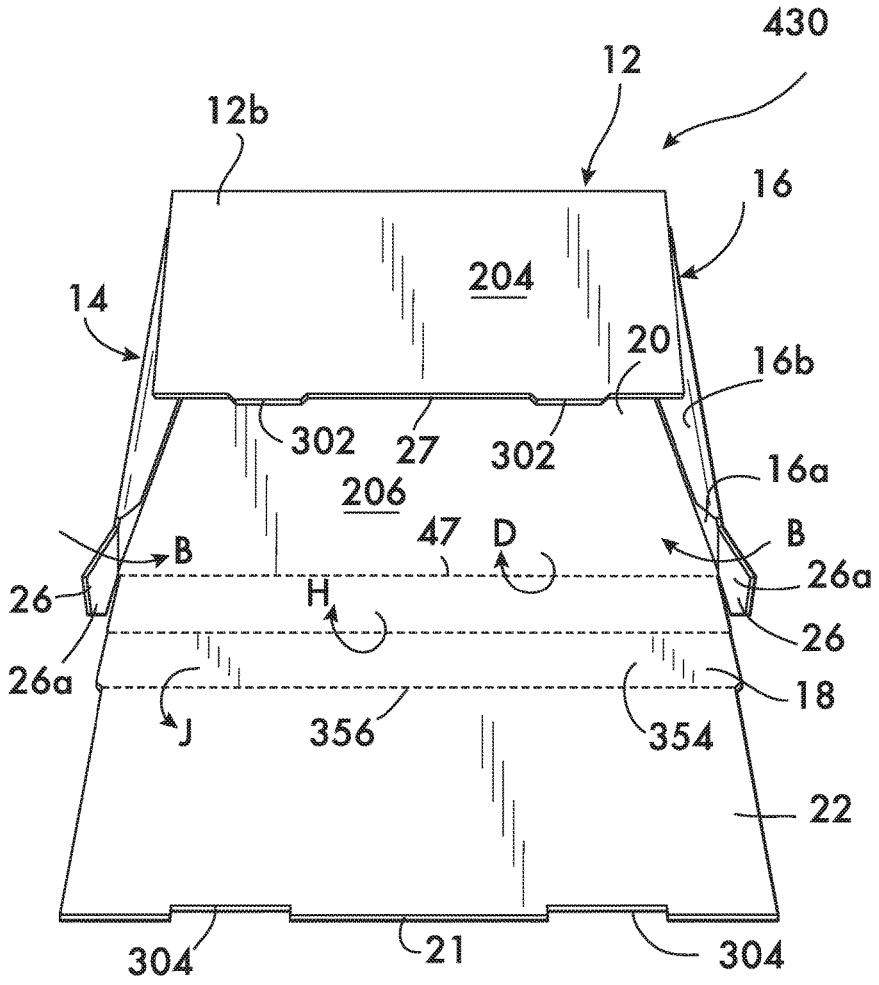

Turning to FIG. 68, the tuck tabs 26 are folded in the direction indicated by arrow B to a position parallel to front panel 18 as shown in FIG. 63. The front panel 18 and the shelf panel 22 are pivoted about the fold line 47, as indicated by arrow D (FIG. 63), moving front panel 18 into its final display tray position seen in FIG. 63. The rollover front panel 354 is further pivoted as indicated by the arrow H (FIG. 63) about fold line 49 such that the rollover front panel 354 engages the inside surface 26*a* of the respective tuck tab 26 while the shelf panel 22 folds in the opposite direction J about fold line 356 and is pushed into a flat position over the inside face 206 of bottom panel 20 such that the slots 304 along the edge 21 of shelf panel 22 lock around the tabs 302 along the edge 27 of the rollover rear panel 12*b*, thereby completing the display tray as seen in FIG. 63.

These and other advantages of the present invention will be apparent to those skilled in the art from the foregoing specification. Accordingly, it will be recognized by those skilled in the art that changes or modifications may be made to the above-described embodiments without departing from the broad inventive concepts of the invention. It should therefore be understood that this invention is not limited to the particular embodiments described herein, but is intended to include all changes and modifications that are within the scope and spirit of the invention as defined in the claims. For example, the above embodiments use various terms of orientation that are arbitrary such as rear and front and upper and lower in relation to the various panels. It is appreciated that what such terms are interchangeable without deviating from the spirit of the invention.

We claim:

1. A knockdown that can be assembled into a display tray; comprising:

a bottom panel positioned between opposed front and rear panels and opposed side panels when in the display tray form, the bottom panel being connected to the rear panel along a fold line;

an alignment panel connected to one of said side panels along a fold line, said alignment panel having an alignment portion and a connection portion connected to one another along a fold line which intersects proximate a common corner of said rear panel, said bottom panel, and said one of said side panels, said connection portion having a face;

an upper planar section which includes said alignment portion, said connection portion and said one of said side panels;

a lower planar section which includes said rear panel and said bottom panel, said lower planar section having a face, wherein said face of said connection portion and said face of said lower planar section are attached to one another in a face to face relation; and said alignment portion is foldable relative to said connection portion about said fold line therebetween so as to align said one side panel and said rear panel into their display tray positions.

2. A knockdown in accordance with claim 1 wherein the opposed side panels are connected to the rear panel along respective fold lines and an inner face of said connection portion is attached to an inner face of said bottom panel.

3. A knockdown in accordance with claim 1 wherein the opposed side panels are connected to the bottom panel along respective fold lines and said connection portion is attached to a face of said rear panel.

4. A knockdown in accordance with claim 1 wherein said knockdown is formed from a single integrated sheet.

5. A knockdown in accordance with claim 1 further comprising a second alignment panel connected to the other of said side panels along a fold line, said second alignment panel having a second alignment portion and a second connection portion connected to one another along a fold line.

6. A knockdown in accordance with claim 1 wherein the opposed side panels are connected along fold lines to opposed sides of the rear panel.

7. A knockdown in accordance with claim 1 wherein the opposed side panels are connected along fold lines to opposed sides of the bottom panel.

8. A knockdown in accordance with claim 1 wherein said alignment panel is attached to said bottom panel along a fold line.

9. A knockdown in accordance with claim 1 wherein at least one of said side and rear panels include a main section and a roll over section attached thereto along a fold line.

10. A knockdown in accordance with claim 1 wherein said alignment portion is foldable into face to face relation with said connection portion about said fold line therebetween so as to align said one side panel and said rear panel into their display tray positions.

11. A knockdown in accordance with claim 1 further comprising a shelf panel connected to and extending from an edge of the font panel, said shelf panel being foldable relative to said front panel to a position extending between said front, rear and opposed side panels when in the assembled display tray.

12. A knockdown in accordance with claim 11 wherein said shelf panel includes a main shelf panel and at least one rollover panel attached to said main shelf panel in face to face relation therewith.

13. A knockdown in accordance with claim 1 further comprising a tuck tab connected along a fold line to and extending from at least one of said side panels, said tuck tab being foldable to be adjacent said front panel in face to face relation when the knockdown is assembled into the display tray.

14. A knockdown in accordance with claim 11 further comprising at least one slant back return panel section formed in said shelf panel, and which is foldable about a fold line away from said shelf panel to engage said tuck tab when the knockdown is assembled into the display tray.

15. A knockdown in accordance with claim 1 further comprising at least one reinforcing panel connected to said first alignment panel, said reinforcing panel positioned in said upper planar section when in the knockdown form and adjacent said front panel in the assembled display tray.

16. A knockdown in accordance with claim 1 further comprising a front rollover panel connected to said front panel, said front panel and said front rollover panel positioned in said lower planar section when in the knockdown form, and which front rollover panel is folded relative to said front panel when in the assembled display tray.

17. A knockdown in accordance with claim 1 further comprising at least one product support panel connected to any one of said side panels, said product support panel positioned in said upper planar section when in the knockdown form.

18. A knockdown in accordance with claim 17 wherein said product support panel includes at least one slot formed therein for receiving retail product therein.

19. A knockdown in accordance with claim 16 further comprising a shelf panel connected to and extending from said front rollover panel, said shelf panel extending from said front rollover panel towards said rear panel.

20. A knockdown in accordance with claim 1 wherein said upper and lower planar sections are further attached to one another along a fold line.

21. A knockdown in accordance with claim 2 wherein the opposed side panels are connected along fold lines to opposed sides of the rear panel.

22. A knockdown in accordance with claim 3 wherein the opposed side panels are connected along fold lines to opposed sides of the bottom panel.

23. A knockdown in accordance with claim 2 wherein said alignment panel is attached to said bottom panel along a fold line.

24. A knockdown in accordance with claim 3 wherein said alignment panel is attached to said side panels along a fold line.

25. A knockdown in accordance with claim 2 wherein said alignment portion is foldable into face to face relation with said connection portion about said fold line therebetween so as to align said one side panel and said rear panel into their display tray positions.

26. A knockdown in accordance with claim 3 wherein said alignment portion is foldable into face to face relation with said connection portion about said fold line therebetween so as to align said one side panel and said rear panel into their display tray positions.

27. A knockdown in accordance with claim 2 wherein said upper and lower planar sections are further attached to one another along a fold line.

28. A knockdown in accordance with claim 3 wherein said upper and lower planar sections are further attached to one another along a fold line.

29. A display tray assembled from the knockdown as set forth in claim 1.

30. A knockdown in accordance with claim 1 wherein said inner face of said connection portion is attached to said inner face of said lower planar section by an adhesive.

31. A knockdown in accordance with claim 30 wherein said face of said connection portion is attached to a face of said bottom panel.

32. A knockdown that can be assembled into a display tray; comprising:

a bottom panel positioned between opposed front and rear panels and opposed side panels when in the display tray form, the bottom panel being connected to the rear panel along a fold line;

an alignment panel connected to one of said side panels along a fold line, said alignment panel having an alignment portion and a connection portion connected to one another along a fold line, said connection portion having an inner face;

an upper planar section which includes one of said side panels and said alignment panel in a first plane;

a lower planar section which includes said rear panel and said bottom panel in a second plane disposed below said first plane, said lower planar section having an inner face, wherein said upper and lower planar sections are adjacent to one another and attached to one another along a fold line, and said inner face of said connection portion and said inner face of said lower planar section are attached to one another in a face to face relation; and each said alignment portion is foldable into face to face relation with its respective connection portion about said fold line therebetween so as to align said side panels and said rear panel into their display tray positions.

33. A knockdown in accordance with claim 32 wherein the opposed side panels are connected to the rear panel along respective fold lines and said inner face of said connection portion is attached to a face of said bottom panel.

34. A knockdown in accordance with claim 32 wherein the opposed side panels are connected to the bottom panel along respective fold lines and said connection portion is attached to a face of said rear panel.

35. A knockdown in accordance with claim 32 wherein said fold line connecting said alignment portion to said connection portion of each alignment panel extends in an approximate direction towards a common corner of said rear panel, said bottom panel, and a respective one of said side panels.

36. A display tray assembled from the knockdown as set forth in claim 32.

37. A knockdown in accordance with claim 32 wherein said inner face of said connection portion is attached to said inner face of said lower planar section by an adhesive.

* * * * *